US007770890B2

(12) United States Patent
Ohnishi et al.

(10) Patent No.: US 7,770,890 B2
(45) Date of Patent: Aug. 10, 2010

(54) IMAGE FORMING APPARATUS AND IMAGE FORMING METHOD

(75) Inventors: Hidenori Ohnishi, Yamatokoriyama (JP); Masami Tsuchida, Yamatokoriyama (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 718 days.

(21) Appl. No.: 11/543,914

(22) Filed: Oct. 6, 2006

(65) Prior Publication Data

US 2007/0090586 A1 Apr. 26, 2007

(30) Foreign Application Priority Data

Oct. 21, 2005 (JP) ..... 2005-307514
Oct. 25, 2005 (JP) ..... 2005-310295

(51) Int. Cl.
*B65H 39/10* (2006.01)
*B65H 7/12* (2006.01)

(52) U.S. Cl. ..... 271/298; 271/262; 271/176

(58) Field of Classification Search ..... 271/298, 271/262, 176

See application file for complete search history.

(56) References Cited

U.S. PATENT DOCUMENTS 4,851,876 A * 7/1989 Yamamoto et al. ..... 399/402
7,017,903 B2 3/2006 Fujii et al.

FOREIGN PATENT DOCUMENTS

| | | | |
|---|---|---|---|
| JP | 06-303375 | A | 10/1994 |
| JP | 07-140854 | A | 6/1995 |
| JP | 08-091630 | A | 4/1996 |
| JP | 10-109785 | A | 4/1998 |
| JP | 11-349187 | A | 12/1999 |
| JP | 2000-165594 | A | 6/2000 |
| JP | 2002-333797 | A | 11/2002 |
| JP | 2003-327361 | A | 11/2003 |
| JP | 2004-170729 | A | 6/2004 |
| JP | 2005-015166 | A | 1/2005 |
| JP | 2005-173472 | A | 6/2005 |
| JP | 2005-244425 | A | 9/2005 |

* cited by examiner

*Primary Examiner*—Patrick Mackey
*Assistant Examiner*—Luis Gonzalez
(74) *Attorney, Agent, or Firm*—Birch, Stewart, Kolasch & Birch, LLP

(57) ABSTRACT

An image on a fed document is read, and recording paper on which an output image is formed based on the read image is discharged onto a first tray. When overlapped feeding is detected at the time of feeding a document, page numbers of the overlapped documents are recorded, and an image on a document fed after the overlapped documents is read, an output image is formed on recording paper based on the read image, and the recording paper is discharged onto a second tray to notify the occurrence of overlapped feeding. When the documents are set again by the user and fed, an image on a document of a page number matching a recorded page number is read, an output image is formed on recording paper based on the read image, and the recording paper is discharged onto the first tray.

7 Claims, 32 Drawing Sheets

IMAGE FORMING APPARATUS AND IMAGE FORMING METHOD

CROSS-REFERENCE TO RELATED APPLICATIONS

This non-provisional application claims priority under 35 U.S.C. §119(a) on Patent Application No. 2005-307514 filed in Japan on Oct. 21, 2005, and Patent Application No. 2005-310295 filed in Japan on Oct. 25, 2005, the entire contents of which are hereby incorporated by reference.

BACKGROUND OF THE INVENTION

1. Field of the Invention

The present invention relates to an image forming apparatus and an image forming method capable of continuing image formation without stopping a document reading process even when multiple documents are fed in an overlapped manner at the time of feeding a document.

The present invention also relates to an image forming apparatus and an image forming method capable of reducing the burden of the user and continuing image formation even when sheets on which images are to be formed are fed in an overlapped manner.

2. Description of Related Art

In recent years, an image forming apparatus such as a digital complex machine having a scanner function, a printer function, and a facsimile function comprises an automatic document reading apparatus, and processes a large amount of documents at high speeds by feeding one sheet of document at a time from a stack of documents placed on a document tray of the automatic document reading apparatus to an image reading unit, reading an image recorded on the document, and performing a process such as printing on recording paper based on the read image.

However, when feeding a document by the automatic document reading apparatus, overlapped feeding in which two or more sheets of documents are fed in an overlapped manner may sometimes occur because the apparatus may fail to separate and feed one sheet of document at a time due to the influence of humidity or static electricity at the time of feeding the document. Conventionally, when overlapped feeding occurs in an image forming apparatus, the feed of the documents is stopped, and image forming processes such as an exposure process, a development process, a transfer process and a fixing process are also stopped. Therefore, there is a problem that the job efficiency of the image forming processes is decreased, or a problem that a lot of burden is placed on the user to perform a recovery process when overlapped feeding occurs. Hence, there were proposed image reading apparatuses and image forming apparatuses capable of taking appropriate measures when overlapped feeding occurs.

For example, there was proposed a facsimile machine in which image data about each page of a document obtained by reading and scanning the document is stored in an image memory, and, when overlapped feeding is detected at the time of reading a document, the contents of the image data stored in the image memory are printed on recording paper, and thus the user who sees the contents of the image data can easily determine which page of documents was not read nor scanned (see, for example, Japanese Patent Application Laid-Open No. 06-303375 (1994)).

Moreover, there was proposed an image reading apparatus in which, when overlapped feeding is detected at the time of reading a document, marking is added to the surface of the overlapped documents, so that documents which were read and documents which have not been read are easily distinguished from each other (see, for example, Japanese Patent Application Laid-Open No. 08-91630 (1996)).

There was also proposed an image reading apparatus in which, when overlapped feeding is detected at the time of reading a document, the overlapped documents and documents that were not fed in an overlapped manner are sorted from each other and discharged separately, and therefore, even when overlapped feeding occurs, it is possible to reduce the operational burden of the operator by continuing to feed documents without stopping, collecting only documents failed for reading due to overlapped feeding after completion of reading the documents, and performing the reading operation again (see, for example, Japanese Patent Application Laid-Open No. 2000-165594).

Further, in recent years, image forming apparatuses, such as a printer or a digital copying machine having a scanner function, a printer function and a facsimile function, can process a large volume of data at high speeds by performing a printing process on recording paper, based on image data transmitted from an external personal computer, or image data stored in a memory device such as a HDD beforehand.

However, when feeding the recording paper from a paper feed cassette to perform the printings process on the recording paper, overlapped feeding in which two or more sheets of recording paper are fed in an overlapped manner without separating and feeding the recording paper one sheet at a time may sometimes occur due to the influence of humidity or static electricity. Conventionally, when overlapped feeding occurs in the image forming apparatus, the feed of the recording paper is stopped, and image forming processes such as an exposure process, a development process, a transfer process and a fixing process are also stopped. Therefore, there is a problem that the job efficiency of the image forming processes is decreased, or a problem that a lot of burden is placed on the user to perform a recovery process when overlapped feeding occurs. Hence, there was proposed an image forming apparatus capable of taking appropriate measures when overlapped feeding occurs.

For example, there was proposed an image forming apparatus in which, when overlapped feeding is detected in feeding recording paper, the recording paper involved in overlapped feeding is discharged as it is onto a specified tray without forming an image, image data supposed to be formed on the recording paper is saved, and an image is formed based on the saved image data on recording paper supplied from a recording paper supply section, and thus it is possible to ensure continuity of image forming processes and reuse the recording paper involved in overlapped feeding (see, for example, Japanese Patent Application Laid-Open No. 2002-333797).

Further, there was proposed an image forming apparatus for creating a bunch of paper with an insertion paper inserted between sheets of recording paper, in which when sheets of the insertion paper are fed in an overlapped manner, a bunch of paper created normally and a bunch of paper which was not created normally due to overlapped feeding are discharged separately onto different discharge trays (see, for example, Japanese Patent Application Laid-Open No. 2003-327361).

In addition, there was proposed an image forming apparatus in which, when overlapped feeding is detected at the time of feeding transfer paper, the image creating conditions such as a fixation temperature or transfer conditions are changed according to an overlapped feeding detection value, such as the thickness of the transfer paper or the length of the transfer paper in the transport path direction, and therefore, even when overlapped feeding occurs, it is possible to perform image formation without stopping a printing operation (see, for example, Japanese Patent Application Laid-Open No. 2005-15166).

SUMMARY OF THE INVENTION

However, in the facsimile machine of Japanese Patent Application Laid-Open No. 06-303375 (1994), in order to determine which pages of documents were fed in an overlapped manner, the user needs to see the images printed on the recording paper. Thus, although the user can determine which documents were fed in an overlapped manner, if a large amount of documents need to be handled, the user must determine an image involved in overlapped feeding from the images printed on a large number of sheets of recording paper, and a long time is required to make the determination and more time is required for the whole processes. Therefore, there has been a demand for reducing the burden of the user.

In the image reading apparatus of Japanese Patent Application Laid-Open No. 08-91630 (1996), in order to determine which pages of documents were fed in an overlapped manner, the user needs to see the marking added to the document. Thus, although the user can determine which documents were fed in an overlapped manner, if a large amount of documents need to be handled, the user must find the marking from many sheets of documents, and a long time is required for this operation and more time is required for the whole processes. Therefore, there has been a demand for reducing the burden of the user.

In the image forming apparatus of Japanese Patent Application Laid-Open No. 2000-165594, even when overlapped feeding occurs, it is possible to continue to read documents without stopping, collect only documents which could not have been read satisfactorily due to overlapped feeding after completing the reading of documents, and perform the reading operation again. However, this patent application does not describe the process of forming an image on recording paper after reading a document. Therefore, there has been a demand for an image forming apparatus capable of preventing a decrease in the overall job efficiency of the apparatus and reducing the burden of the user even when overlapped feeding occurs in processing a large number of documents at high speeds.

In the image forming apparatus of Japanese Patent Application Laid-Open No. 2002-333797, although recording paper involved in overlapped feeding is discharged onto a different tray, sheets of recording paper created normally before and after the occurrence of overlapped feeding are discharged onto a single tray. Therefore, the user needs to find a correct place between the normally printed sheets of recording paper and insert into the correct place recording paper having an image, which was supposed to be printed on the recording paper involved in overlapped feeding, printed thereon and discharged onto the specified tray. When printing a particularly large number of sheets of recording paper, the burden of the user increases, and therefore there has been a demand for an image forming apparatus capable of reducing the burden of the user.

In the image forming apparatus of Japanese Patent Application Laid-Open No. 2003-327361, when overlapped feeding of insertion paper to be inserted between sheets of recording paper occurs, it is possible to distinguish a bunch of paper involved in overlapped feeding from a normally created bunch of paper by discharging the bunch of paper involved in overlapped feeding onto a different tray. However, this patent application does not describe a process to be performed when overlapped feeding occurs on recording paper fed when printing a different image on each of many sheets of recording paper. Therefore, there has been a demand for an image forming apparatus capable of reducing the burden of the user and continuing image formation even when overlapped feeding of recording paper occurs in forming images on many sheets of recording paper.

In the image forming apparatus of Japanese Patent Application Laid-Open No. 2005-15166, when overlapped feeding is detected, if an overlapped feeding detection value exceeds a set value, the image creating operation is interrupted, and thus there is a possibility that the overall job efficiency of the apparatus may be decreased when overlapped feeding occurs. In particular, when a large volume of data needs to be processed at high speeds, the job efficiency of the apparatus decreases considerably, and therefore there has been a demand for an image forming apparatus capable of continuing image formation even when overlapped feeding of recording paper occurs.

The present invention has been made with the aim of solving the above problems, and it is an object of the present invention to provide an image forming apparatus and an image forming method in which, when overlapped feeding of fed documents is detected, a sheet having an output image formed by reading an image from a document fed before the detection of overlapped feeding is discharged onto a first tray, and a sheet on which an output image is formed by reading an image from a document fed after the overlapped documents where overlapped feeding was detected is discharged onto a second tray, and therefore, even when overlapped feeding is detected, it is possible to continue the image forming processes and prevent a decrease in the overall job efficiency of the apparatus, and it is possible to reduce the burden of the user without requiring the user to perform extra work such as confirming all the discharged sheets and rearranging the sheets in the read order of the documents.

Another object of the present invention is to provide an image forming apparatus capable of determining whether or not an image recorded on documents fed in an overlapped manner is readable, and in which an image forming unit forms an output image based on an image read from the overlapped documents by an image reading unit when a determination is made that the image is readable, and thereby capable of continuing image forming processes on the overlapped documents and preventing a decrease in the overall job efficiency of the apparatus without wasting the time required for feeding the documents.

Still another object of the present invention is to provide an image forming apparatus capable of continuing image forming processes on overlapped documents by discharging onto the first tray a sheet on which an output image is formed by reading an image on a document of the first feed number in the overlapped documents if the image on the overlapped documents is readable, and thereby capable of preventing a decrease in the overall job efficiency of the apparatus without wasting the time required for feeding the documents, and capable reducing the burden of the user.

Yet another object of the present invention is to provide an image forming apparatus capable of continuing image forming processes on overlapped documents by discharging onto the second tray a sheet on which an output image is formed by reading an image on a document of the last feed number in the overlapped documents if the image on the overlapped documents is readable, and thereby capable of preventing a decrease in the overall job efficiency of the apparatus without wasting the time required for feeding the documents, and capable reducing the burden of the user without requiring extra work such as rearranging the sheets in the read order of the documents.

A further object of the invention is to provide an image forming apparatus capable of determining the number of sheets of overlapped documents, and thereby capable of certainly specifying the last feed number in the overlapped documents regardless of the number of sheets of the overlapped documents.

A further object of the invention is to provide an image forming apparatus capable of storing the feed number of a document failed to read an image in the overlapped documents, and forming an output image based on an image read from a document of a stored feed number when a plurality of the fed documents are fed again, thereby capable of reducing the burden of the user without requiring extra work such as rearranging the sheets in the read order of the documents.

A further object of the invention is to provide an image forming apparatus capable of storing the feed numbers of overlapped documents, and forming an output image based on an image read from a document of a stored feed number when a plurality of the fed documents are fed again, and thereby capable of reducing the burden of the user without requiring extra work such as rearranging the sheets in the read order of the documents.

A further object of the invention is to provide an image forming apparatus capable of determining the number of sheets of overlapped documents, and thereby capable of certainly specifying the feed numbers of the overlapped documents regardless of the number of sheets of the overlapped documents.

A further object of the invention is to provide an image forming apparatus capable of discharging onto the first tray a sheet on which an output image is formed by reading an image on a document when a plurality of the fed documents are fed again, and thereby capable of reducing the burden of the user without requiring extra work such as rearranging the sheets in the read order of the documents.

A further object of the invention is to provide an image forming apparatus and an image forming method in which, when overlapped feeding of sheets (for example, recording paper) is detected, a sheet having an image formed before the detection of overlapped feeding is discharged onto a first tray, and a sheet fed after overlapped sheets where overlapped feeding was detected and having an image formed thereon is discharged onto a second tray, thereby capable of continuing image forming processes and preventing a decrease in the overall job efficiency of the apparatus even when overlapped feeding is detected, and capable of reducing the burden of the user without requiring the user to make corrections when overlapped feeding occurs.

A further object of the invention is to provide an image forming apparatus capable of easily distinguishing sheets fed in an overlapped manner and sheets on which images were normally formed from each other by discharging the overlapped sheets onto a third tray, and capable of reducing the burden of the user without requiring the user to perform extra work such as confirming all the discharged sheets and removing unnecessary sheets.

A further object of the invention is to provide an image forming apparatus capable of forming an image involved in overlapped feeding and supposed to be formed on overlapped sheets on a sheet based on image data corresponding to the image, and thereby continuing image forming processes without stopping and capable of preventing a decrease in the overall job efficiency of the apparatus even when overlapped feeding occurs.

A further object of the invention is to provide an image forming apparatus capable of determining whether or not it is possible to interrupt image formation in progress when overlapped feeding is detected, so that even when overlapped feeding occurs, it is possible to continue image forming processes without wasting image formation in progress, and it is possible to promptly form an image involved in overlapped feeding when it becomes possible to interrupt the image forming processes.

A further object of the invention is to provide an image forming apparatus comprising an image processing unit for generating data for use in forming an image based on image data, and capable of determining whether not it is possible to interrupt image formation in progress, based on the data already generated in the image processing unit, so that even when overlapped feeding occurs, it is possible to continue image forming processes without wasting image formation in progress, and it is possible to promptly form an image involved in overlapped feeding when it becomes possible to interrupt the image forming processes.

A further object of the invention is to provide an image forming apparatus capable of discharging onto the first tray a sheet on which an image involved in overlapped feeding is formed, and thereby capable of reducing the burden of the user without requiring the user to perform extra work, such as confirming all the discharged sheets and removing unnecessary sheets.

A further object of the invention is to provide an image forming apparatus capable of switching a tray based on a result of determining whether or not there is a sheet on the tray when overlapped feeding is detected, so that, even when overlapped feeding occurs a plurality of times, it is possible to continue image forming processes without a need to stop the image forming processes to discharge sheets, or a need to confirm the order of sheets to be discharged, or placing a burden on the user.

A further object of the invention is to provide an image forming apparatus capable of interrupting image formation when a determination is made that sheets are present on all of the trays and resuming the interrupted image formation when a determination is made that there is no sheet on at least one of the trays, so that even when overlapped feeding occurs a plurality of times, it is possible to continue image forming processes without a need to confirm the order of the discharged sheets, or placing a burden on the user.

A further object of the invention is to provide an image forming apparatus comprising an output unit for outputting an instruction to remove sheets on at least one of trays when a determination is made that sheets are present on all the trays, and thereby capable of using the already discharged sheets for post processing and continuing image forming processes without placing a burden on the user even when overlapped feeding occurs a plurality of times in performing a large amount of printing.

An image forming apparatus of the present invention is an image forming apparatus comprising: an image reading unit for reading an image recorded on a fed document; an image forming unit for forming an output image on a sheet, based on the image read by said image reading unit; a plurality of trays for discharging a sheet having an output image formed thereon; a detecting unit for detecting overlapped feeding of a plurality of documents; and a controller capable of controlling switching of the trays so that, when overlapped feeding is detected by said detecting unit, a sheet having an output image formed by said image forming unit based on an image read by said image reading unit from a document fed before the detection of overlapped feeding is discharged onto a first tray, and a sheet having an output image formed by said image forming unit based on an image read by said image reading unit from a document fed after the overlapped documents where overlapped feeding was detected is discharged onto a second tray.

An image forming apparatus of the present invention is characterized in that said controller is further capable of determining whether or not an image recorded on overlapped documents is readable when overlapped feeding is detected by said detecting unit, and when said controller determines that the image is readable, said image forming unit forms an output image based on the image read from the overlapped documents by said image reading unit.

An image forming apparatus of the present invention is characterized by further comprising a counting unit for counting a feed number of a fed document, wherein when the image is determined to be readable, said controller is further capable of causing a sheet having an output image formed by said image forming unit based on the image read by said image reading unit from a document of a first feed number in the overlapped documents to be discharged onto the first tray.

An image forming apparatus of the present invention is characterized by further comprising a counting unit for counting a feed number of a fed document, wherein said controller is further capable of causing a sheet on which an output image is formed by said image forming unit, based on an image read by said image reading unit from a document of a last feed number in the overlapped documents, to be discharged onto the second tray, when a determination is made that the image is readable.

An image forming apparatus of the present invention is characterized in that said controller is further capable of determining the number of sheets of overlapped documents, based on a detection result detected by said detecting unit; and specifying a last feed number of the overlapped documents, based on a determination result of said controller and a count result of said counting unit.

An image forming apparatus of the present invention is characterized by further comprising a storing unit for storing a feed number of a document whose image could not have been read in the overlapped documents, based on a count result of the counting unit and a determination result of said controller, when overlapped feeding is detected by said detecting unit, wherein, when a plurality of the fed documents are fed again, said image forming unit forms an output image based on an image read by said image reading unit from a document of a feed number stored in said storing unit.

An image forming apparatus of the present invention is characterized by further comprising: a counting unit for counting a feed number of a fed document; and a storing unit for storing feed numbers of overlapped documents, based on a count result of said counting unit, when overlapped feeding is detected by said detecting unit, wherein when a plurality of the fed documents are fed again, said image forming unit forms an output image based on an image read by said image reading unit from a document of a feed number stored in said storing unit.

An image forming apparatus of the present invention is characterized in that said controller is further capable of: determining the number of sheets of overlapped documents, based on a detection result detected by said detecting unit; and specifying feed numbers of the overlapped documents, based on a determination result of said controller and a count result of said counting unit.

An image forming apparatus of the present invention is characterized in that said controller is further capable of causing a sheet on which an output image is formed by said image forming unit, based on an image read from a document by said image reading unit, to be discharged onto the first tray, when a plurality of the fed documents are fed again.

An image forming method of the present invention is an image forming method for reading an image recorded on a fed document, forming an output image on a sheet based on the read image, and discharging the sheet having the output image formed thereon, comprising the steps of detecting overlapped feeding of a plurality of documents; and when overlapped feeding is detected, discharging onto different trays a sheet on which an output image is formed based on an image read from a document fed before the detection of overlapped feeding, and a sheet on which an output image is formed based on an image read from a document fed after the overlapped documents where overlapped feeding was detected.

An image forming apparatus of the present invention is an image forming apparatus comprising: an image forming unit for forming an image on a fed sheet, based on input image data; a plurality of trays for discharging a sheet having an image formed thereon; a detecting unit for detecting overlapped feeding of a plurality of sheets; and a controller capable of controlling switching of the trays so that, when overlapped feeding is detected by said detecting unit, a sheet having an image formed by said image forming unit before the detection of overlapped feeding is discharged onto a first tray, and a sheet which is fed after the overlapped sheets where overlapped feeding was detected and has an image formed by said image forming unit is discharged onto a second tray.

An image forming apparatus of the present invention is characterized in that said controller is further capable of causing the overlapped sheets to be discharged onto a third tray.

An image forming apparatus of the present invention is characterized in that when overlapped feeding is detected by said detecting unit, said image forming unit forms an image involved in overlapped feeding and to be formed on the overlapped sheets, on a sheet fed after the overlapped sheets, based on image data corresponding to the image.

An image forming apparatus of the present invention is characterized in that said controller is further capable of determining whether or not it is possible to interrupt image formation in progress when overlapped feeding is detected by said detecting unit, and when said controller determines that it is possible to interrupt the image formation, said image forming unit forms an image involved in overlapped feeding on a sheet fed after the overlapped sheets, based on image data corresponding to the image.

An image forming apparatus of the present invention is characterized by further comprising an image processing unit for generating data for use in forming an image based on image data, wherein said controller is further capable of determining whether or not it is possible to interrupt the image forming process, based on data already generated in said image processing unit, when overlapped feeding is detected.

An image forming apparatus of the present invention is characterized in that said controller is further capable of causing the sheet on which the image involved in overlapped feeding is formed to be discharged onto the first tray.

An image forming apparatus of the present invention is characterized in that said controller is further capable of determining presence or absence of sheets on a tray; and switching the tray, based on the determined presence or absence of sheets, when overlapped feeding is detected by said detecting unit.

An image forming apparatus of the present invention is characterized in that said image forming unit interrupts image formation when said controller determines that there are sheets on all of the trays, said image forming unit resumes the interrupted image formation when said controller determines that there is no sheet on at least one of the trays; and said controller is further capable of causing a sheet having an image formed by the resumed image formation to be discharged onto said tray.

An image forming apparatus of the present invention is characterized by further comprising an output unit for outputting an instruction to remove sheets on at least one of the trays if a determination is made that sheets are present on all of the trays when overlapped feeding is detected by said detecting unit.

An image forming method of the present invention is an image forming method for forming an image on a fed sheet based on input image data, and discharging the sheet having the image formed thereon, comprising the steps of detecting overlapped feeding of a plurality of sheets; and when overlapped feeding is detected, discharging onto different trays a sheet having an image formed before the detection of overlapped feeding, and a sheet fed after overlapped sheets where overlapped feeding was detected and having an image formed thereon.

In the present invention, the detecting unit detects overlapped feeding of documents (that is, a feed of two or more sheets of documents in an overlapped manner) before reading an image on a fed document. For example, the detecting unit uses an ultrasonic sensor, includes a transmitting section for transmitting ultrasonic waves and a receiving section for receiving the transmitted ultrasonic waves on both sides of a document to be fed, and detects overlapped feeding of documents according to the magnitude of transmitted energy of the received ultrasonic waves. The image forming unit forms an output image on a sheet based on an image read from a document fed before the detection of overlapped feeding, and the controller causes the sheet having the output image formed thereon to be discharged onto the first tray.

When overlapped feeding is detected by the detecting unit, the controller causes a tray for discharging a sheet to be switched from the first tray to the second tray different from the first tray. The image forming unit forms an output image on a sheet based on an image read from a document fed after the documents fed in an overlapped manner (overlapped documents), and the controller causes the sheet having the output image formed thereon to be discharged onto the second tray. Thus, even when overlapped feeding is detected, the controller does not stop the process of reading the image on the document and continues the process of forming an output image based on the read image. Moreover, sheets on which output images are formed based on images on documents other than overlapped documents are discharged onto different trays depending on before and after the detection of overlapped feeding.

In the present invention, when overlapped feeding of documents is detected, the controller determines whether or not an image recorded on the overlapped documents is readable. For example, if the documents are double sided documents with images recorded on both sides of the documents, the controller determines that the images on mutually facing sides of the overlapped documents are unreadable. On the other hand, if the documents are single sided documents with an image recorded only on a single side (front side) of the documents, the controller determines whether or not the image is readable based on the image reading side of the overlapped documents. When the controller determines that the image is readable, the image forming unit forms an output image based on the image read from the overlapped documents.

In the present invention, the counting unit counts the feed number of a fed document (for example, which sheet or which page of document is the fed document). When overlapped feeding of documents is detected, if the controller determines that an image on the overlapped documents is readable, it causes a sheet on which an output image is formed by the image forming unit based on the image read by the image reading unit from a document of the first feed number in the overlapped documents to be discharged onto the first tray. For example, when two sheets of documents are fed in an overlapped manner in feeding a plurality of documents having an image recorded on one side (front side) of each document, the controller determines that the image on the front side of the first sheet of overlapped document is not covered by overlapped feeding and is readable. On the other hand, the controller determines that an image on the second sheet of overlapped document is unreadable because a part or the whole of the front side of the second sheet of overlapped document is covered with the first sheet of overlapped document.

In the present invention, the counting unit counts the feed number of a fed document (for example, which sheet or which page of document is the fed document). When overlapped feeding of documents is detected, if the controller determines that an image on the overlapped documents is readable, it causes a sheet on which an output image is formed by the image forming unit based on the image read by the image reading unit from a document of the last feed number in the overlapped documents to be discharged onto the second tray. For example, when two sheets of documents are fed in an overlapped manner in feeding a plurality of documents having an image recorded on one side (back side) of each document, the controller determines that the image on the first sheet of overlapped document is unreadable because a part or the whole of the back side of the first sheet of overlapped document is covered with the second sheet of overlapped document. On the other hand, the controller determines that the image on the second sheet of overlapped document is readable because the image on the second sheet is not covered by overlapped feeding.

In the present invention, the controller determines the number of sheets of overlapped documents based on the detection result of the detecting unit. Based on the number of sheets of overlapped documents and the count result counted by the counting unit, the controller specifies the last feed number of the overlapped documents. For example, in the case where 10 sheets of documents were fed before the detection of overlapped feeding, if the number of sheets of the overlapped documents is two, then the controller specifies that the last feed number of the overlapped documents is the 12th sheet. In the case where 10 sheets of documents were fed before the detection of overlapped feeding, if the number of sheets of the overlapped documents is three, then the controller specifies that the last feed number of the overlapped documents is the 13th sheet.

In the present invention, when overlapped feeding is detected, the storing unit stores the feed number of a document (for example, which sheet or which page of overlapped documents) failed to read the image in the overlapped documents. When a plurality of the fed documents are fed again to read an image on the overlapped documents, the image forming unit forms an output image based on an image read from a document of the same feed number as the stored feed number.

In the present invention, when overlapped feeding is detected, the storing unit stores the feed numbers of the overlapped documents (for example, which sheets or which pages of the whole documents are the overlapped documents). When a plurality of the fed documents are fed again to read an image on the overlapped documents, the image forming unit forms an output image based on an image read from a document of the same feed number as the stored feed number.

In the present invention, the controller determines the number of sheets of the overlapped documents based on the detection result of the detecting unit. Based on the number of sheets of the overlapped documents and the count result counted by the counting unit, the controller specifies the feed numbers of the overlapped documents. For example, in the case where 10 sheets of documents were fed before the detection of overlapped feeding and the number of sheets of the overlapped documents is two, if a determination is made that the images on all the overlapped documents are unreadable, then the controller specifies that the feed numbers of the overlapped documents are the 11th and 12th sheets. In the case where 10 sheets of documents were fed before the detection of overlapped feeding and the number of sheets of the overlapped documents is two, if a determination is made that the image on the first sheet of overlapped document is unreadable, then the controller specifies that the feed number of the overlapped document is the 11th sheet. In the case where 10 sheets of documents were fed before the detection of overlapped feeding and the number of sheets of the overlapped documents is two, if a determination is made that the image on the last sheet of the overlapped document is unreadable, then the controller specifies that the feed number of the overlapped document is the 12th sheet.

In the present invention, when a plurality of the fed documents are fed again to read the image on the overlapped documents, a sheet on which an output image is formed by the image forming unit based on the image read from a document is discharged onto the first tray. Thus, the sheet is discharged following a sheet having an output image formed based on an image read from a document fed before the detection of overlapped feeding.

In the present invention, the detecting unit detects overlapped feeding of sheets (that is, a feed of two or more sheets in an overlapped state) before forming an image on a fed sheet (for example, recording paper). For example, the detecting unit uses an ultrasonic sensor, includes a transmission section for transmitting ultrasonic waves and a reception section for receiving the transmitted ultrasonic waves on both sides of a sheet to be fed, and detects overlapped feeding of sheets based on the magnitude of the energy of the received ultrasonic waves. The controller causes a sheet having an image formed by the image forming unit before the detection of overlapped feeding to be discharged onto the first tray.

When overlapped feeding is detected by the detecting unit, the controller causes a tray for discharging a sheet to be switched from the first tray to the second tray different from the first tray. The image forming unit forms an image on a sheet fed after the sheets fed in an overlapped manner (overlapped sheets), and the controller causes the sheet having the image formed thereon to be discharged onto the second tray. Thus, even when overlapped feeding is detected, the image forming processes on a sheet are continued.

In the present invention, the controller causes the overlapped sheets to be discharged onto the third tray. Thus, overlapped sheets, sheets having an image formed normally thereon before the occurrence of overlapped feeding, and sheets having an image formed normally thereon after the occurrence of overlapped feeding are sorted from each other.

In the present invention, when overlapped feeding is detected, an image involved in overlapped feeding and supposed to be formed on the overlapped sheet is formed on a sheet fed after the overlapped sheets, based on image data corresponding to the image. Thus, an image formed or supposed to be formed on the overlapped sheet is formed again on a sheet fed after the overlapped sheets.

In the present invention, when overlapped feeding is detected, the controller determines whether or not it is possible to interrupt image formation in progress. For example, when overlapped feeding is detected on the Nth sheet (page), if the process for forming an image on a sheet started and the process for forming an image has been completed for up to the (N+3)th sheet, then the controller determines that it is possible to perform an interrupt process (image formation) in the image forming unit after the image forming unit forms the image on the (N+3)th sheet. At an interrupt available timing, the image forming unit forms an image which could not have been formed due to overlapped feeding of sheets (an image involved in overlapped feeding) on a sheet.

In the present invention, the image processing unit performs the process of generating data for use in forming an image based on image data. For example, the image processing unit generates data for controlling semiconductor laser light for forming an electrostatic latent image on a photoreceptor drum surface, based on image data. When overlapped feeding is detected, the controller determines whether or not it is possible to interrupt image formation in progress, based on data already generated in the image processing unit. In other words, when overlapped feeding is detected, if data for image formation has already been generated in the image processing unit, the controller determines that it is impossible to interrupt image formation about recording paper for which data has already been generated, determines that it is possible to interrupt image formation about recording paper for which data has not yet been generated, and determines that it is possible to interrupt image formation after waiting for an image to be formed on a sheet by using the already generated data.

In the present invention, the controller causes a sheet on which an image involved in overlapped feeding is formed to be discharged onto the first tray.

In the present invention, when overlapped feeding is detected, the controller causes a tray to be switched, based on whether or not there are sheets on the tray.

In the present invention, when the controller determines that there are sheets on all the trays, the image forming unit interrupts the image formation. After the state in which sheets are present on all the trays, when a determination is made that there is no sheet on at least one tray, the image forming unit resumes the interrupted image formation. The controller causes a sheet on which an image is formed by the resumed image formation to be discharged onto the tray.

In the present invention, when overlapped feeding is detected and a determination is made that sheets are present on all the trays, the output unit outputs an instruction to remove the sheets on at least one of the trays (for example, displays an operation to specify a tray and remove the sheets).

In the present invention, when overlapped feeding of documents is detected, the controller causes a sheet on which an output image is formed based on an image read from a document fed after the overlapped documents to be discharged onto the second tray different from the first tray. Hence, even when overlapped feeding is detected, it is possible to continue the process of forming an output image based on the read image without stopping the feed of documents to be read, and it is possible to prevent a decrease in the overall job efficiency of the apparatus due to overlapped feeding.

Moreover, by discharging sheets having output images formed based on images on documents other than overlapped document onto different trays depending on before and after the detection on overlapped feeding, the user can easily determine that overlapped feeding occurred between the last page on the first tray and the first page on the second tray. Further, when an output image is formed on a sheet based on the image on the overlapped document, if the sheet is placed after the last page of sheets discharged onto the first tray and then the user places the sheets discharged onto the second tray over the first tray, the sheets having output images formed thereon can be easily arranged according to the order of the documents without paying attention to the place where overlapped feeding occurred, and it is possible to reduce the burden of the user.

In the present invention, when a feed of a document is detected, the controller determines whether or not it is possible to read an image recorded on overlapped documents, and it is possible to form an output image for a readable document in the overlapped documents. It is thus possible to continue the image forming processes for the overlapped documents and prevent a decrease in the overall job efficiency of the apparatus by not wasting the time required for the document feed.

In the present invention, by discharging onto the first tray a sheet having an output image formed by reading an image on a document of the first feed number in the overlapped documents, the process of feeding one sheet in the overlapped documents will not be wasted. Moreover, since sheets having output images formed by reading images from the overlapped documents can be arranged according to the order of the documents, it is possible to reduce the burden of the user.

In the present invention, by discharging onto the second tray a sheet on which an output image is formed by reading an image on a document of the last feed number in the overlapped documents, the process of feeding one of the overlapped documents will not be wasted. Moreover, sheets on which output images are formed by reading images from the overlapped documents can be arranged according to the order of the documents, and it is possible to reduce the burden of the user.

In the present invention, it is possible to certainly specify the feed numbers of overlapped documents regardless of the number of sheets of the overlapped documents.

In the present invention, when the feed numbers of overlapped documents failed to read images are stored and a plurality of the fed documents are fed again, an output image is formed based on an image read from a document of the same feed number as the stored feed number. Thus, since the work of sorting overlapped documents from documents which were not fed in an overlapped manner is completely unnecessary, it is possible to reduce the burden of the user. In particular, when there is a need to process a large amount of documents at high speeds, it is possible to significantly reduce the burden of the user.

In the present invention, when the feed numbers of overlapped documents are stored and a plurality of the fed documents are fed again, an output image is formed based on an image read from a document of the same feed number as the stored feed number. Thus, since the work of sorting overlapped documents from documents which were not fed in an overlapped manner is completely unnecessary, it is possible to reduce the burden of the user. In particular, when there is a need to process a large amount of documents at high speeds, it is possible to significantly reduce the burden of the user.

In the present invention, it is possible to certainly specify the feed numbers of overlapped documents regardless of the number of sheets of the overlapped documents.

In the present invention, a sheet having an output image formed by the image forming unit based on an image read from the overlapped documents is discharged onto the first tray. Therefore, even when overlapped feeding occurs, sheets having output images formed thereon can be arranged according to the feed order of the documents, and it is possible to reduce the burden of the user because it is completely unnecessary for the user to sort out sheets corresponding to the overlapped documents and to rearrange the order of the sheets.

In the present invention, when overlapped feeding of sheets is detected, the controller causes a sheet fed after the overlapped sheets and having an image formed thereon to be discharged onto the second tray different from the first tray. Thus, even when overlapped feeding is detected, it is possible to continue the image forming processes on sheets without stopping, and it is possible to prevent a decrease in the overall job efficiency of the apparatus due to overlapped feeding.

Moreover, by discharging sheets having images formed thereon onto different trays depending on before and after the detection of overlapped feeding, the user can easily determine that overlapped feeding occurred between the last page on the first tray and the first page on the second tray. Moreover, by placing a sheet on which an image involved in overlapped feeding is formed after the last page of sheets discharged onto the first tray and then placing sheets discharged onto the second tray after the above-mentioned sheet, it is possible to easily arrange the sheets according to the order of image formation, and it is possible to reduce the burden of the user.

In the present invention, by discharging overlapped sheets onto the third tray, it is possible to prevent the overlapped sheets from mixing with sheets on which images are formed normally, it is possible to allow the user to easily discard unnecessary overlapped sheets, and it is possible to reduce the burden of the user.

In the present invention, an image formed or supposed to be formed on overlapped sheets (an image involved in overlapped feeding) is formed again on a sheet fed after the overlapped sheets, and therefore, even when overlapped feeding occurs, it is possible to continue the image forming processes without stopping.

In the present invention, when overlapped feeding is detected, a determination is made as to whether or not it is possible to interrupt image formation in progress. Thus, when overlapped feeding occurs, it is possible to prevent the image forming process in progress from being wasted, and it is possible to promptly form an image involved in overlapped feeding.

In the present invention, the image processing unit for generating data for use in forming an image based on image data is comprised, and a determination is made whether or not it is possible to interrupt image formation in progress, based on data already generated in the image processing unit. Thus, when overlapped feeding occurs, it is possible to prevent the image forming process in progress from being wasted, and it is possible to promptly form again an image supposed to be formed on the overlapped sheets.

In the present invention, a sheet on which an image involved in overlapped feeding is formed is discharged onto the first tray, and therefore, even when overlapped feeding occurs, sheets having images formed thereon can be arranged according to the record order, and it is possible to reduce the burden of the user because it is completely unnecessary for the user to sort out sheets on which images involved in overlapped feeding are formed and rearrange the sheets in the correct order. In particular, when there is a need to perform a large amount of printing based on a large volume of image data, the sheets discharged in the record order can be quickly sent to post processing after printing, and it is possible to significantly reduce the burden of the user.

In the present invention, when overlapped feeding is detected, a tray is switched based on a result of determining whether or not there are sheets on the tray. Therefore, even when overlapped feeding occurs a plurality of times, it is possible to sort and discharge sheets by switching to an empty tray without using a tray on which sheets have already been discharged, and it is possible to reduce the burden of the user.

In the present invention, if a determination is made that sheets are present on all the trays, image formation is interrupted and, after a state in which sheets are present on all the trays, if a determination is made that there is no sheet on at least one of the trays, the interrupted image formation is resumed. Therefore, even when overlapped feeding occurs a plurality of times, it is possible to resume the image formation by waiting for a tray to be empty, and it is possible to continue the image forming processes without placing a burden on the user.

In the present invention, the output unit for giving an instruction to remove sheets on at least one of trays when a determination is made that sheets are present on all the trays is comprised. Therefore, even when overlapped feeding occurs a plurality of times in performing a large amount of printing, it is possible to continue the image forming processes without placing a burden on the user.

The above and further objects and features of the invention will more fully be apparent from the following detailed description with accompanying drawings.

DETAILED DESCRIPTION OF THE INVENTION

Embodiment 1

Figure 1:
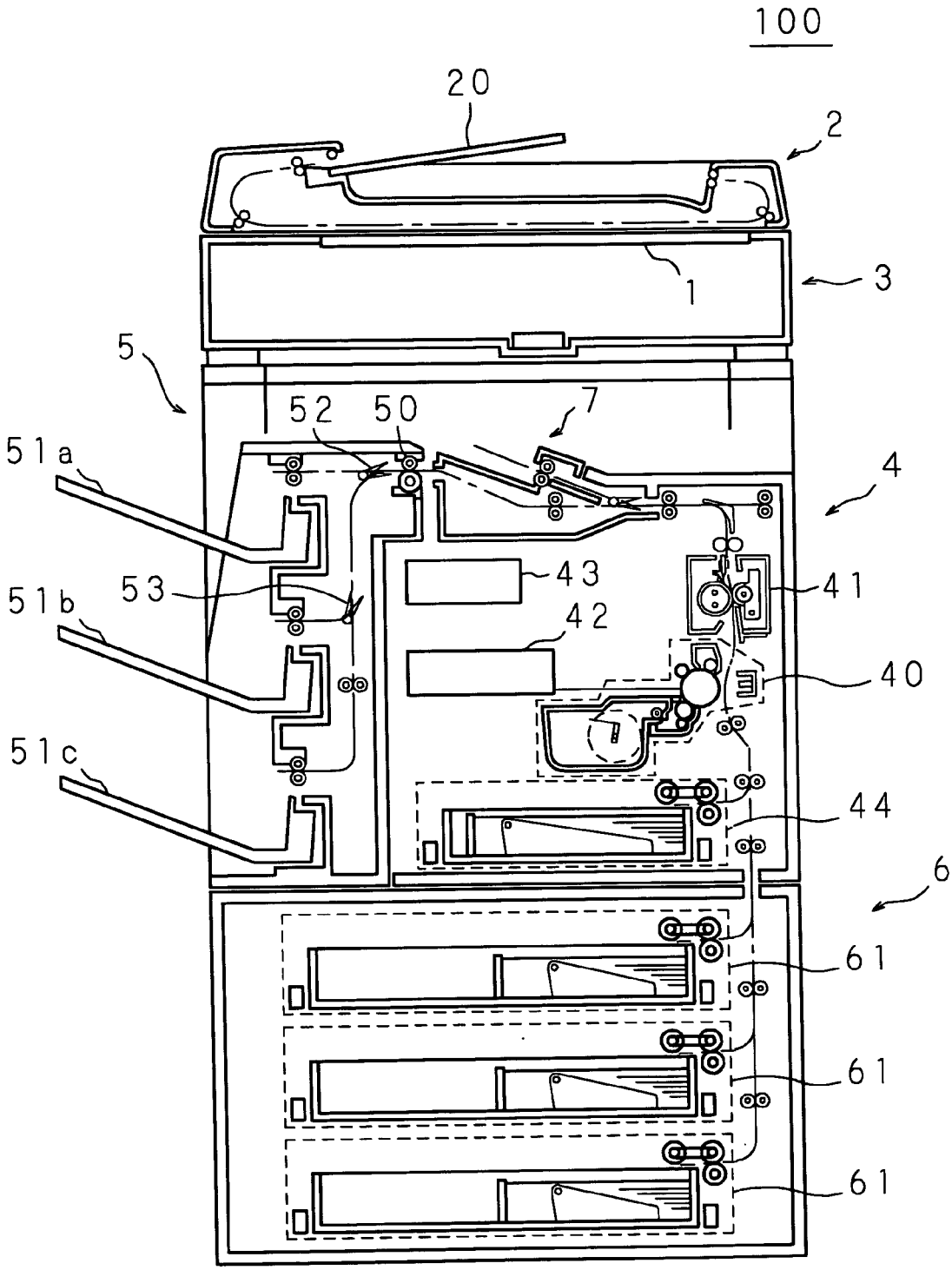
FIG. 1 is a front schematic view of an image forming apparatus according to Embodiment 1 of the present invention.

The following description will explain the present invention, based on the drawings illustrating Embodiment 1 thereof. FIG. 1 is a front schematic view of an image forming apparatus 100 according to Embodiment 1 of the present invention. In FIG. 1, 1 is a glass platen for placing a document thereon. Mounted above the platen 1 is an automatic document feeding unit 2 including a document tray 20 and a later-described image reading unit 24. Mounted under the platen 1 is a scanner unit 3 including a later-described image reading unit 30.

An image forming unit 4 is placed under the scanner unit 3 so that a transport path 7 for discharging recording paper (sheet) having an output image formed thereon is located between the image forming unit 4 and the scanner unit 3. The image forming unit 4 comprises an electrophotographic processing section 40, a fixing device 41, an optical writing unit 42, a process controller 43 for controlling the electrophotographic processing section 40, and a recording paper storage section 44 for storing the recording paper.

The electrophotographic processing section 40 comprises a photoreceptor drum to be driven and rotated, a developing device for developing an electrostatic latent image formed on the surface of the photoreceptor drum, and a transfer device for transferring a toner image on the photoreceptor drum surface to the recording paper.

The fixing device 41 comprises a fixing roller, and fixes the toner image to the recording paper by applying high heat and pressure to the toner image transferred and formed on the recording paper.

The optical writing unit 42 comprises a semiconductor laser device for emitting dot light modulated according to image data, a polygon mirror for deflecting laser light emitted from the semiconductor laser device in a main scanning direction, and lenses and mirrors (none of them is shown) for focusing the laser light deflected by the polygon mirror on the surface of the photoreceptor drum.

Mounted under the image forming unit 4 is a multi-stage paper feeding unit 6 in which recording paper storage sections 61 for storing recording paper are arranged in three stages in a vertical direction. When forming an output image, a desired size of recording paper is selected, and the selected recording paper is supplied to the electrophotographic processing section 40.

A post-processing unit 5 for performing post-processing (for example, sorting and stapling) on the recording paper is provided on a side face of the electrophotographic processing section 4 so that it is located between the scanner unit 3 and the multi-stage paper feeding unit 6. The post-processing unit 5 comprises discharge-use trays 51*a* (first tray), 51*b* (second tray) and 51*c* (third tray) for discharging the recording paper on which an output image is formed, guides 52 and 53 for switching which tray the recording paper is to be discharged, and transport rollers 50 for feeding the recording paper to be discharged.

Figure 2:
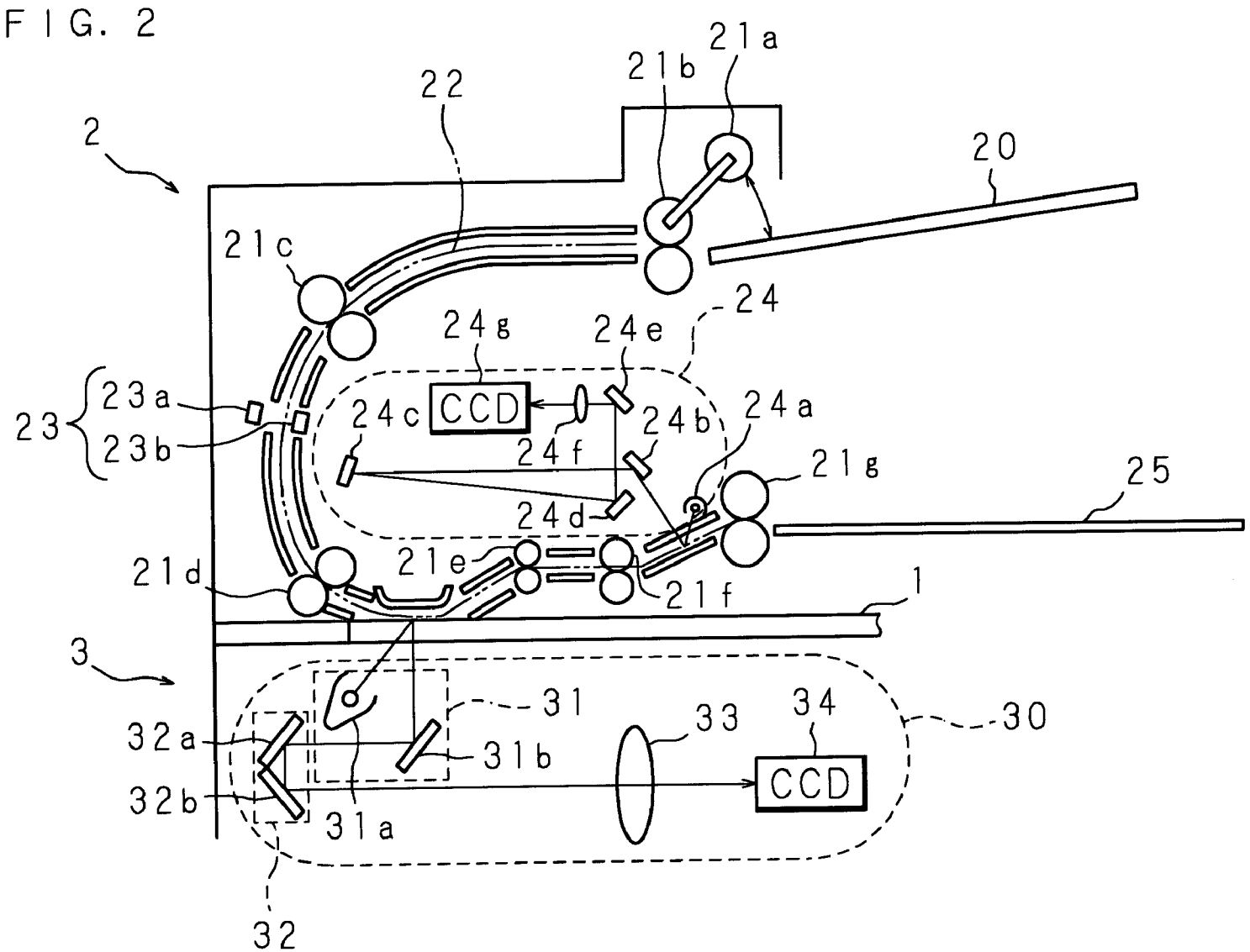
FIG. 2 is a schematic view showing the structures of an automatic document feeding unit and a scanner unit.

FIG. 2 is a schematic view showing the structures of the automatic document feeding unit 2 and the scanner unit 3. The automatic document feeding unit 2 comprises the document tray 20, an image reading unit 24 for reading an image recorded on a document, a pickup roller 21*a* and a separating roller 21*b* for feeding one sheet at a time from a stack of documents on the document tray 20; a transport path 22 for feeding the document to a discharge tray 25 via the image reading unit 24, transport rollers 21*c*, 21*d*, 21*e*, 21*f* and 21*g* suitably arranged in the transport path 22, and an ultrasonic sensor 23 including a transmission section 23*a* for transmitting ultrasonic waves and a reception section 23*b* for receiving the ultrasonic waves transmitted by the transmission section 23*a*, which are disposed to face each other to sandwich the document fed from the transport path 22 on the upstream side of the image reading unit 24.

The image reading unit 24 comprises a light source 24*a* for irradiating laser light on the document fed through the transport path 22; mirrors 24*b*, 24*c*, 24*d* and 24*e* for guiding the laser light reflected by the document to a predetermined optical path; a focus lens 24*f* for focusing the reflected light guided by the respective mirrors on a CCD sensor 24*g*; and the CCD sensor 24*g* for outputting an electric signal by photoelectrically converting the focused laser light. The image reading unit 24 outputs to the process controller 43 data decomposed into color components of R (red), G (green) and B (blue) based on a color image read from the document. Predetermined image data processing is performed on the data outputted to the process controller 43.

The scanner unit 3 comprises an image reading unit 30. The image reading unit 30 comprises scanning units 31 and 32 that move in a reciprocating manner parallel to the lower surface of the platen 1; a focus lens 33; and a CCD line sensor 34 as a photoelectric conversion device. The scanning unit 31 comprises a light source 31*a* for irradiating laser light on a document placed on the platen 1 or a document fed along the transport path 22; and a mirror 31*b* for guiding the laser light reflected by the document to a predetermined optical path. Moreover, the scanning unit 32 comprises mirrors 32*a* and 32*b* for guiding the laser light reflected by the document to a predetermined optical path.

The focus lens 33 focuses the laser light guided from the scanning unit 32 on a predetermined position on the CCD line sensor 34. The CCD line sensor 34 outputs an electric signal by photoelectrically converting the focused light image. The image reading unit 30 outputs to the process controller 43 data decomposed into color components of R (red), G (green) and B (blue) based on a color image read from the document. Predetermined image data processing is performed on the data outputted to the process controller 43.

When reading an image recorded on a document, the user can use a later-described operation unit 16 to switch whether to read the document from both sides, or read the document from a single side. For example, if images are recorded on both sides of a document, when double-side reading is set through the operation unit 16, a stack of documents placed with the front side facing up on the document tray 20 are fed one sheet at a time through the transport path 22, the image recorded on the front side of the document is read by the image reading unit 30, and the image recorded on the back side of the document is read by the image reading unit 24. On the other hand, if an image is recorded only on the front side of a document, when single-side reading is set through the operation unit 16, a stack of documents placed with the front side facing up on the document tray 20 are fed one sheet at a time through the transport path 22, and the image recorded on the front side of the document is read by the image reading unit 30. In this case, image reading in the image reading unit 24 is not performed.

Figure 3:
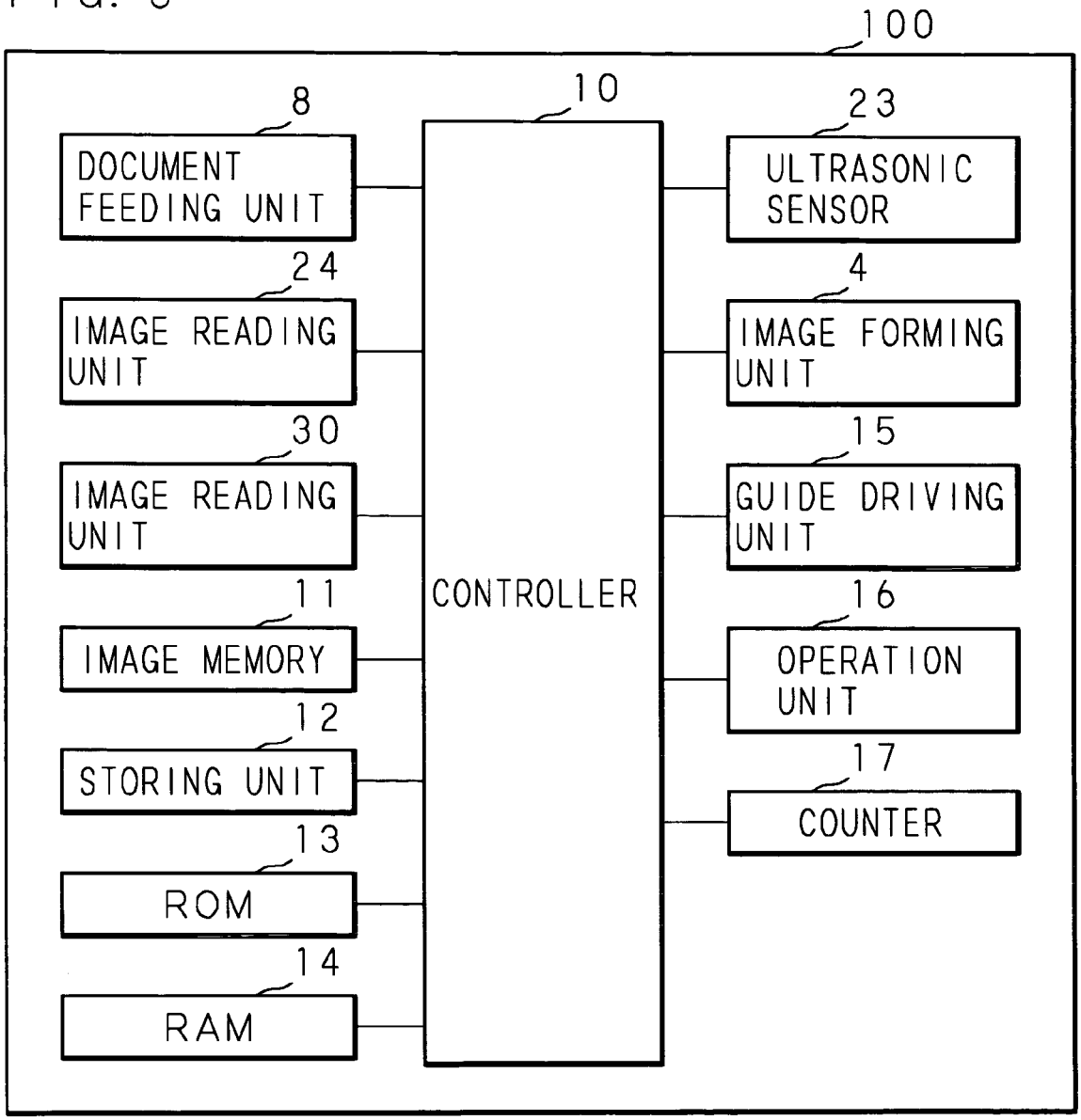
FIG. 3 is a block diagram showing the internal structure of the image forming apparatus according to Embodiment 1 of the present invention.

FIG. 3 is a block diagram showing the internal structure of an image forming apparatus 100 according to Embodiment 1 of the present invention. The image forming apparatus 100 comprises a controller 10 composed of a CPU for performing various kinds of calculation processes. Connected through an internal bus to the controller 10 are a document feeding unit 8, an image reading unit 24, an image reading unit 30, an image memory 11, a storing unit 12 composed of a HDD or the like, a ROM 13, a RAM 14, an ultrasonic sensor 23, an image forming unit 4, a guide driving unit 15, an operation unit 16, a counter 17 (counting unit), etc., and the controller 10 controls the operations of these hardware sections.

The ROM 13 stores a control program indicating the control steps of the controller 10 in advance. When the CPU of the controller 10 loads the control program stored in the ROM 13 into the RAM 14, the controller 10 controls the operation of the image forming apparatus 100 according to the control steps shown by the control program.

The document feeding unit 8 comprises the pickup roller 21*a*, the separating roller 21*b*, the transport path 22, and the transport rollers 21*c*, 21*d*, 21*e*, 21*f* and 21*g*, feeds the documents placed on the document tray 20 one sheet at a time to the image reading units 24 and 30, and also feeds the documents whose images were read by the image reading units 24 and 30 to the discharge tray 25.

The image reading units 24 and 30 photo-electrically convert the image on the document into an analog signal by the CCD sensor, and converts the obtained analog signal into a digital signal by an A/D converter. The image reading units 24 and 30 correct the alignment characteristic of the light source in reading the document, sensitivity variations of the image sensor, etc. with respect to the digital signals obtained by conversion, and store the obtained image data in the image memory 11 under the control of the controller 10.

The image forming unit 4 forms an image on the recording paper, based on the image data stored in the image memory 11. Note that the image forming unit 4 is not limited to the electrophotographic type, and may be of an inkjet type, thermal transfer type, etc.

Before a document fed by the document feeding unit 8 is read on the upstream side of the image reading units 24 and 30, that is, before the image on the document is read by the image reading units 24 and 30, the ultrasonic sensor 23 (detecting unit) detects overlapped feeding of documents, and outputs the detection result to the controller 10. Overlapped feeding means a state in which two sheets of documents are fed in an overlapped manner instead of separating and feeding one sheet of document at a time. The detail of overlapped feeding will be explained later with reference to FIGS. 5A to 5D.

Figure 4:
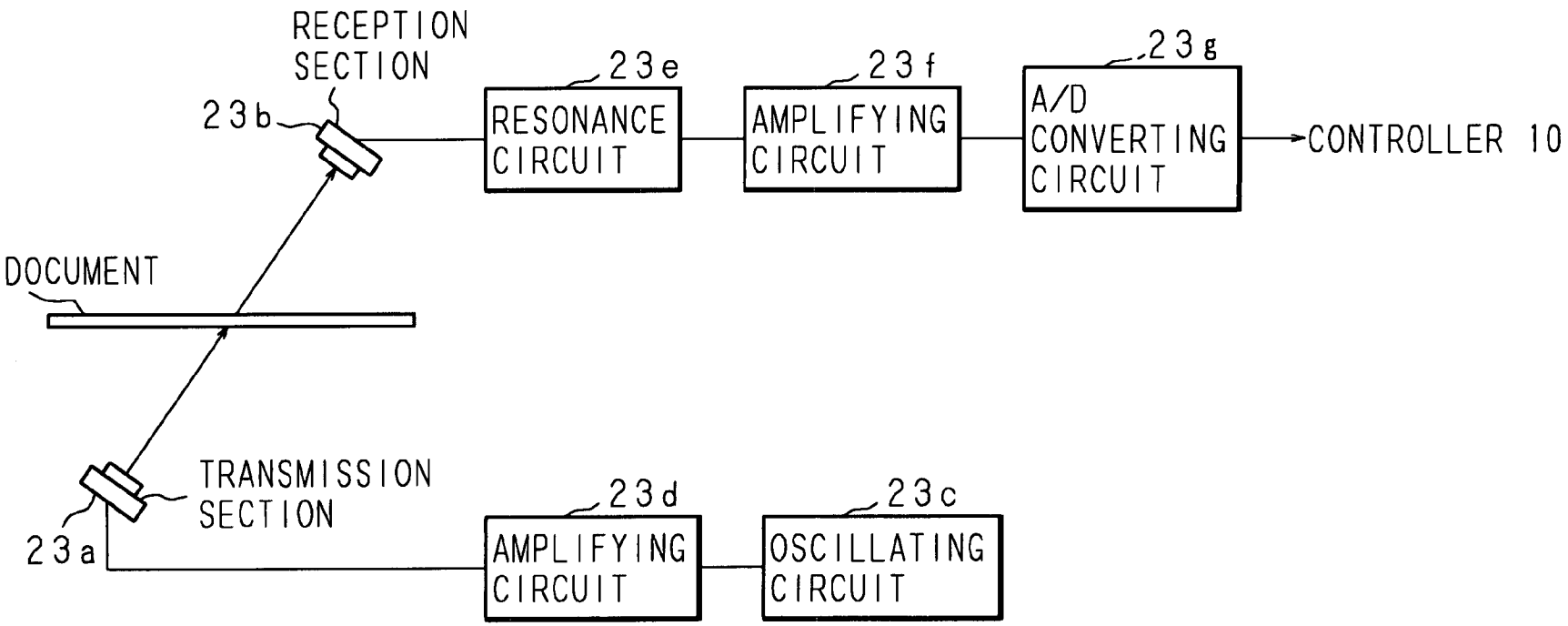
FIG. 4 is a block diagram showing the structure of an ultrasonic sensor.

FIG. 4 is a block diagram showing the structure of the ultrasonic sensor 23. The ultrasonic sensor 23 comprises, for example, an oscillating circuit 23*c* for producing a drive waveform with an oscillation frequency of about 220 kHz; an amplifying circuit 23*d* for amplifying the drive waveform produced by the oscillating circuit 23*c*; the transmission section 23*a* for transmitting the drive waveform; the reception section 23*b* for receiving a signal transmitted by the transmission section 23*a*; a resonance circuit 23*e* for detecting a signal received by the reception section 23*b* over a wide band (for example 220 kHz±20 kHz); an amplifying circuit 23*f* for amplifying the received signal; and an A/D converting circuit 23*g* for converting the amplified signal into a digital signal. By transmitting a signal from the transmission section 23*a* to the fed document, receiving the transmitted signal by the reception section 23*b* and outputting the signal to the controller 10, the ultrasonic sensor 23 detects the number of sheets of documents fed, that is, overlapped feeding, based on the magnitude of the energy of the signal. Note that means for detecting overlapped feeding is not limited to the ultrasonic sensor, and it may be possible to use other sensor.

The guide driving unit 15 switches the guides 52 and 53 under the control of the controller 10. For example, the guides 52 and 53 are switched so that recording paper having an output image formed based on an image read from a fed document is discharged onto the first tray 51*a*. When overlapped feeding is detected in feeding a document, the guides 52 and 53 are switched so that recording paper on which an output image is formed based on an image read from a document fed after the overlapped documents is discharged onto the second tray 51*b*. In addition, when overlapped feeding is detected again at the time of feeding a document, the guides 52 and 53 are switched so that recording paper on which an output image is formed based on an image read from a document fed after the overlapped documents is discharged onto the third tray 51*c*.

The operation unit 16 is a touch panel type operation panel, and comprises various keys and switches for receiving operation instructions of the user, and a liquid crystal display for displaying information to be given to the user. For example, the operation unit 16 can set whether to read single sided documents or double sided documents.

The counter 17 counts the number of sheets or pages of fed documents according to the feed of single sided documents or double sided documents, based on the operation through the operation unit 16, and outputs the count result to the controller 10.

In the storing unit 12, when overlapped feeding of documents is detected, the number of sheets or pages of the overlapped documents, or the number of pages of documents (or which sheet of the documents) determined to be failed for image reading in the overlapped documents, is stored under the control of the controller 10.

Figure 5A:
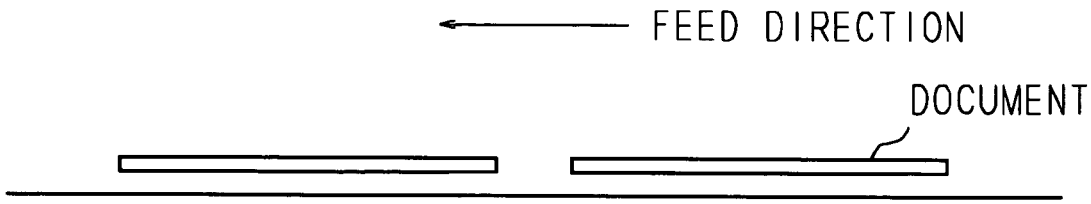
FIGS. 5A to 5D are explanatory views showing an example of overlapped feeding of documents.
Figure 5B:
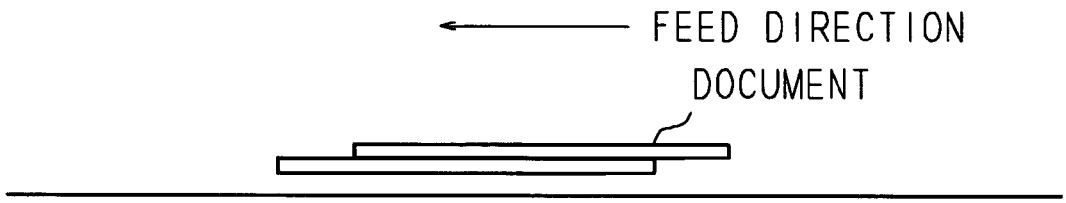
Figure 5C:
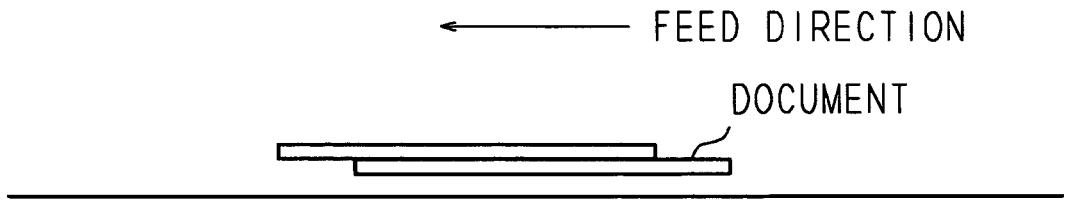
Figure 5D:
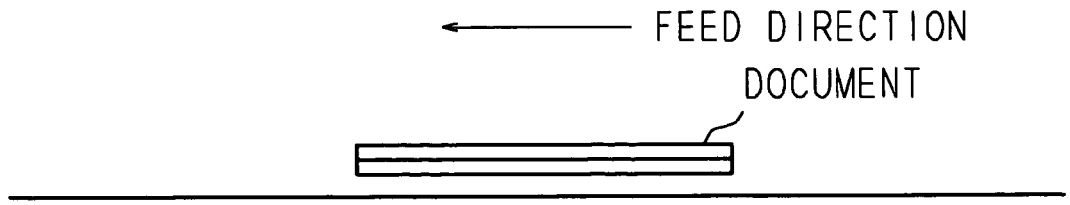

FIGS. 5A to 5D are explanatory views showing an example of overlapped feeding of documents. The arrow in FIGS. 5A to 5D indicates the document feed direction. FIG. 5A shows the case where the documents are fed normally one sheet at a time with a predetermined distance between the documents. FIG. 5B shows the case of overlapped documents in which the leading end of the first sheet of overlapped documents and the leading end of the second sheet of overlapped documents are not aligned with each other when performing so-called bottom sheet pickup in which one sheet of document is picked up at a time from the bottommost sheet in a stack of documents placed on the document tray. FIG. 5C shows the case of overlapped documents in which the leading end of the first sheet of overlapped documents and the leading end of the second sheet of overlapped documents are not aligned with each other when performing so-called top sheet pickup in which one sheet of document is picked up at a time from the topmost sheet in a stack of documents placed on the document tray. FIG. 5D shows the case of overlapped documents in which the leading end of the first sheet of overlapped documents and the leading end of the second sheet of overlapped documents are aligned with each other when performing the bottom sheet pickup or the top sheet pickup.

Figure 6:
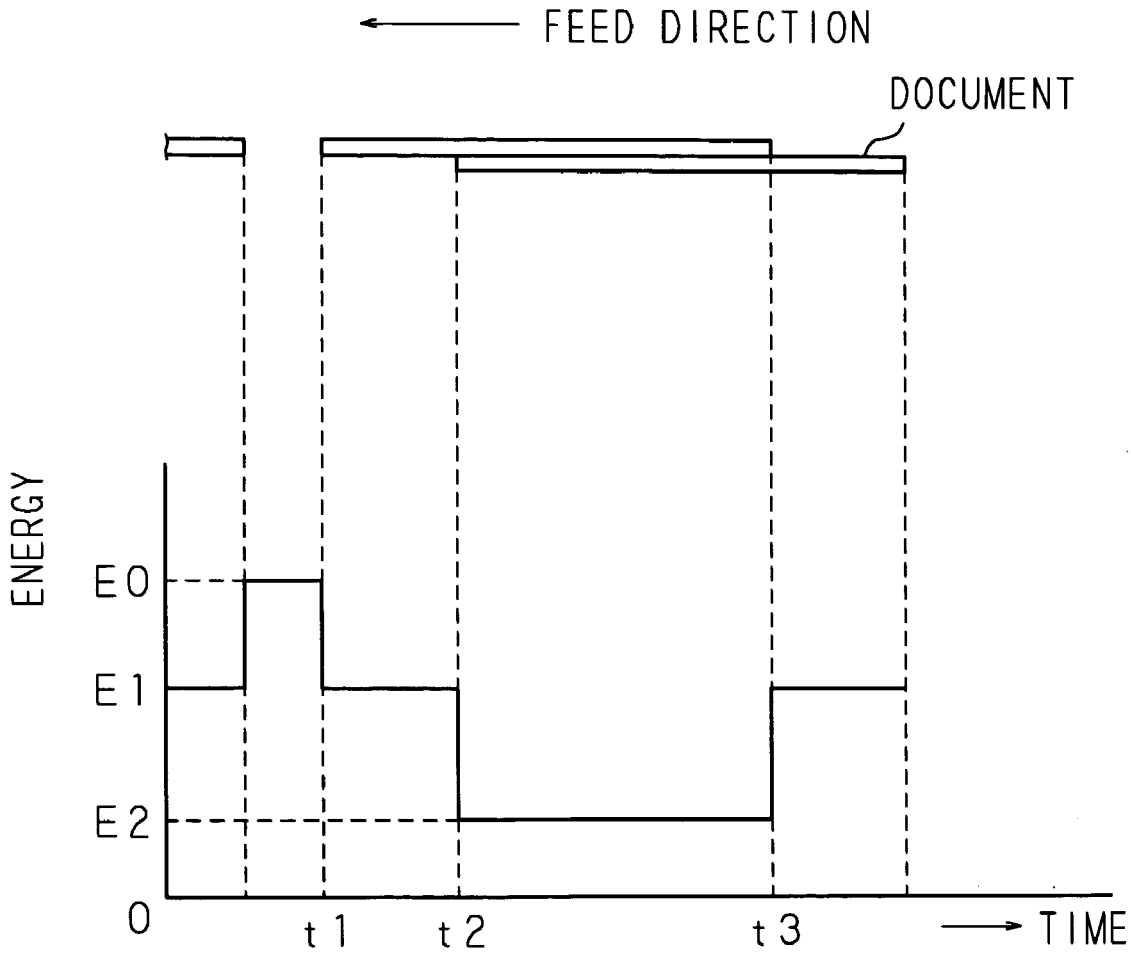
FIG. 6 is a time chart showing the levels of overlapped feeding detection signals when the leading ends of overlapped documents are not aligned with each other.

FIG. 6 is a time chart showing the levels of overlapped feeding detection signals when the leading ends of overlapped documents are not aligned with each other. The energy (for example, transmitted energy) of a signal received by the reception section 23*b* of the ultrasonic sensor 23 changes according to the number of sheets of documents through which the signal is transmitted. For example, when there is no document, the energy of the received signal is E0; when there is one sheet of document, the energy of the received signal is E1 (E0>E1); and when there are two sheets of documents, the energy of the received signal is E2 (E1>E2). Since the energy of the signal is changed from E0 to E1 at time t1, the feed of the next document is detected. When overlapped feeding of documents occurs, for example, the energy of the signal will change from E1 to E2 at time t2. It is possible to detect from the difference in the energy levels of the received signals that the two sheets of documents were fed in an overlapped manner with their leading ends not being aligned with each other. The energy of the signal will change from E2 to E1 at time t3.

It is also possible to calculate an approximate length of misalignment between the documents, based on the document feed speed and the time difference between time t2 and t1.

Figure 7:
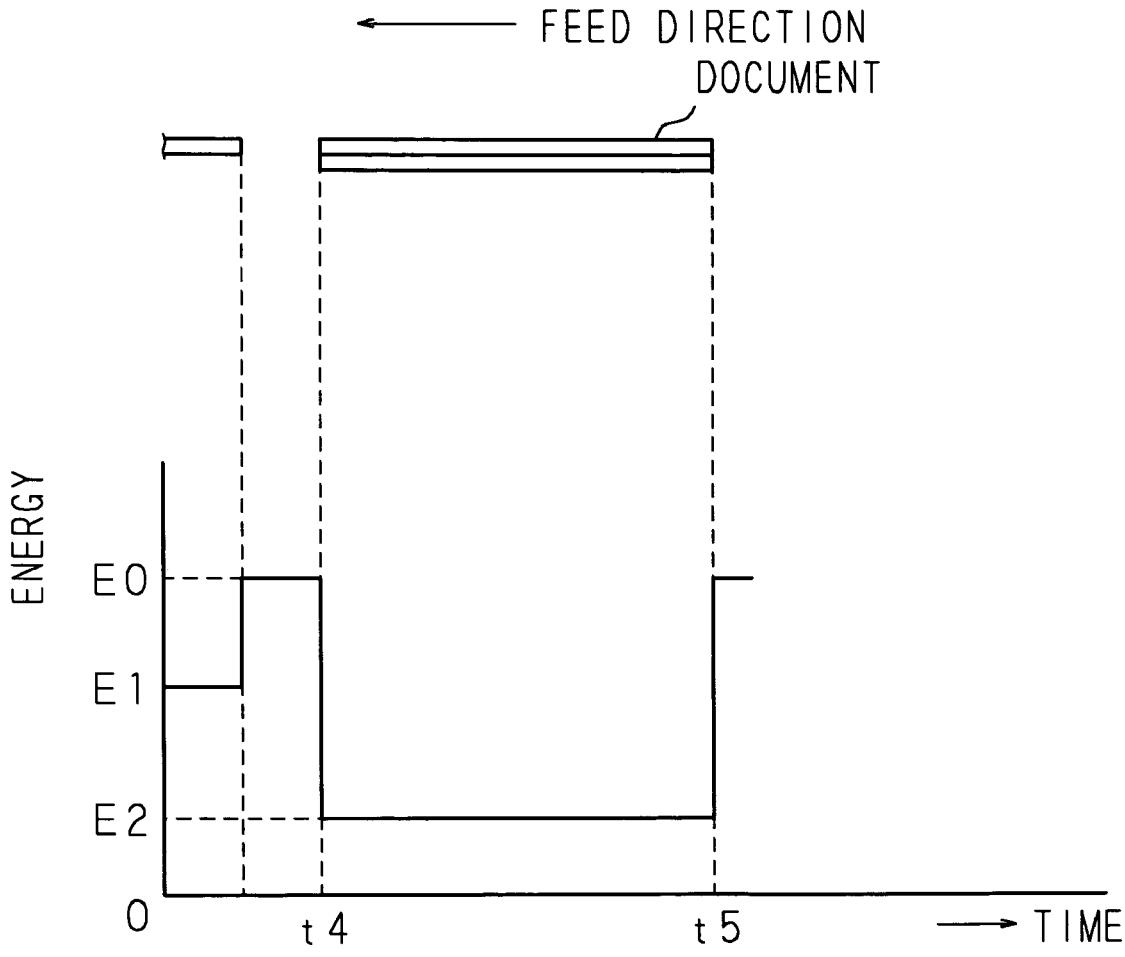
FIG. 7 is a time chart showing the relationship between overlapped feeding detection signals when the leading ends of overlapped documents are aligned with each other.

FIG. 7 is a time chart showing the relationship between overlapped feeding detection signals when the leading ends of overlapped documents are aligned with each other. The energy of the signal will change from E0 to E2 at time t4. It is possible to detect from the difference in the energy levels of the received signals that next two sheets of documents were fed in an overlapped manner with their leading ends being aligned with each other. The energy of the signal will change from E2 to E0 at time t5.

The controller 10 determines, based on the detection result (the level of the detection signal) outputted from the ultrasonic sensor 23, whether multiple documents were fed in an overlapped manner, and determines which pages were fed in an overlapped manner if the documents are double sided documents. When overlapped feeding is detected, the controller 10 specifies the feed numbers of overlapped documents (which sheets of documents are the overlapped documents), based on the determined number of sheets of overlapped documents and the number of sheets of documents fed before the occurrence of overlapped feeding, which was counted by the counter 17. For example, when 10 sheets of documents were fed before the detection of overlapped feeding and the number of sheets of the overlapped documents is two sheets, the controller 10 specifies that the feed numbers of the overlapped documents are the 11th and 12th sheets.

Moreover, when overlapped feeding is detected, the controller 10 corrects the feed numbers of documents to be fed after the overlapped documents, which are counted by the counter 17, according to the number of sheets of the overlapped documents. For example, when 10 sheets of documents were fed before the detection of overlapped feeding and the number of sheets of the overlapped documents is two sheets, if the counter 17 counts the two overlapped documents as one sheet of document, then the counter 17 may count the first document fed after the overlapped documents as the 11th sheet. However, the controller 10 corrects the count to the 12th sheet, and corrects similarly the number of sheets of documents to be counted thereafter.

Figure 8:
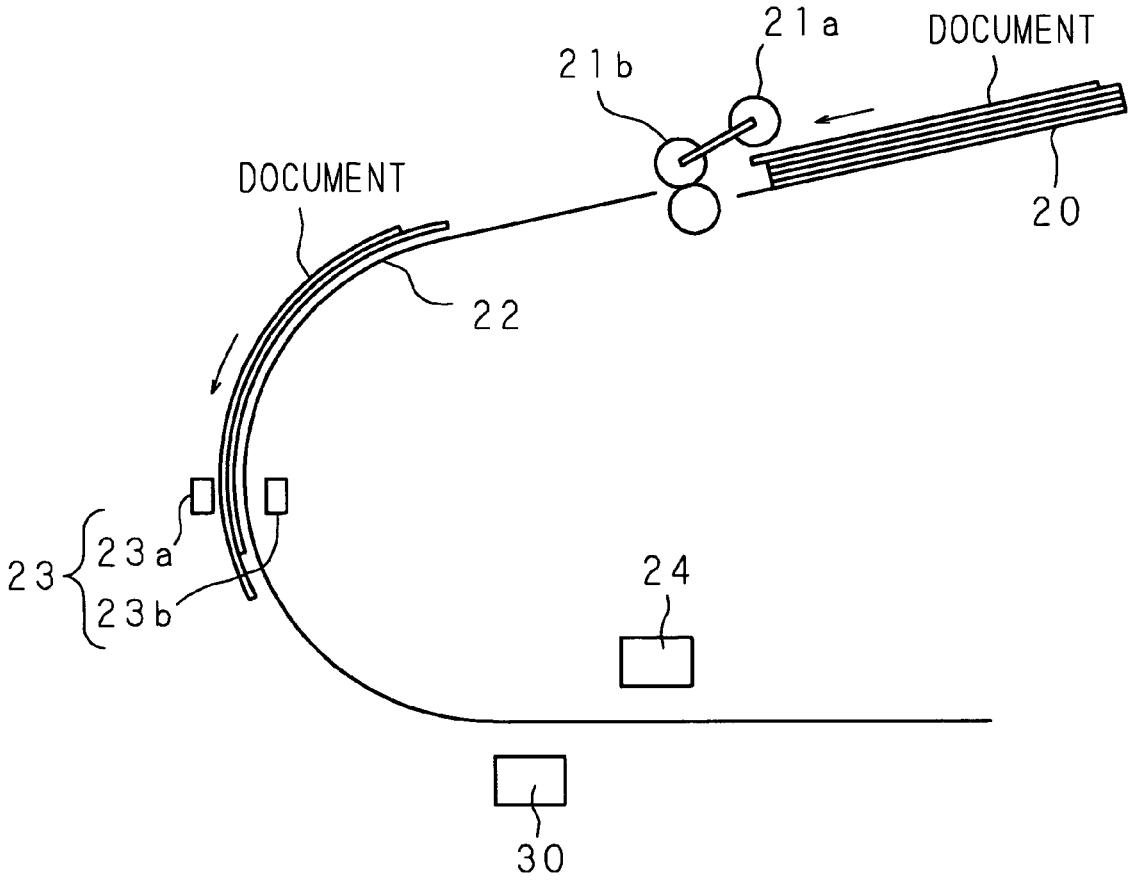
FIG. 8 is a schematic view showing a transport path (reverse path) when the topmost document is picked up.

FIG. 8 is a schematic view showing a transport path (reverse path) when the topmost document is picked up. First, the following description will explain the case in which a single sided document is printed (an output image is formed) on a single side of recording paper. As shown in FIG. 8, on the document tray 20, a stack of documents is placed with the front side (the image recorded surface in the case of single sided documents) facing up. The topmost document in the stack of documents is fed one sheet at a time to the transport path 22 by the pickup roller 21*a* or the separating roller 21*b*. When it was not possible to separate the documents and feed one sheet at a time by the pickup roller 21*a* or the separating roller 21*b* and two sheets of documents are fed in an overlapped manner, the image on the first sheet of overlapped document can be read by the image reading unit 30 without being covered with the second sheet of overlapped document.

On the other hand, since the image on the second sheet of overlapped document is covered with the first sheet of overlapped document, it can not be read by the image reading unit 30. In this case, therefore, the controller 10 which received an overlapped feeding detection signal determines that the first sheet of overlapped document is readable and that the second sheet of overlapped document is unreadable. In this case, the controller 10 sets a timing for reading the image on the first sheet of overlapped document, based on the time at which the first sheet of overlapped document was detected. Note that if the document is a single sided document, the reading process in the image reading unit 24 is not performed.

The following description will explain the case where a double sided document is printed (output images are formed) on both sides of recording paper. On the document tray 20, a stack of documents are placed with the front side facing up (images are recorded on the front side and the back side of a double sided document). The topmost document in the stack of documents is fed one sheet at a time to the transport path 22 by the pickup roller 21*a* and the separating roller 21*b*. In the case where the documents could not be separated and could not be fed one sheet at a time by the pickup roller 21*a* or the separating roller 21*b* and thus two sheets of documents are fed in an overlapped manner, the image on the back side of the first sheet of overlapped document and the image on the front side of the second sheet of overlapped document are covered with each other, and thus these images are unreadable by the image reading units 24 and 30. In this case, therefore, the controller 10 which received an overlapped feeding detection signal determines that both of the first sheet and second sheet of overlapped document are unreadable.

Figure 9:
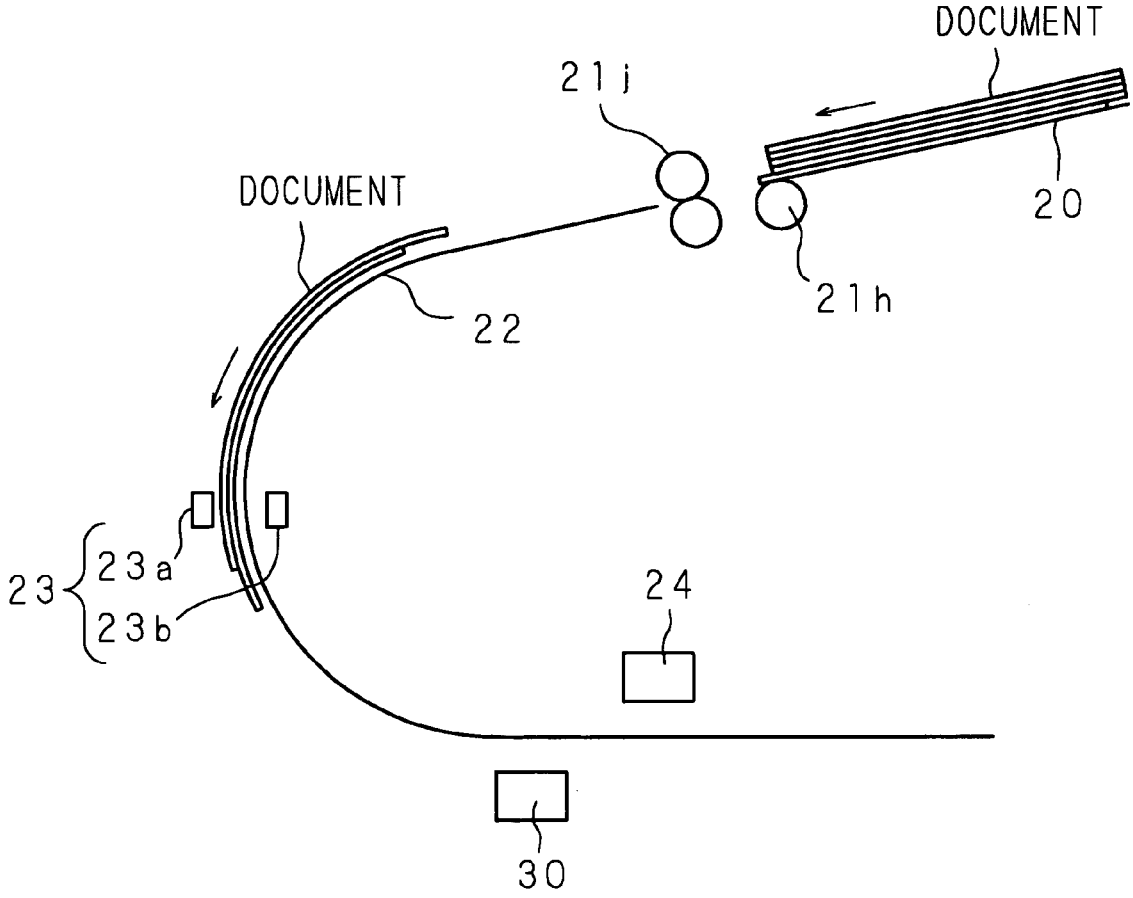
FIG. 9 is a schematic view showing a transport path (reverse path) when the bottommost document is picked up.

FIG. 9 is a schematic view showing a transport path (reverse path) when the bottom document is picked up. First, the following description will explain the case where a single sided document is printed (an output image is formed) on a single side of recording paper. As shown in FIG. 9, on the document tray 20, a stack of documents are placed with the front side (in the case of a single sided document, the side where an image is recorded) facing up. The bottommost document in the stack of documents is fed one sheet at a time to the transport path 22 by the pickup rollers 21*h* and 21*j*. If the documents could not be separated and could not be fed one sheet at a time by the pickup rollers 21*h* and 21*j* and thus two sheets of documents are fed in an overlapped manner, then the image on the first sheet of overlapped document is covered with the second sheet of overlapped document and thus can not be read by the image reading unit 30.

On the other hand, the image on the second sheet of overlapped document is not covered with the first sheet of overlapped document, and can be read by the image reading unit 30. In this case, therefore, the controller 10 which received an overlapped feeding detection signal determines that the first sheet of overlapped document is unreadable and that the second sheet of overlapped document is readable. In this case, the controller 10 sets a timing for reading the image on the second sheet of overlapped document, based on the time at which overlapping of the first and second sheets of the overlapped documents was detected. Note that if the document is a single sided document, the reading process in the image reading unit 24 is not performed.

The following description will explain the case where a double sided document is printed (output images are formed) on both sides of recording paper. On the document tray 20, a stack of documents is placed with the front side facing up (in the case of a double sided document, images are recorded on the front side and the back side). The bottommost document in the stack of documents is fed one sheet at a time to the transport path 22 by the pickup rollers 21*h* and 21*j*. If the documents could not be separated and could not be fed one sheet at a time by the pickup rollers 21*h* and 21*j* and thus two sheets of the documents are fed in an overlapped manner, then the image on the front side of the first sheet of overlapped document and the image on the back side of the second sheet of overlapped document are covered with each other, and thus can not be read by the image reading units 24 and 30. In this case, therefore, the controller 10 which received an overlapped feeding detection signal determines that both of the first and second sheets of the overlapped documents are unreadable.

Figure 10:
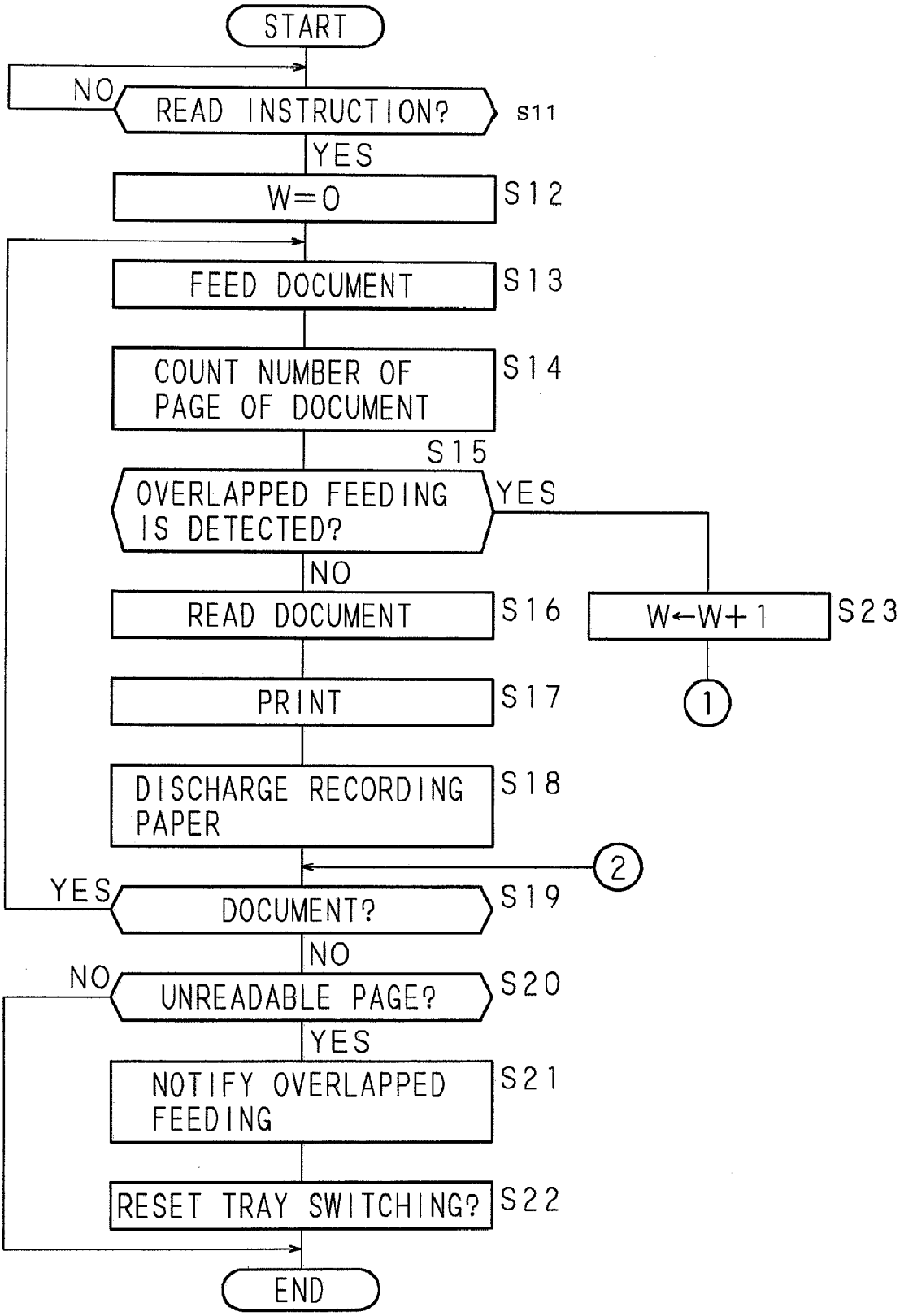
FIG. 10 is a flowchart showing the steps of a process executed by the image forming apparatus when overlapped feeding of documents is detected.
Figure 11:
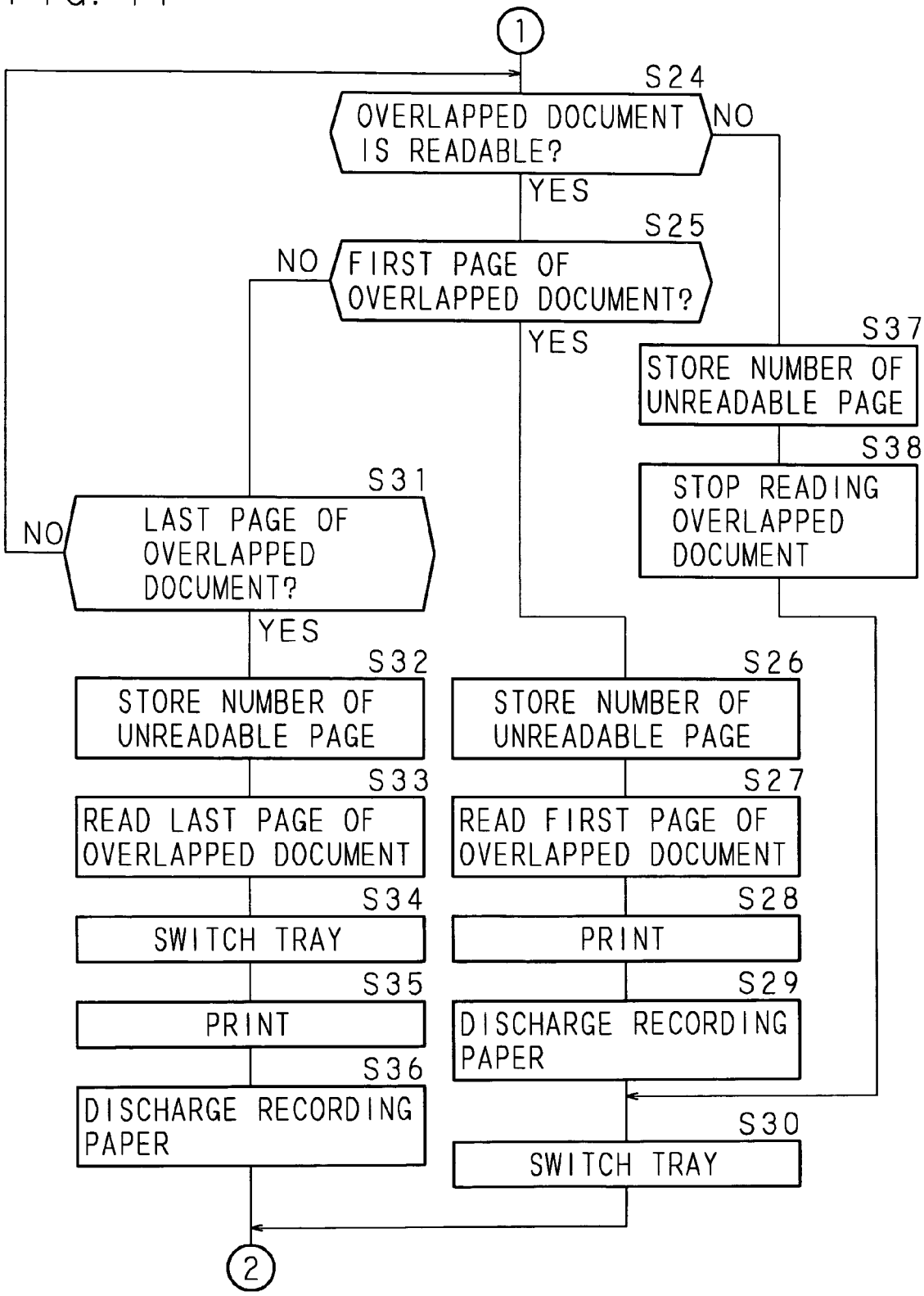
FIG. 11 is a flowchart showing the steps of a process executed by the image forming apparatus when overlapped feeding of documents is detected.

Next, the operation of the image forming apparatus 100 of the present invention will be explained. FIGS. 10 and 11 are flowcharts showing the steps of a process executed by the image forming apparatus 100 when overlapped feeding of documents is detected. The controller 10 determines, based on the information inputted from the operation unit 16, whether or not there is an instruction to read a document (S11). If there is no read instruction (NO in S11), the controller 10 continues the process of step S11, and waits until a read instruction is given.

When there is a read instruction (YES in S11), the controller 10 resets an overlapped feeding record W indicating the number of times the multiple documents were fed in an overlapped manner to 0 (S12), and causes the document feeding unit 8 to feed the documents placed on the document tray (S13). The controller 10 causes the counter 17 to count the number of pages of fed documents (in the case of single sided documents, the number of sheets of documents) (S14), and determines whether or not overlapped feeding of documents was detected (S15).

When overlapped feeding of documents was not detected (NO in S15), the controller 10 causes both of the image reading units 24 and 30 (both of them in the case of a double sided document, or one of them in the case of a single sided document) to read the image on the document (S16), causes the image forming unit 4 to perform printing (form an output image) on recording paper based on the read image (S17), and causes the printed recording paper to be discharged onto the first tray 51*a* (S18).

The controller 10 determines whether or not there is a document to be fed (S19). If the controller 10 determines that there is a document (YES in S19), it continues the processes in and after step S13. If the controller 10 determines that there is no document (NO in S19), the controller 10 determines whether or not there is a page from which the image on the document could not have been read (S20). If the controller 10 determines that there is no page which could not have been read (NO in S20), it finishes the process.

If the controller 10 determines that there is a page which could not have been read (YES in S20), it causes the operation unit 16 to notify that overlapped feeding was detected (S21), and causes the guide driving unit 15 to reset tray switching to switch the tray for discharging the recording paper to the first tray (S22) and finishes the process.

On the other hand, if overlapped feeding of documents is detected (YES in S15), the controller 10 adds 1 to the overlapped feeding record W (S23), and determines whether or not the image on the overlapped documents is readable (S24). If the image on the overlapped documents is readable (YES in S24), the controller 10 determines whether or not the readable document is the first page of overlapped document (the first sheet of overlapped document) (S25). If it is the first page of overlapped document (YES in S25), the controller 10 stores the number of an unreadable page (for example, the second sheet of overlapped document) in the storing unit 12 (S26).

The controller 10 causes the image reading units 24 and 30 to read the image on the first page of overlapped document (S27), and causes the image forming unit 4 to perform printing (form an output image) on recording paper based on the read image (S28). The controller 10 causes the printed recording paper to be discharged onto the first tray 51*a* (S29), causes the guide driving unit 15 to switch the tray for discharging the recording paper to the second tray (or other empty tray) from the first tray (S30), and continues the processes in and after step S19.

If the readable document is not the first page of overlapped document (NO in S25), the controller 10 determines whether the readable document is the last page of overlapped document (the second sheet of overlapped document) (S31). If the readable document is not the last page of overlapped document (NO in S31), the controller 10 continues the processes in and after step S24.

If the readable document is the last page of overlapped document (YES in S31), the controller 10 stores the number of an unreadable page (for example, the first sheet of overlapped document) in the storing unit 12 (S32). The controller 10 causes the image reading units 24 and 30 to read the image on the last page of overlapped document (S33), and causes the guide driving unit 15 to switch the tray for discharging the recording paper to the second tray (or other empty tray) from the first tray (S34). The controller 10 causes the image recording section 4 to perform printing (form an output image) on recording paper based on the read image (S35), causes the printed recording paper to be discharged onto the second tray 51*b* (or the switched tray) (S36), and continues the processes in and after step S19.

On the other hand, if the image on the overlapped documents is unreadable (NO in S24), the controller 10 stores the number of unreadable pages (for example, both of the front and back pages of the first sheet of and both of the front and back pages of the second sheet of overlapped documents, or the first and second sheets of overlapped documents) in the storing unit 12 (S37). The controller 10 stops the process of reading the image on the overlapped documents (S38), and continues the processes in and after step S30.

According to the above-mentioned processes, before overlapped feeding is detected, recording paper on which an image is printed by reading the image on a fed document is discharged onto the first tray, for example. When overlapped feeding is detected, recording paper on which an image is printed by reading the image on a document fed after the overlapped documents is discharged onto the second tray. At this time, if the image on the first sheet of overlapped document is readable, recording paper on which an image is printed by reading the image on the document is discharged onto the first tray, or, if the image on the second sheet of overlapped document is readable, recording paper on which an image is printed by reading the image on the document is discharged onto the second tray.

Further, when overlapped feeding is detected again at the time of feeding a document, recording paper on which an image is printed by reading the image on a document fed after the overlapped documents is discharged onto the third tray. At this time, if the image on the first sheet of overlapped document is readable, recording paper on which an image is printed by reading the image on the document is discharged onto the second tray, or, if the image on the second sheet of overlapped document is readable, recording paper on which an image is printed by reading the image on the document is discharged onto the third tray.

Figure 12:
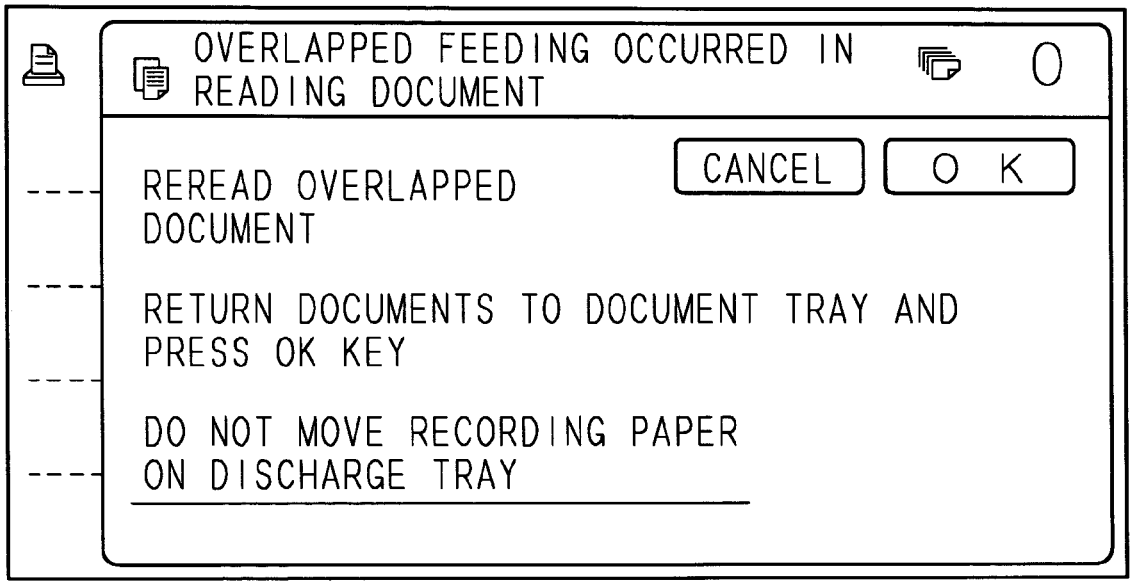
FIG. 12 is a schematic view showing one example of a screen displayed on a display screen for notifying overlapped feeding.

FIG. 12 is a schematic view showing one example of a screen displayed on a display screen for notifying overlapped feeding. As shown in FIG. 12, when overlapped feeding of documents is detected, a screen for notifying overlapped feeding of documents is displayed on the liquid crystal display of the operation unit 16. Displayed on the display screen is a message such as, for example, "Overlapped feeding has occurred in reading a document.", "Reread the overlapped documents.", "Return the documents to the document tray and press the OK key.", and "Do not move the recording paper on the discharge tray.". When the user places all the documents discharged after being fed on the document tray and presses the OK key, the image forming apparatus 100 performs the processes of feeding and reading the documents again. By just asking the user to place the discharged documents on the document tray as they are, the image forming apparatus 100 performs the recovery process with respect to the overlapped documents.

Figure 13:
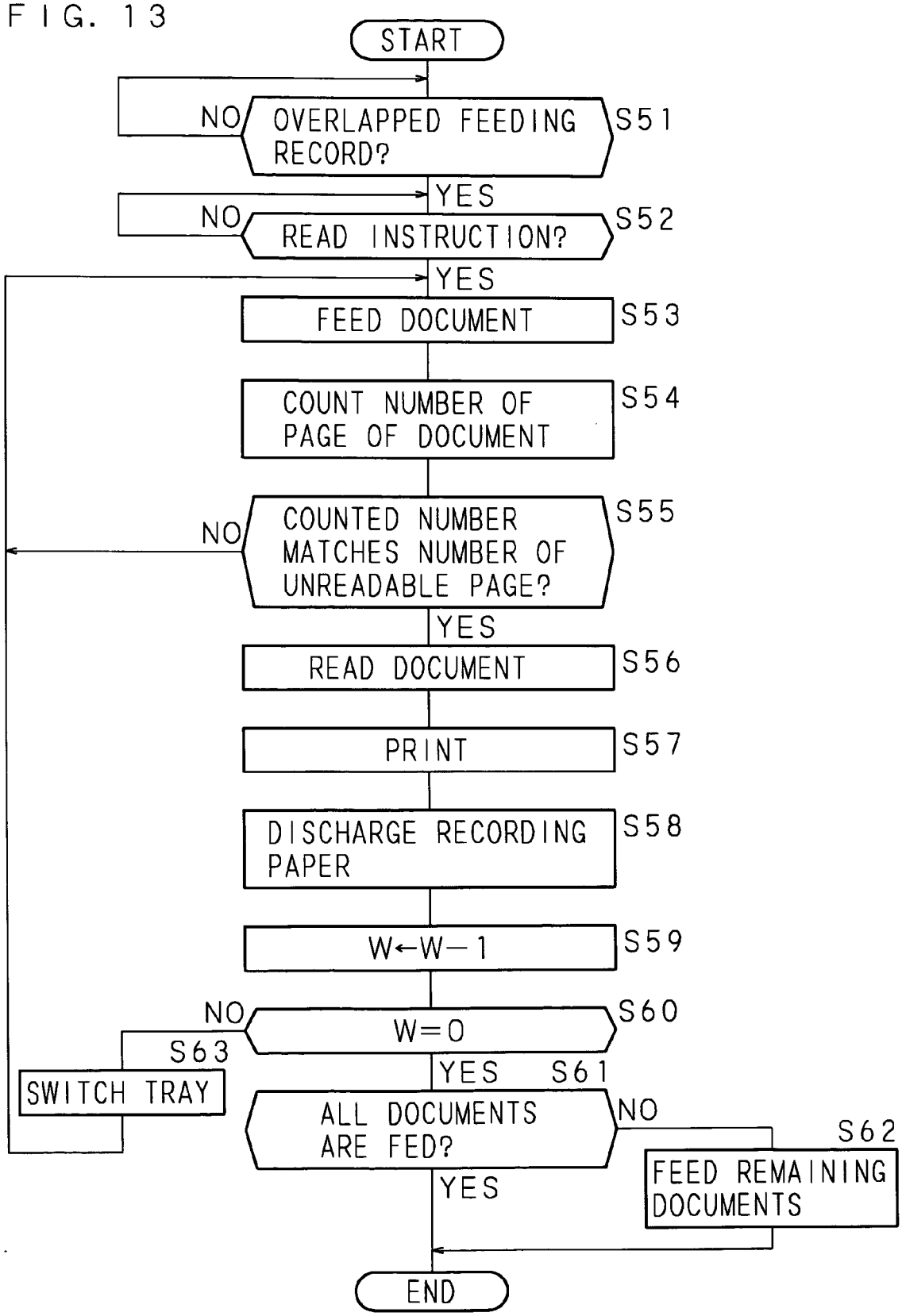
FIG. 13 is a flowchart showing the steps of a process executed by the image forming apparatus when rereading the overlapped documents.

FIG. 13 is a flowchart showing the steps of a process executed by the image forming apparatus 100 when rereading the overlapped documents. The controller 10 determines whether or not there is an overlapped feeding record, based on whether the overlapped feeding record W is 0 or not (S51). If there is no overlapped feeding record (W=0) (NO in S51), the controller 10 continues the process of step S11 and waits.

If there is an overlapped feeding record (W≠0) (YES in S51), the controller 10 determines whether or not there is an instruction to read the documents, based on the information inputted from the operation unit 16 (S52). If there is no read instruction (NO in S52), the controller 10 continues the process of step S52, and waits until a read instruction is given.

If there is a read instruction (YES in S52), the controller 10 causes the document feeding unit 8 to feed the documents placed on the document tray (S53), and causes the counter 17 to count the number of pages of documents fed (in the case of single sided documents, the number of sheets of documents) (S54). The controller 10 determines whether the number of pages of documents counted matches the number of unreadable pages stored (S55). If the number of pages of documents counted does not match the number of unreadable pages stored (NO in S55), the controller 10 continues the processes in and after step S53.

If the number of pages of documents counted matches the number of unreadable pages stored (YES in S55), the controller 10 causes the image reading units 24 and 30 to read the images on the documents of the matching pages (S56), causes the image recording section 4 to perform printing (form output images) on the recording paper based on the read images (S57), and causes the printed recording paper to be discharged onto the first tray 51*a* (S58).

The controller 10 subtracts 1 from the overlapped feeding record W (S59), and determines whether or not the overlapped feeding record W is equal to 0 (S60). If the overlapped feeding record W is 0 (YES in S60), the controller 10 determines whether or not all the documents have been fed (S61). If all the documents have been fed (YES in S61), the controller 10 finishes the process. If all the documents have not been fed (NO in S61), the controller 10 causes the document feeding unit 8 to feed the remaining documents (S62), and finishes the process.

When the overlapped feeding record W is not 0 (NO in S60), the controller 10 causes the guide driving unit 15 to switch the tray for discharging the recording paper to the second tray (or other empty tray) from the first tray (S63), and continues the processes in and after step S53.

According to the above-mentioned processes, the recording paper on which an image is printed by reading the image on a document which could not have been read in the overlapped documents is discharged onto the first tray. For example, when overlapped feeding of documents occurs twice in feeding documents, recording paper on which an image is printed by reading the image on a document which could not have been read due to the second overlapped feeding is discharged onto the second tray.

Figures 14A, 14B, 14C:
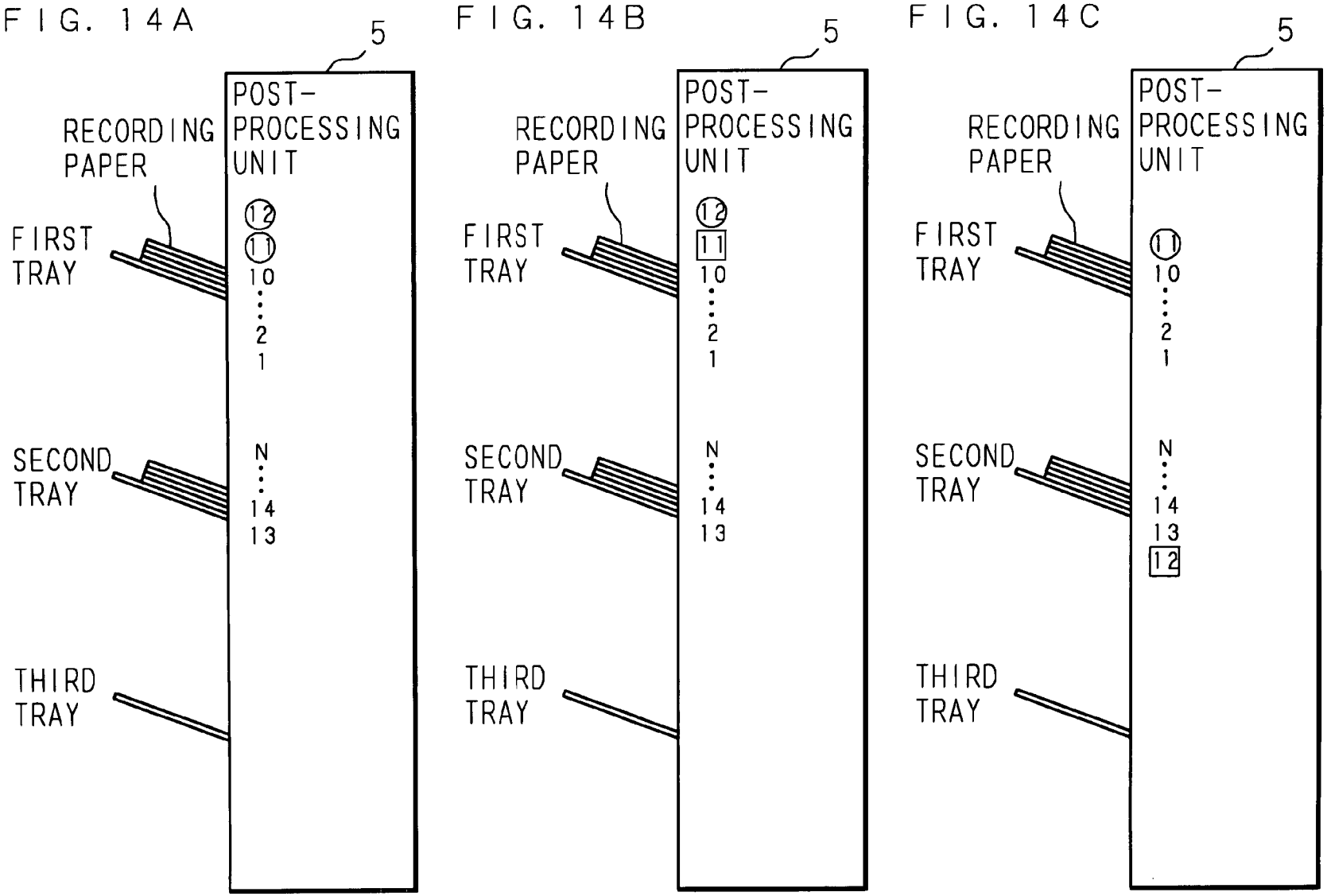
FIGS. 14A to 14C are schematic views showing one example of discharging of recording paper when overlapped feeding of documents occurs.

FIGS. 14A to 14C are schematic views showing one example of discharging of recording paper when overlapped feeding of documents occurs. The post-processing unit 5 includes three trays (the first tray, second tray and third tray). The page numbers (indicating which sheets) of recording paper discharged onto each tray are indicated by 1, 2, . . . N (N is the last page), and the page number of the recording paper corresponds to the page number of the document. FIGS. 14A to 14C show the case where overlapped feeding occurred on the 11th and 12th sheets of documents. The number enclosed by a square indicates the page number of recording paper corresponding to the page number of a readable overlapped document when overlapped feeding of documents occurred. The number enclosed by a circle indicates the page number of recording paper corresponding to the page number of an unreadable overlapped document when overlapped feeding of documents occurred.

As shown in FIG. 14A, when the 11th and 12th sheets are overlapped documents, if both of these documents are unreadable (as in the case of, for example, double sided copying of double sided documents), the recording paper (1, 2, . . . 10) corresponding to the documents (1st to 10th sheets) fed before the occurrence of overlapped feeding is discharged onto the first tray. The recording paper (13, 14, . . . N) corresponding to the documents (13th to Nth sheets) fed after the overlapped documents are discharged onto the second tray.

All the read documents and documents fed at a time in an overlapped manner when feeding a document are discharged onto the document discharge tray 25 in the page order of the documents placed on the document tray 20. Upon the notification of overlapped feeding, when the user places all the documents discharged onto the document discharge tray 25 on the document tray 20 again and starts reading, the documents (1st to Nth sheets) are fed sequentially, and only the 11th and 12th documents (overlapped documents) which could not have been read during the first reading due to overlapped feeding of documents are read by the image reading unit, and thus the recording paper (11, 12) corresponding to the 11th and 12th sheets of documents fed in an overlapped manner (the documents which could not have been read) is discharged following the recording paper (1, 2, . . . 10) onto the first tray.

As shown in FIG. 14B, when the 11th and 12th sheets are overlapped documents, if the first sheet of overlapped document (the first page of overlapped document) is readable (as in the case of, for example, picking up the topmost document from the documents placed with the front side facing up), the recording paper (1, 2, . . . 10) corresponding to the documents (1st to 10th sheets) fed before the occurrence of overlapped feeding is discharged onto the first tray. The recording paper (11) corresponding to the first sheet of overlapped document, namely the 11th sheet of the documents, is discharged following the recording paper (1, 2, . . . 10) onto the first tray. The recording paper (13, 14, . . . N) corresponding to the documents (13th to Nth sheets) fed after the overlapped documents is discharged onto the second tray.

All the read documents and documents fed at a time in an overlapped manner when feeding a document are discharged onto the document discharge tray 25 in the page order of the documents placed on the document tray 20. Upon the notification of overlapped feeding, when the user places all the documents discharged onto the document discharge tray 25 on the document tray 20 again and starts reading, the documents (1st to Nth sheets) are fed sequentially, and only the 12th sheet of the documents (the overlapped document) which could not have been read during the first reading due to overlapped feeding of documents is read by the image reading unit, and thus the recording paper (12) corresponding to the 12th sheet of document fed in an overlapped manner (the document which could not have been read) is discharged following the recording paper (1, 2, . . . 10, 11) onto the first tray.

As shown in FIG. 14C, when the 11th and 12th sheets are overlapped documents, if the second sheet of overlapped document (the last page of overlapped document) is readable (as in the case of, for example, picking up the bottommost document from the documents placed with the front side facing up), the recording paper (1, 2, . . . 10) corresponding to the documents (1st to 10th sheets) fed before the occurrence of overlapped feeding is discharged onto the first tray. The recording paper (12) corresponding to the second sheet of overlapped document, namely the 12th sheet of the documents, is discharged onto the second tray. The recording paper (13, 14, . . . N) corresponding to the documents (13th to Nth sheets) fed after the overlapped documents is discharged following the recording paper (12) onto the second tray.

All the read documents and documents fed at a time in an overlapped manner when feeding a document are discharged onto the document discharge tray 25 in the page order of the documents placed on the document tray 20. Upon the notification of overlapped feeding, when the user places all the documents discharged onto the document discharge tray 25 on the document tray 20 again and starts reading, the documents (1st to Nth sheets) are fed sequentially, and only the 11th sheet of the documents (the overlapped document) which could not have been read during the first reading due to overlapped feeding of documents is read by the image reading unit, and thus the recording paper (11) corresponding to the 11th sheet of the documents which was fed in an overlapped manner (the document which could not have been read) is discharged following the recording paper (1, 2, . . . 10) onto the first tray.

Accordingly, when the user places the documents again on the document tray 20 upon detection of overlapped feeding, a document which could not have been read due to overlapped feeding of documents is read, and recording paper corresponding to the document failed for reading due to overlapped feeding is discharged in the order matching the page order of the documents onto the tray. Hence, by simply placing sheets of the recording paper discharged onto the respective trays one upon the other in order, for example, by placing all the sheets of the recording paper discharged onto the second tray on the first tray, it is possible to arrange the recording paper according to the order of the documents, and the work of confirming the pages of overlapped documents, sorting or rearranging the recording paper is completely unnecessary. It is thus possible to reduce the burden placed on the user when overlapped feeding occurs.

Figures 15A, 15B, 15C:
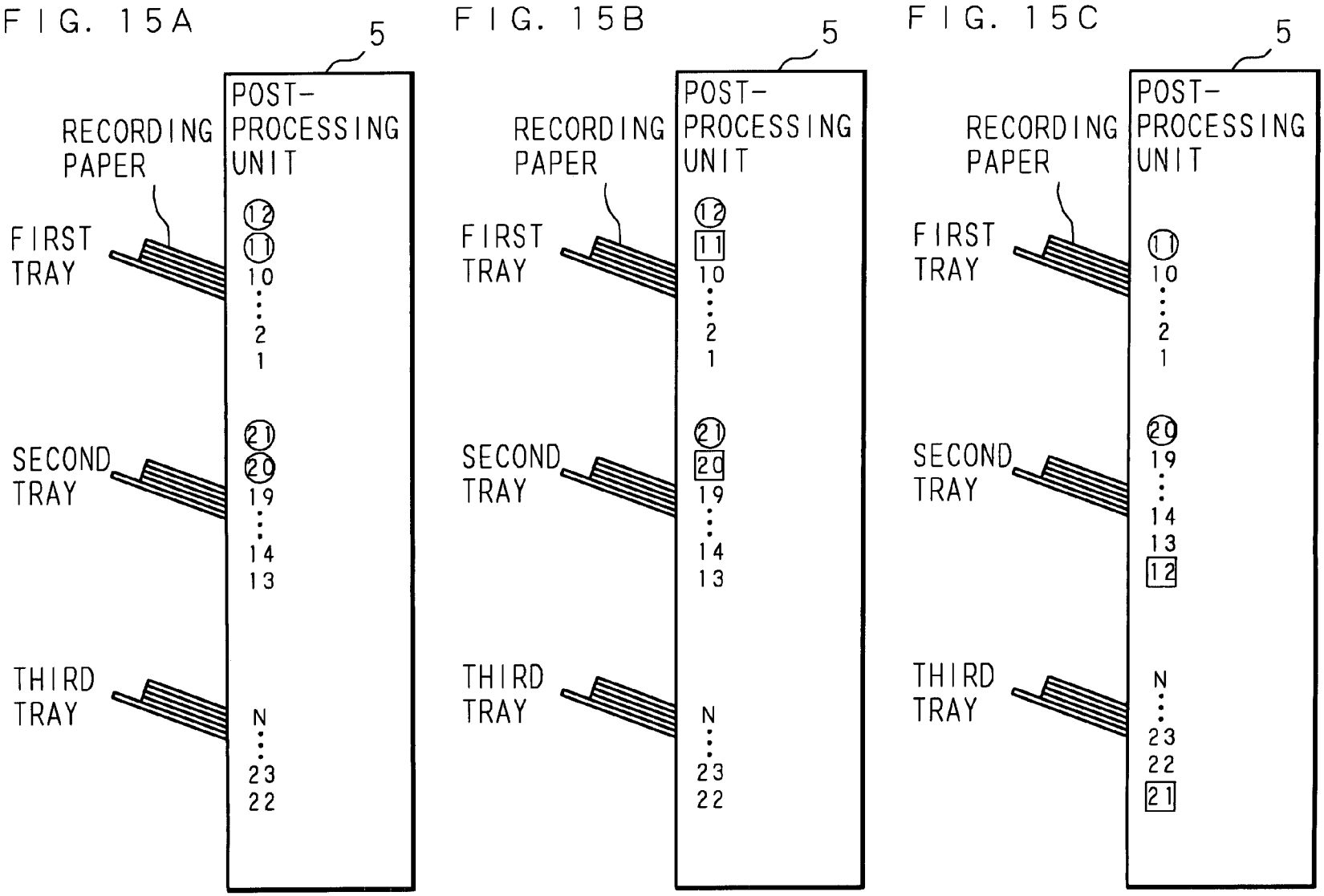
FIGS. 15A to 15C are schematic views showing one example of discharging of recording paper when overlapped feeding of documents occurs twice.

FIGS. 15A to 15C are schematic views showing one example of discharging of recording paper when overlapped feeding of documents occurs twice. The post-processing unit 5 includes three trays (the first tray, second tray and third tray). The page numbers (indicating which sheets) of the recording paper discharged onto the respective trays are indicated by 1, 2, . . . , N (N is the last page), and the page number of the recording paper corresponds to the page number of the document. FIGS. 15A to 15C show the case where the first overlapped feeding occurred on the 11th and 12th sheets of documents, and the second overlapped feeding occurred on the 20th and 21st sheets of documents. The number enclosed by a square indicates the page number of recording paper corresponding to the page number of a readable overlapped document when overlapped feeding of documents occurred. The number enclosed by a circle indicates the page number of recording paper corresponding to the page number of an unreadable overlapped document when overlapped feeding of documents occurred.

As shown in FIG. 15A, when the 11th and 12th sheets are overlapped documents in the first overlapped feeding, if both of the overlapped documents are unreadable (as in the case of, for example, double sided copying of double sided documents), the recording paper (1, 2, . . . 10) corresponding to the documents (1st to 10th sheets) fed before the occurrence of overlapped feeding is discharged onto the first tray.

When the 20th and 21st sheets are overlapped documents in the second overlapped feeding, if both of the overlapped documents are unreadable, the recording paper (13, 14, . . . 19) corresponding to the documents (13th to 19th sheets) fed before the second overlapped feeding occurred is discharged onto the second tray. The recording paper (22, 23, . . . N) corresponding to the documents (22nd to Nth sheets) fed after the overlapped documents in the second overlapped feeding is discharged onto third tray.

By reading the documents (1st to Nth sheets) again, the recording paper (11, 12) corresponding to the 11th and 12th sheets of the documents fed in an overlapped manner is discharged following the recording paper (1, 2, . . . 10) onto the first tray. Moreover, the recording paper (20, 21) corresponding to the 20th and 21st sheets of the documents fed in overlapped manner is discharged following the recording paper (13, 14, . . . 19) onto the second tray.

As shown in FIG. 15B, when the 11th and 12th sheets are overlapped documents in the first overlapped feeding, if the first sheet of overlapped document (the first page of overlapped document) is readable (as in the case of, for example, picking up the topmost document from the documents placed with the front side facing up), the recording paper (1, 2, . . . 10) corresponding to the documents (1st to 10th sheets) fed before the occurrence of overlapped feeding is discharged onto the first tray. The recording paper (11) corresponding to the 1st sheet of the overlapped documents, namely the 11th sheet of the documents, is discharged following the recording paper (1, 2, . . . 10) onto the first tray.

When the 20th and 21st sheets are overlapped documents in the second overlapped feeding, if the first sheet of overlapped document (the first page of overlapped document) is readable, the recording paper (13, 14, . . . 19) corresponding to the documents (13th to 19th sheets) fed before the occurrence of overlapped feeding is discharged onto the second tray. The recording paper (20) corresponding to the first sheet of overlapped document, namely the 20th sheet of the documents, is discharged following the recording paper (13, 14, . . . 19) onto the second tray. The recording paper (22, 23, . . . N) corresponding to the documents (22nd to Nth sheets) fed after the overlapped documents in the second overlapped feeding is discharged onto third tray.

By reading the documents (1st to Nth sheets) again, the recording paper (12) corresponding to the 12th sheet of the documents which could not have been read due to overlapped feeding is discharged following the recording paper (1, 2, . . . 10, 11) onto the first tray. Moreover, the recording paper (21) corresponding to the 21st sheet of the documents, which could not have been read due to overlapped feeding, is discharged following the recording paper (13, 14, . . . 19, 20) onto the second tray.

As shown in FIG. 15C, when the 11th and 12th sheets are overlapped documents in the first overlapped feeding, if the second sheet of overlapped document (the last page of overlapped document) is readable (as in the case of, for example, picking up the bottommost document from the documents placed with the front side facing up), the recording paper (1, 2, . . . 10) corresponding to the documents (1st to 10th sheets) fed before the occurrence of overlapped feeding is discharged onto the first tray. The recording paper (12) corresponding to the second sheet of overlapped document, namely the 12th sheet of the documents, is discharged onto the second tray.

When the 20th and 21st sheets are overlapped documents in the second overlapped feeding, if the second sheet of overlapped document (the first page of overlapped document) is readable, the recording paper (13, 14, . . . 19) corresponding to the documents (13th to 19th sheets) fed before the occurrence of overlapped feeding is discharged following the recording paper (12) onto the second tray. The recording paper (21) corresponding to the second sheet of overlapped document, namely the 21st sheet of the documents, is discharged onto the third tray. The recording paper (22, 23, . . . N) corresponding to the documents (22nd to Nth sheets) fed after the overlapped documents in the second overlapped feeding is discharged following the recording paper (21) onto the third tray.

By reading the documents (1st to Nth sheets) again, the recording paper (11) corresponding to the 11th sheet of the documents, which could not have been read due to overlapped feeding, is discharged following the recording paper (1, 2, . . . 10) onto the first tray. Moreover, the recording paper (20) corresponding to the 20th sheet of the documents, which could not have been read due to overlapped feeding, is discharged following the recording paper (12, 13, . . . 19) onto the second tray.

As explained above, in the present invention, even when overlapped feeding of documents is detected, it is possible to continue the process of forming an output image based on the read image, without stopping the feed of documents to be read, and it is possible to prevent a decrease in the overall job efficiency of the apparatus due to overlapped feeding. Moreover, since recording paper on which an output image is formed can be easily arranged in the feed order (read order) of the documents, it is possible to reduce the burden of the user.

Furthermore, even when overlapped feeding is detected, since the reading process is continued for a readable overlapped document, it is possible to continue the image forming processes for the overlapped document, and it is possible to prevent a decrease in the overall job efficiency of the apparatus without wasting the time required for feeding the documents. Additionally, since there is no need to sort overlapped documents from documents which were not fed in an overlapped state, it is possible to reduce the burden of the user. In particular, when a large amount of documents needs to be processed at high speeds, it is possible to significantly reduce the burden of the user.

In Embodiment 1, although three trays are provided for discharging the recording paper, the number of the trays for discharging is not limited to this, and four or more trays may be provided.

Embodiment 1 explains the case where overlapped documents are two sheets, but the present invention is also applicable to the case where overlapped documents are three sheets, four sheets, etc. if a document jam does not occur in the transport path.

In Embodiment 1, one copy of documents is printed, but the present invention is also applicable to the case where a plurality of copies of documents are printed, sorted and discharged on a copy-by-copy basis, and recording paper corresponding to overlapped documents is discharged onto another tray.

Figure 16:
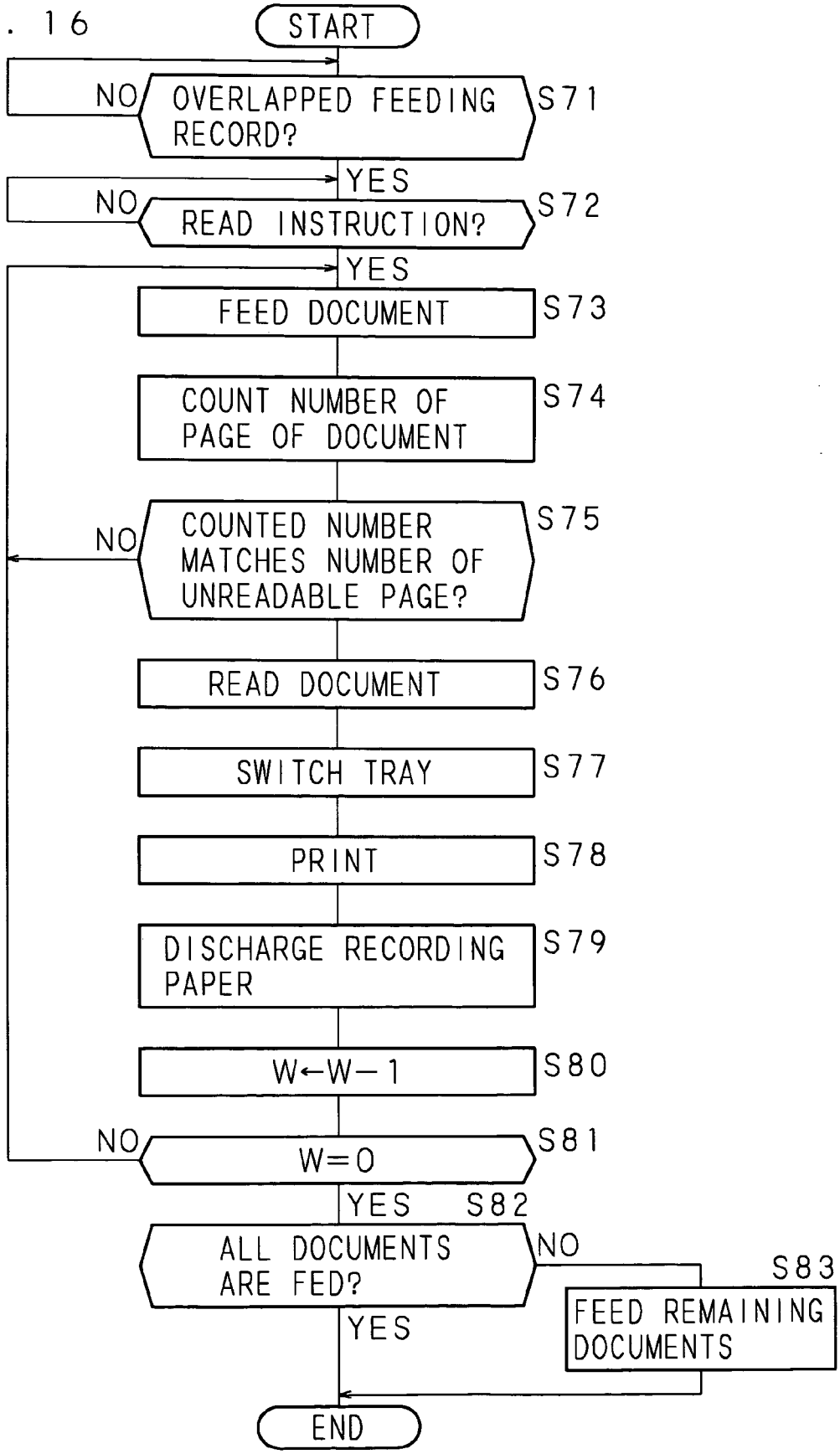
FIG. 16 is a flowchart showing the steps of a process executed by the image forming apparatus when rereading the overlapped documents in making a plurality of sets of copies.

FIG. 16 is a flowchart showing the steps of processes executed by the image forming apparatus 100 when rereading the overlapped documents in making a plurality of copies. Note that since the flowchart showing the steps of the processes executed by the image forming apparatus 100 when overlapped feeding of documents is detected is the same as in FIGS. 10 and 11, the explanation thereof is omitted. Recording paper is printed for a required number of copies and discharged by sorting it (or shifting the recording paper) on a copy-by-copy basis.

The controller 10 determines whether or not there is an overlapped feeding record, based on whether or not the overlapped feeding record W is 0 (S71). If there is no overlapped feeding record (W=0) (NO in S71), the controller 10 continues the process of step S71 and waits.

If there is an overlapped feeding record (W≠0) (YES in S71), the controller 10 determines whether or not there is an instruction to read a document, based on the information inputted from the operation unit 16 (S72). If there is no read instruction (NO in S72), the controller 10 continues the process of step S72, and waits until a read instruction is given.

When there is a read instruction (YES in S72), the controller 10 causes the document feeding unit 8 to feed the documents placed on the document tray (S73), and causes the counter 17 to count the number of pages of documents fed (the number of sheets of documents if the documents are single sided documents) (S74). The controller 10 determines whether the number of pages of documents counted matches the number of unreadable pages stored (S75). If the number of pages of the documents counted does not match the number of unreadable pages stored (NO in S75), the controller 10 continues the processes in and after step S73.

When the number of pages of documents counted matches the number of unreadable pages stored (YES in S75), the controller 10 causes the image reading units 24 and 30 to read the images on the documents of the matching pages (S76), causes the guide driving unit 15 to switch the tray for discharging the recording paper to other empty tray (for example, the third tray) (S77). The controller 10 causes the image recording section 4 to perform printing (to form output images) on the recording paper based on the read images to make a required number of copies (S78), and causes the printed recording paper to be discharged onto the switched tray by sorting the recording paper (or shifting the recording paper) on a copy-by-copy basis (S79).

The controller 10 subtracts 1 from the overlapped feeding record W (S80), and determines whether or not the overlapped feeding record W is equal to 0 (S81). If the overlapped feeding record W is 0 (YES in S81), the controller 10 determines whether or not all the documents have been fed (S82). If all the documents have been fed (YES in S82), the controller 10 finishes the process. If all the documents have not been fed (NO in S82), the controller 10 causes the document feeding unit 8 to feed the remaining documents (S83), and finishes the process.

When the overlapped feeding record W is not 0 (NO in S81), the controller 10 continues the processes in and after step S73.

Figure 17B:
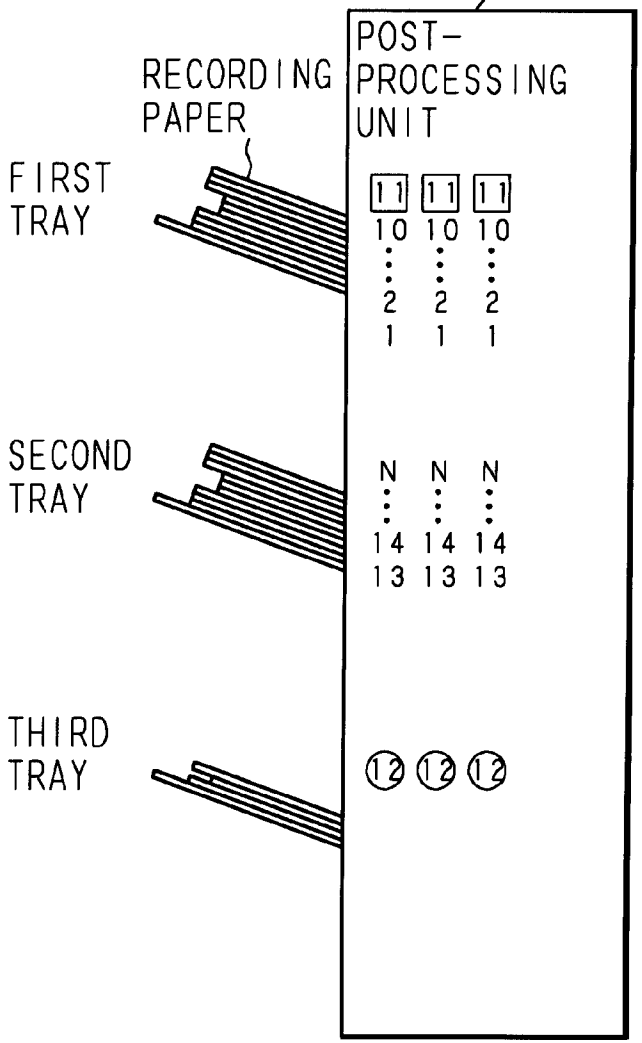
FIGS. 17A to 17B are schematic views showing one example of discharging of recording paper when documents are fed in an overlapped manner in making a plurality of sets of copies of documents.
Figure 17A:
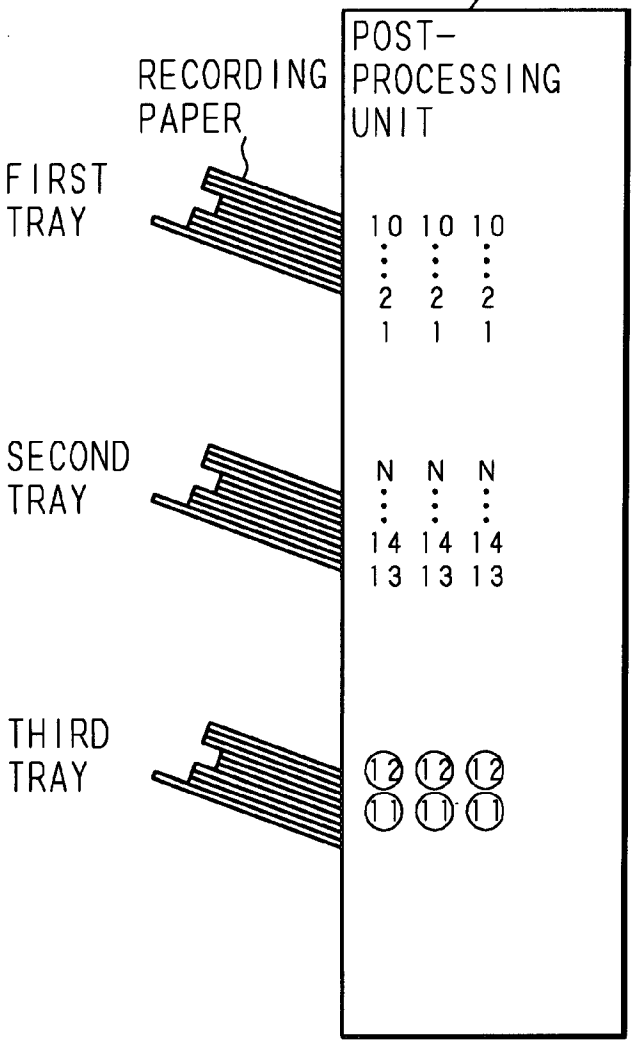

FIGS. 17A and 17B are schematic views showing one example of discharging of recording paper when documents are fed in an overlapped manner in making a plurality of copies of documents. The post-processing unit 5 includes three trays (the first tray, second tray and third tray). The page numbers (indicating which sheets) of recording paper discharged onto the respective trays are indicated by 1, 2, . . . N (N is the last page), and the page number of the recording paper corresponds to the page number of the document. FIGS. 17A and 17B show the case where overlapped feeding occurred on the 11th and 12th sheets of the documents. The number enclosed by a square indicates the page number of recording paper corresponding to the page number of a readable overlapped document when overlapped feeding of documents occurred. The number enclosed by a circle indicates the page number of recording paper corresponding to the page number of an unreadable overlapped document when overlapped feeding of documents occurred. Although FIGS.

17A and 17B show the case where three copies of documents are produced, the number of copies is not limited to this.

As shown in FIG. 17A, when the 11th and 12th sheets are overlapped documents, if both of the multiple documents are unreadable (as in the case of, for example, double sided copying of double sided documents), the recording paper (1, 2, . . . 10) corresponding to the documents (1st to 10th sheets) fed before the occurrence of overlapped feeding is discharged onto the first tray by sorting the recording paper on a copy-by-copy basis. The recording paper (13, 14, . . . N) corresponding to the documents (13th to Nth sheets) fed after the overlapped documents is discharged onto the second tray by sorting the recording paper on a copy-by-copy basis.

All the read documents and documents fed at a time in an overlapped manner when feeding a document are discharged onto the document discharge tray 25 in the page order of the documents placed on the document tray 20. Upon the notification of overlapped feeding, when the user places all the documents discharged onto the document discharge tray 25 on the document tray 20 again and starts reading, the documents (1st to Nth sheets) are fed sequentially, and only the 11th and 12th sheets of the documents (overlapped documents) which could not have been read in the first reading due to overlapped feeding are read by the image reading unit, and thus the recording paper (11, 12) corresponding to the 11th and 12th sheets of documents fed in an overlapped manner (the documents failed for reading) is discharged onto the third tray by sorting the recording paper on a copy-by-copy basis.

As shown in FIG. 17B, when the 11th and 12th sheets are overlapped documents, if the first sheet of overlapped document (the first page of overlapped document) is readable (as in the case of, for example, picking up the topmost sheet of the documents placed with the front side facing up), reading has been completed for the 1st to 10th sheets of the documents which were read before the occurrence of overlapped feeding and the 11th sheet of the document which was read during the overlapped feeding, and therefore the recording paper (1, 2, . . . 10, 11) corresponding to the 1st to 11th sheets of the documents is discharged onto the first tray by sorting it on a copy-by-copy basis. The recording paper (13, 14, . . . N) corresponding to the documents (13th to Nth sheets) fed after the overlapped documents is discharged onto the second tray by sorting it on a copy-by-copy basis.

All the read documents and documents fed at a time in an overlapped manner when feeding a document are discharged onto the document discharge tray 25 in the page order of the documents placed on the document tray 20. Upon the notification of overlapped feeding, when the user places all the documents discharged onto the document discharge tray 25 on the document tray 20 again and starts reading, the documents (1st to Nth sheets) are fed sequentially, and only the 12th sheet of the document (overlapped document) which could not have been read during the first reading due to overlapped feeding is read by the image reading unit, and thus the recording paper (12) corresponding to the 12th sheet of the document, which was fed in an overlapped manner (the document failed for reading), is discharged onto the third tray.

According to the above-mentioned processes, if overlapped feeding occurs once, for example, before the detection of overlapped feeding, recording paper printed by reading the images on documents fed is discharged onto the first tray, for example, by shifting the recording paper on a copy-by-copy basis. When overlapped feeding is detected, recording paper printed by reading the images on documents fed after the overlapped documents is discharged onto the second tray by shifting the recording paper on a copy-by-copy basis. Recording paper printed by feeding the documents again and reading the overlapped documents is discharged onto the third tray by shifting the recording paper on a copy-by-copy basis. Even when making a plurality of copies of documents, the user can easily arrange the recording paper in the feed order (or read order) of the documents by placing the recording paper discharged onto the respective trays one over the other in order.

Although Embodiment 1 shows an example where the transport path of the document feeding unit 8 is a reverse path, the present invention is not limited to this, and may use a transport path in the form of a straight path.

Figure 18:
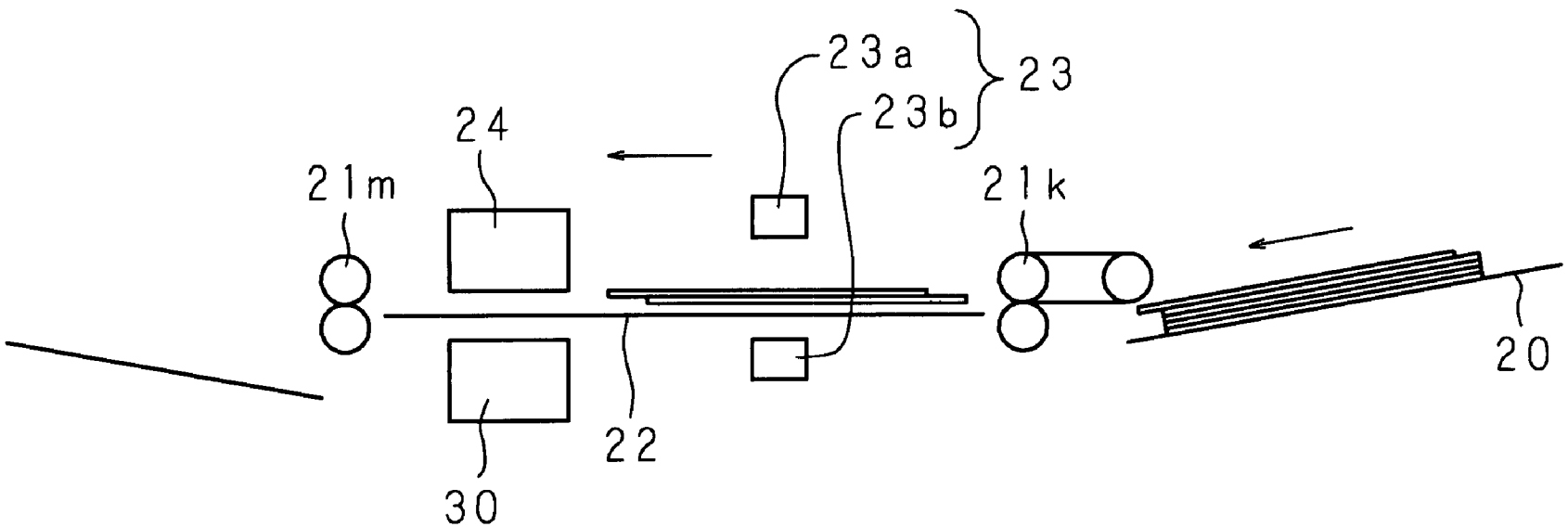
FIG. 18 is a schematic view showing a transport path (straight path) when the topmost document is picked up.

FIG. 18 is a schematic view showing the transport path (straight path) when picking up the topmost document. As shown in FIG. 18, on the document tray 20, a stack of documents are placed with the front side (the surface where an image is recorded) facing down. The topmost document in the stack of documents is separated and fed one sheet at a time to the transport path 22 by the pickup roller 21*k*. When one sheet of the document could not be separated by the pickup roller 21*k* and two sheets of the documents are fed in an overlapped manner, the image on the first sheet of overlapped document is covered with the second sheet of overlapped document, and can not be read by the image reading unit 30. On the other hand, since the image on the second sheet of overlapped document is not covered with the first sheet of overlapped document, it is readable by the image reading unit 30. In this case, therefore, the controller 10 which received an overlapped feeding detection signal determines that the first sheet of overlapped document is unreadable and that the second sheet of overlapped document is readable. Note that if a stack of documents are placed with the front side (the surface where an image is recorded) facing up on the document tray 20, a fed document can be read in the same manner by the image reading unit 24, instead of the image reading unit 30.

Figure 19:
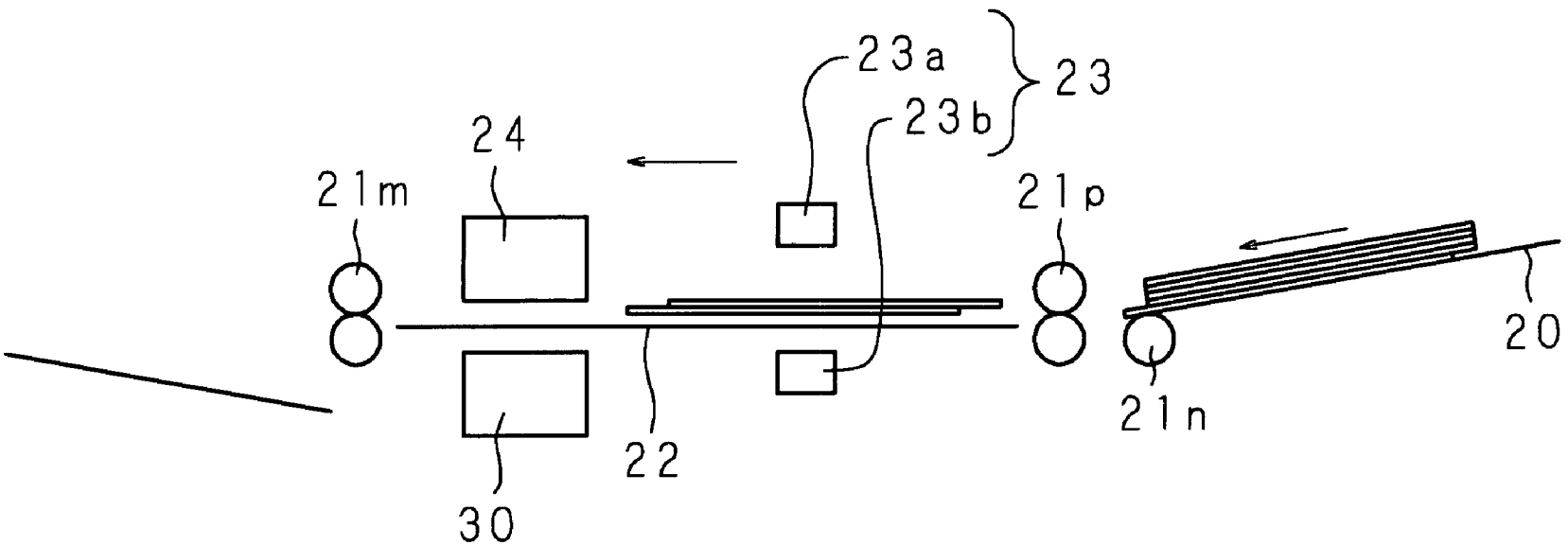
FIG. 19 is a schematic view showing a transport path (straight path) when the bottommost document is picked up.

FIG. 19 is a schematic view showing a transport path (straight path) when the bottommost document is picked up. As shown in FIG. 19, on the document tray 20, a stack of documents are placed with the front side (the surface where an image is recorded) facing down. The bottommost document in the stack of documents is fed one sheet at a time to the transport path 22 by the pickup rollers 21*n* and 21*p*. When one sheet of the document could not be separated by the pickup rollers 21*n* and 21*p* and two sheets of documents are fed in an overlapped manner, the image on the first sheet of overlapped document can be read by the image reading unit 30 because it is not covered with the second sheet of overlapped document. On the other hand, since the image on the second sheet of overlapped document is covered with the first sheet of overlapped document, it can not be read by the image reading unit 30. In this case, therefore, the controller 10 which received an overlapped feeding detection signal determines that the first sheet of overlapped document is readable and that the second sheet of overlapped document is unreadable. Note that if a stack of documents are placed with the front side (the surface where an image is recorded) facing up on the document tray 20, the fed document can be read in the same manner by the image reading unit 24, instead of the image reading unit 30.

In Embodiment 1, although the ultrasonic sensor is used as means for detecting overlapped feeding of documents, the means is not limited to this, and it may be possible to use, for example, an optical sensor. However, in the case where the optical sensor is used, when the length of a document in the feed direction is detected and the distance between the leading end and trailing end of the document is larger than the dimension of the document, a determination is made that overlapped feeding has occurred. Therefore, when two sheets of documents perfectly overlap each other, there is a possibility that overlapped feeding may not be detected. Thus, in terms of detection accuracy, the ultrasonic sensor is superior.

Although Embodiment 1 explains printing a double sided document (namely, a document with images recorded on the front and back sides thereof) on both sides of recording paper (so-called double sided copying), it may be possible to print a double sided document on a single side of recording paper. In this case, for example, when two sheets of documents are fed in an overlapped manner, the image on the front side of the first sheet of overlapped document and the image on the back side of the second sheet of overlapped document are readable. Therefore, by continuing the reading process, it is possible to prevent the feed time of the documents from being wasted.

In Embodiment 1, although the tray for discharging the recording paper is switched by the guide, switching of trays is not limited to this, and it may be possible to move the transport path itself to discharge the recording paper onto a predetermined tray, or it may be possible to switch a discharge location of the recording paper by moving the discharge tray.

Embodiment 2

Figure 20:
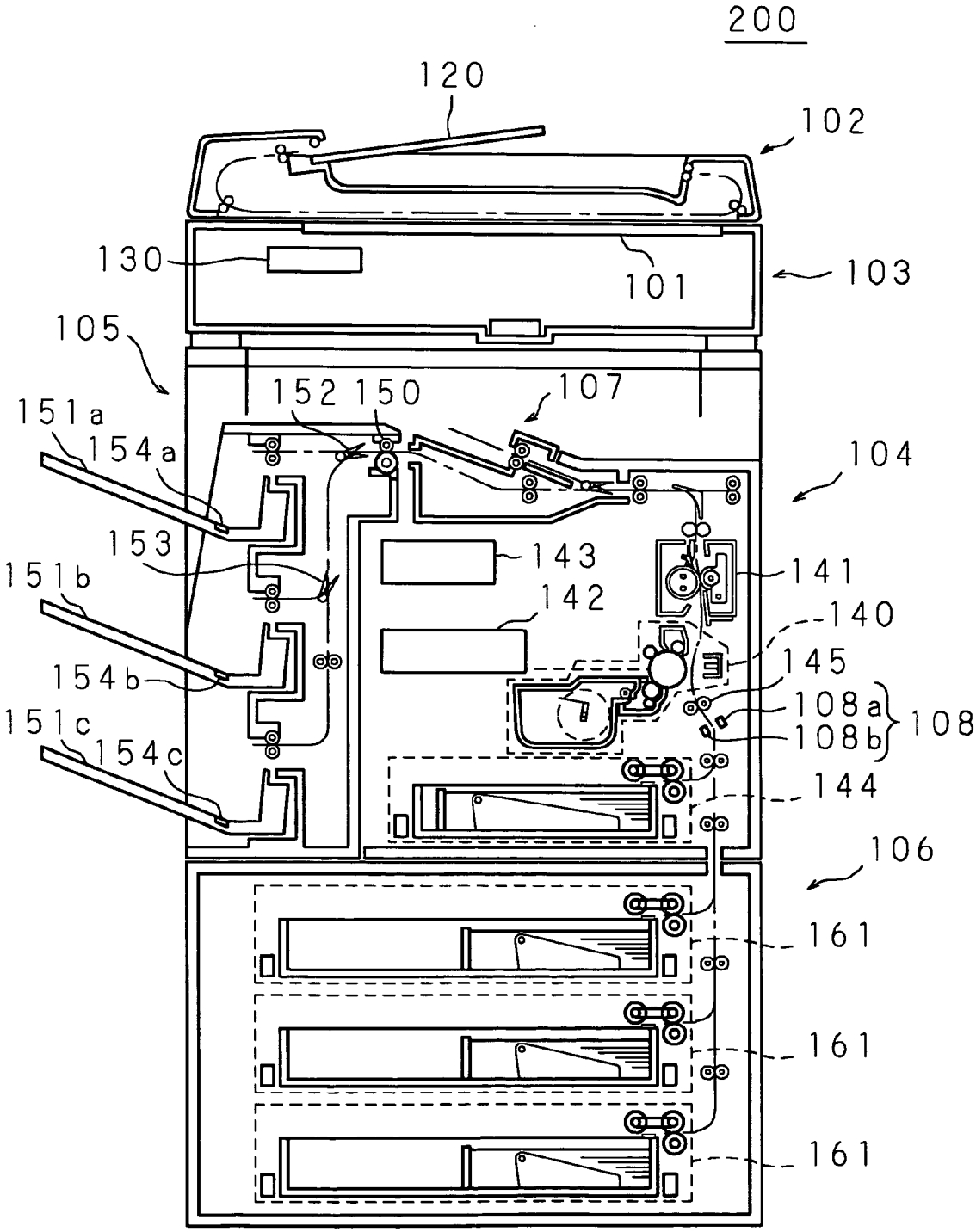
FIG. 20 is a front schematic view of an image forming apparatus according to Embodiment 2 of the present invention.

The following description will explain the present invention, based on the drawings illustrating Embodiment 2 thereof. FIG. 20 is a front schematic view of an image forming apparatus 200 according to Embodiment 2 of the present invention. In FIG. 20, 101 is a glass platen for placing a document thereon. Mounted above the platen 101 is an automatic document feeding unit 102 including an image reading unit (not shown) and a document tray 120. Mounted under the platen 101 is a scanner unit 103 including an image reading unit 130.

The image forming unit 130 comprises a scanning unit that moves in a reciprocating manner parallel to the lower surface of the platen 101, a focus lens, and a CCD line sensor as a photoelectric conversion device (none of them are shown). The scanning unit comprises a light source for irradiating laser light on a document placed on the platen 101 or a document fed along the transport path, and a mirror for guiding the laser light reflected by the document to a predetermined optical path. The focus lens focuses the laser light guided from the scanning unit on a predetermined position on the CCD line sensor. The CCD line sensor outputs an electric signal by photoelectrically converting the focused light image. The image reading unit outputs data decomposed into color components of R (red), G (green) and B (blue) based on a color image read from the document to a later-described process controller 143. Predetermined image data processing is performed on the data outputted to the process controller 143.

An image forming unit 104 is provided under the scanner unit 103 so that a transport path 107 for discharging recording paper (sheet) having an image formed thereon is located therebetween. The image forming unit 104 comprises an electrophotographic processing section 140, a fixing device 141, an optical writing unit 142, the process controller 143 for controlling the electrophotographic processing section 140, and a recording paper storage section 144 for storing the recording paper.

The electrophotographic processing section 140 comprises a photoreceptor drum to be driven and rotated, a developing device for developing an electrostatic latent image formed on the surface of the photoreceptor drum, and a transfer device for transferring a toner image on the photoreceptor drum surface to the recording paper.

The fixing device 141 comprises a fixing roller, and fixes the toner image to the recording paper by applying high heat and pressure to the toner image transferred and formed on the recording paper.

The optical writing unit 142 comprises a semiconductor laser device for emitting dot light modulated according to image formation data generated based on image data read by the image reading unit 130, or image data obtained from an external personal computer etc.; a polygon mirror for deflecting laser light emitted from the semiconductor laser device in a main scanning direction; and lenses and mirrors (none of them are shown) for focusing the laser light deflected by the polygon mirror on the surface of the photoreceptor drum.

Mounted under the image forming unit 104 is a multi-stage paper feeding unit 106 in which recording paper storage sections 161, . . . for storing recording paper are arranged in three stages in a vertical direction. When forming an output image, a desired size of recording paper is selected, and the selected recording paper is supplied to the electrophotographic processing section 140.

A resist roller 145 for feeding the recording paper according to the image forming timing is provided in the transport path on the upstream side of the electrophotographic processing section 140. Provided in the transport path located on the upstream side of the resist roller 145 and the downstream side of the recording paper storage section 144 and multistage paper feeding unit 106 is an ultrasonic sensor 108 including a transmission section 108*a* for transmitting ultrasonic waves and a reception section 108*b* for receiving the ultrasonic waves transmitted by the transmission section 108*a*, which are positioned with the transport path therebetween.

A post-processing unit 105 for performing post-processing (for example, sorting and stapling) on the recording paper is placed on a side face of the electrophotographic processing section 140 between the scanner unit 103 and the multistage paper feeding unit 106. The post-processing unit 105 comprises discharge-use trays 151*a* (first tray), 151*b* (second tray) and 151*c* (third tray) for discharging the recording paper having an image formed thereon, guides 152 and 153 for switching which tray the recording paper is to be discharged to, and transport rollers 150 for feeding the recording paper to be discharged. Moreover, recording paper sensors 154*a*, 154*b* and 154*c* for detecting the presence or absence of recording paper discharged onto the trays are provided for the trays 151*a*, 151*b*, and 151*c*, respectively. The recording paper sensors 154*a*, 154*b* and 154*c* detect the presence or absence of the recording paper on the respective trays, and output the detection results to a controller 110.

Figure 21:
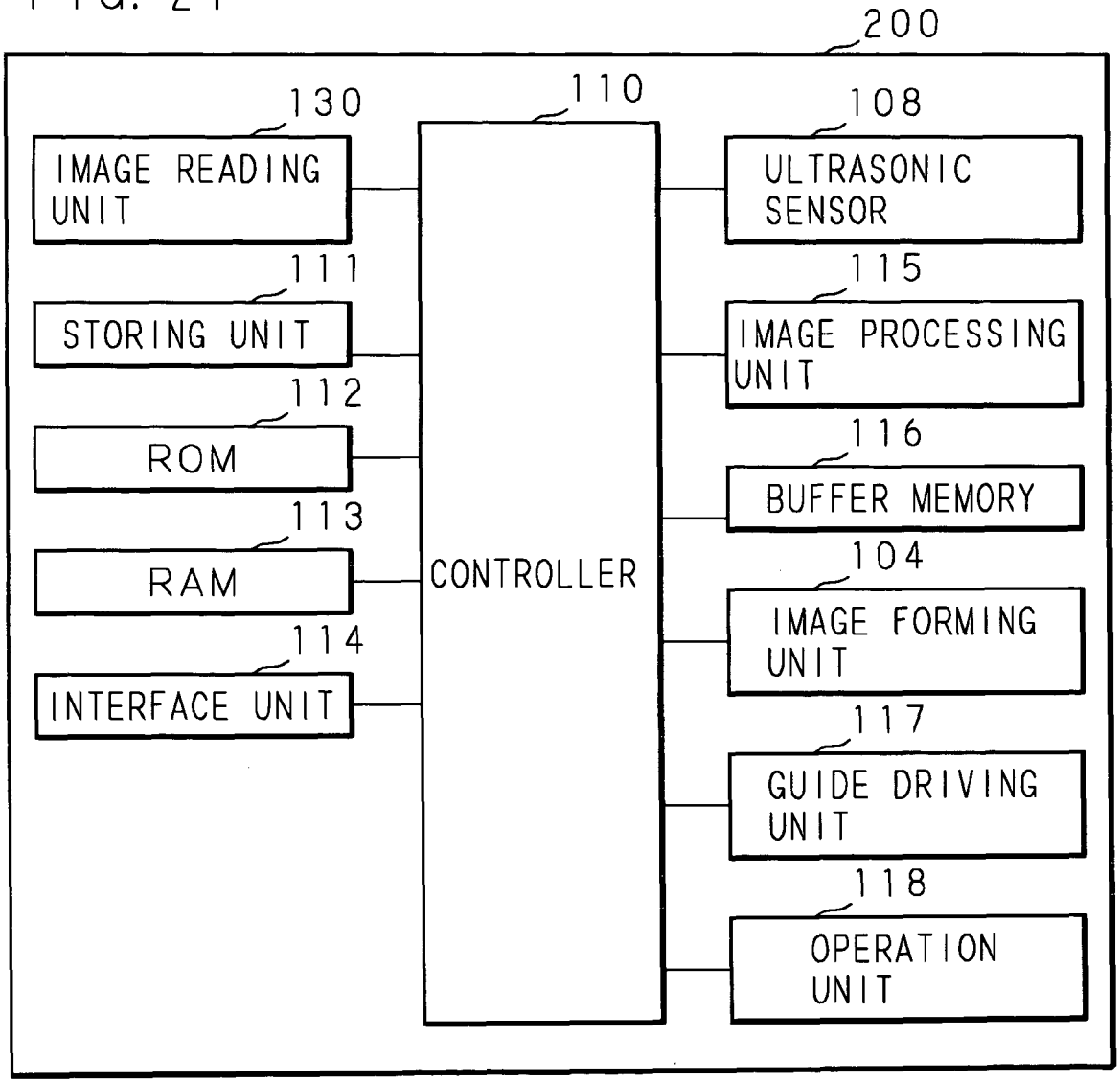
FIG. 21 is a block diagram showing the internal structure of the image forming apparatus according to Embodiment 2 of the present invention.

FIG. 21 is a block diagram showing the internal structure of the image forming apparatus 200 according to Embodiment 2 of the present invention. The image forming apparatus 200 comprises the controller 110 composed of a CPU for performing various calculation processes. Connected through an internal bus to the controller 110 are an image reading unit 130, a storing unit 111 composed of a HDD or the like, a ROM 112, a RAM 113, an interface unit 114, an ultrasonic sensor 108, an image processing unit 115, a buffer memory 116, an image forming unit 104, a guide driving unit 117, an operation unit 118 (output unit), etc., and the controller 110 controls the operations of these hardware sections.

The ROM 112 stores a control program indicating the control steps of the controller 110 in advance. When the CPU of the controller 110 loads the control program stored in the ROM 112 into the RAM 113, the controller 110 controls the operation of the image forming apparatus 200 according to the control steps indicated by the control program.

The image reading unit 130 photo-electrically converts the image on the document into an analog signal by the CCD sensor, and converts the obtained analog signal into a digital signal by an A/D converter. The image reading unit 130 corrects the alignment characteristic of the light source in reading the document, sensitivity variations of the image sensor, etc. with respect to the digital signal obtained by the conversion, and stores the obtained image data in the storing unit 111 under the control of the controller 110.

The image processing unit 115 generates data (image formation data) for controlling the semiconductor laser light for forming an electrostatic latent image on the photoreceptor drum surface, based on the image data stored in the storing unit 111, for each sheet of recording paper, and temporarily stores the generated data in the buffer memory 116. Whenever the image processing unit 115 generates image formation data, it outputs to the controller 110 a count signal indicating which sheet of recording paper the data for forming an image was generated. Accordingly, the controller 110 determines up to which sheet of the recording paper the image formation data has already been generated.

The image forming unit 104 forms an image on the recording paper, based on the image formation data stored in the buffer memory 116, under the control of the controller 110. Whenever an image is formed on the recording paper, the image forming unit 104 outputs to the controller 110 an output signal indicating which sheet of the recording paper the image was formed. Accordingly, the controller 110 can determine up to which sheet of recording paper the image has already been formed based on the already formed image formation data. Note that the image forming unit 104 is not limited to the electrophotographic type, and may be of an inkjet type, thermal transfer type, etc.

At a position in the transport path located on the downstream side of the junction between the recording paper storage section 144 and the multistage paper feeding unit 106 and on the upstream side of the resist roller 145, the ultrasonic sensor 108 detects overlapped feeding of documents, and outputs the detection result to the controller 110. Overlapped feeding means a state in which two sheets of recording paper are fed in an overlapped manner, instead of separating and feeding the recording paper one sheet at a time. The detail of overlapped feeding will be explained later with reference to FIGS. 23A to 23C.

Figure 22:
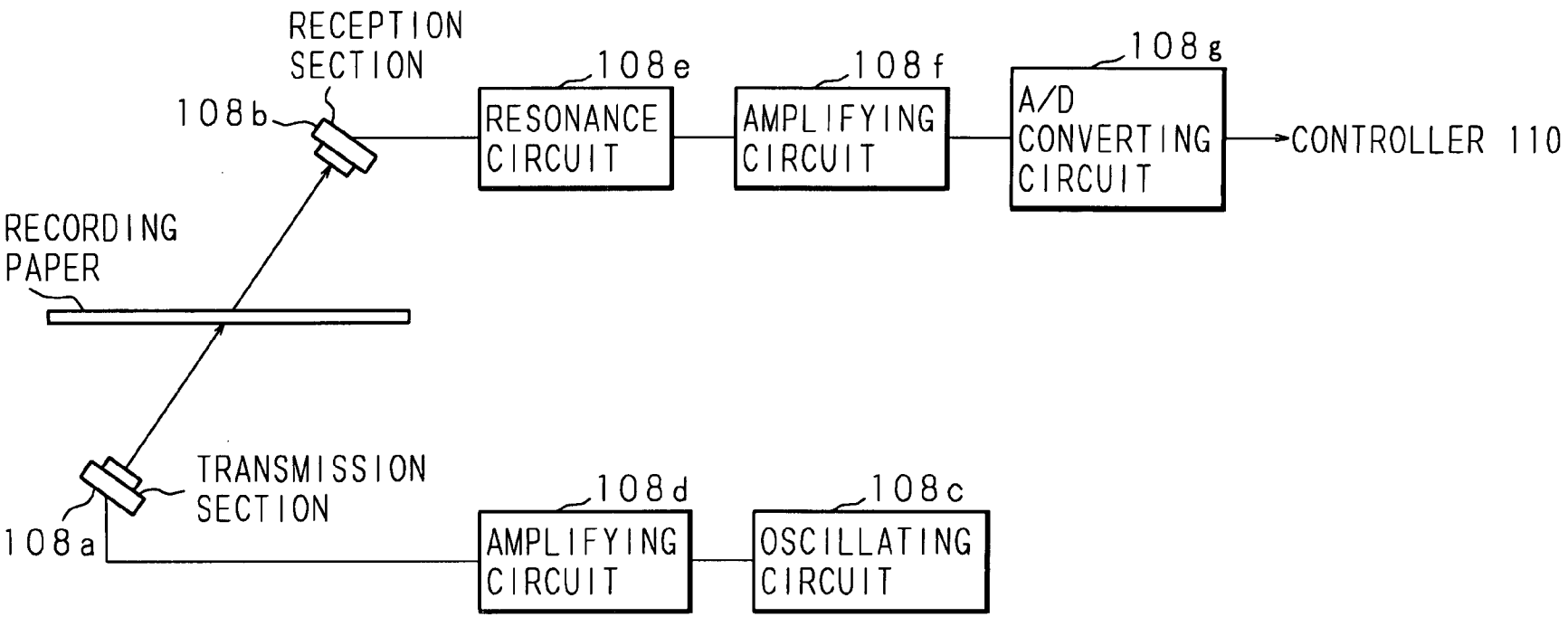
FIG. 22 is a block diagram showing the structure of an ultrasonic sensor.

FIG. 22 is a block diagram showing the structure of the ultrasonic sensor 108. The ultrasonic sensor 108 comprises, for example, an oscillating circuit 108*c* for producing a drive waveform with an oscillation frequency of about 220 kHz, an amplifying circuit 108*d* for amplifying the drive waveform produced by the oscillating circuit 108*c*, a transmission section 108*a* for transmitting the drive waveform, a reception section 108*b* for receiving a signal transmitted by the transmission section 108*a*, a resonance circuit 108*e* for detecting a signal received by the reception section 108*b* over a wide band (for example 220 kHz±20 kHz), an amplifying circuit 108*f* for amplifying the received signal, and an A/D converting circuit 108*g* for converting the amplified signal into a digital signal. The ultrasonic sensor 108 transmits a signal from the transmission section 108*a* to the fed recording paper, receives the transmitted signal by the reception section 108*b*, and outputs the signal to the controller 110, so that the number of sheets of recording paper fed, that is, overlapped feeding, is detected based on the magnitude of the energy of the signal. Note that means for detecting overlapped feeding is not limited to the ultrasonic sensor, and it may be possible to use other sensor.

The guide driving unit 117 switches the guides 152 and 153 under the control of the controller 110. For example, when performing a required print process, the guides 152 and 153 are switched so that the recording paper having an image formed thereon is discharged onto the first tray 151*a*. When overlapped feeding is detected, the guides 152 and 153 are switched so that the recording paper fed in an overlapped manner is discharged onto the third tray 151*c*. The guides 152 and 153 are switched so that the recording paper fed after the detection of overlapped feeding and having an image formed thereon is discharged onto the second tray 151*b*.

The operation unit 118 is a touch panel type operation panel, and comprises various keys and switches for receiving operation instructions of the user, and a liquid crystal display for displaying information to be given to the user. For example, when overlapped feeding is detected, if there is no empty tray, the operation unit 118 displays for the user an instruction to remove the recording paper on the tray. Moreover, when printing is finished, the operation unit 118 displays how to handle the recording paper, such as the order of placing the recording paper discharged on the tray.

The interface unit 114 obtains image data from an information processor such as an external personal computer, and stores the obtained image data in the storing unit 111.

Figure 23A:
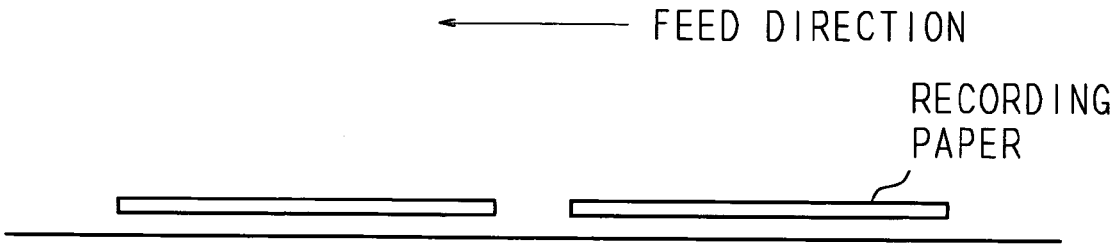
FIGS. 23A to 23C are explanatory views showing an example of overlapped feeding of recording paper.
Figure 23B:
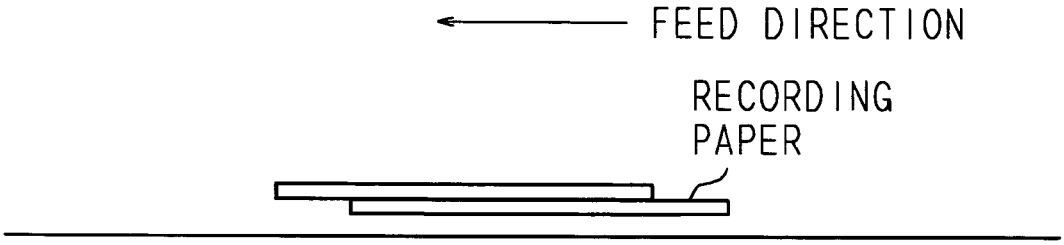
Figure 23C:
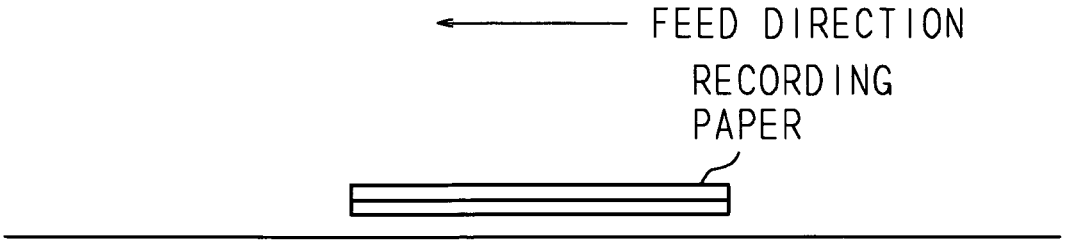

FIGS. 23A to 23C are explanatory views showing an example of overlapped feeding of recording paper. The arrow in FIGS. 23A to 23C indicates the feed direction of recording paper. FIG. 23A shows the case where the recording paper is fed normally one sheet at a time with a predetermined separation distance from the next recording paper. FIG. 23B shows the case where the first and second sheets of recording paper overlap each other with their leading ends not being aligned. FIG. 23C shows the case where the first and second sheets of recording paper overlap each other with their leading ends being aligned.

Figure 24:
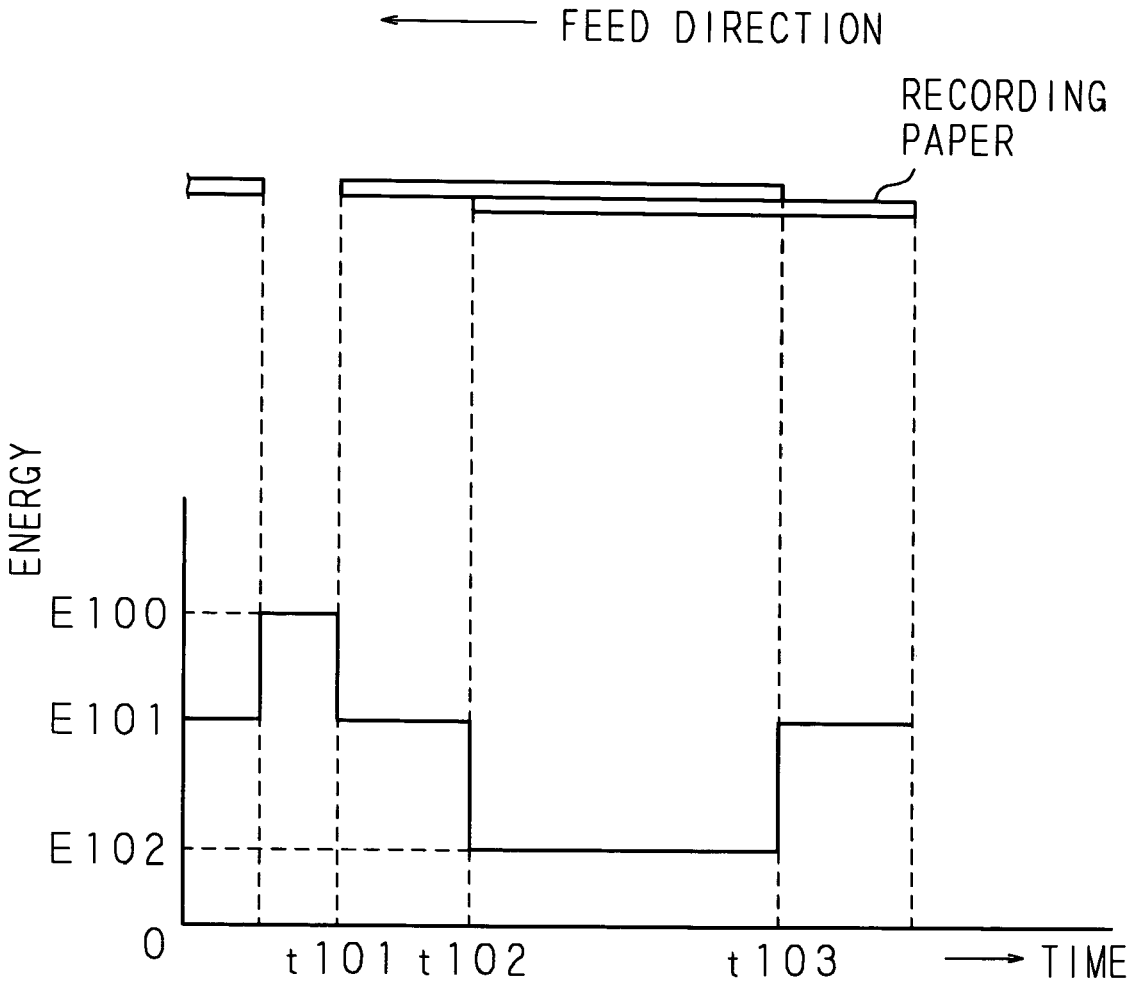
FIG. 24 is a time chart showing the levels of overlapped feeding detection signals when the leading ends of sheets of recording paper are not aligned with each other.

FIG. 24 is a time chart showing the levels of overlapped feeding detection signals when the leading ends of sheets of recording paper are not aligned with each other. The energy of the signal received by the reception section 108*b* of the ultrasonic sensor 108 (for example, transmitted energy) changes according to the number of sheets of recording paper through which the signal is transmitted. For example, when there is no recording paper, the energy of the received signal is E100; when there is one sheet of recording paper, the energy of the received signal is E101 (E100>E101); and when there are two sheets of recording paper, the energy of the received signal is E102 (E101>E102). Since the energy of the signal changed from E100 to E101 at time t101, the feed of the next recording paper is detected. When overlapped feeding of recording paper occurs, for example, the energy of the signal will change from E101 to E102 at time t102. It is possible to detect from the difference in the energy levels of the received signals that two sheets of recording paper were fed in an overlapped manner with their leading ends being not aligned with each other. The energy of the signal changes from E102 to E101 at time t103.

It is also possible to calculate an approximate length of misalignment between the sheets of recording paper fed in an overlapped manner, based on the feed speed of the recording paper and the time difference between time t102 and t101.

Figure 25:
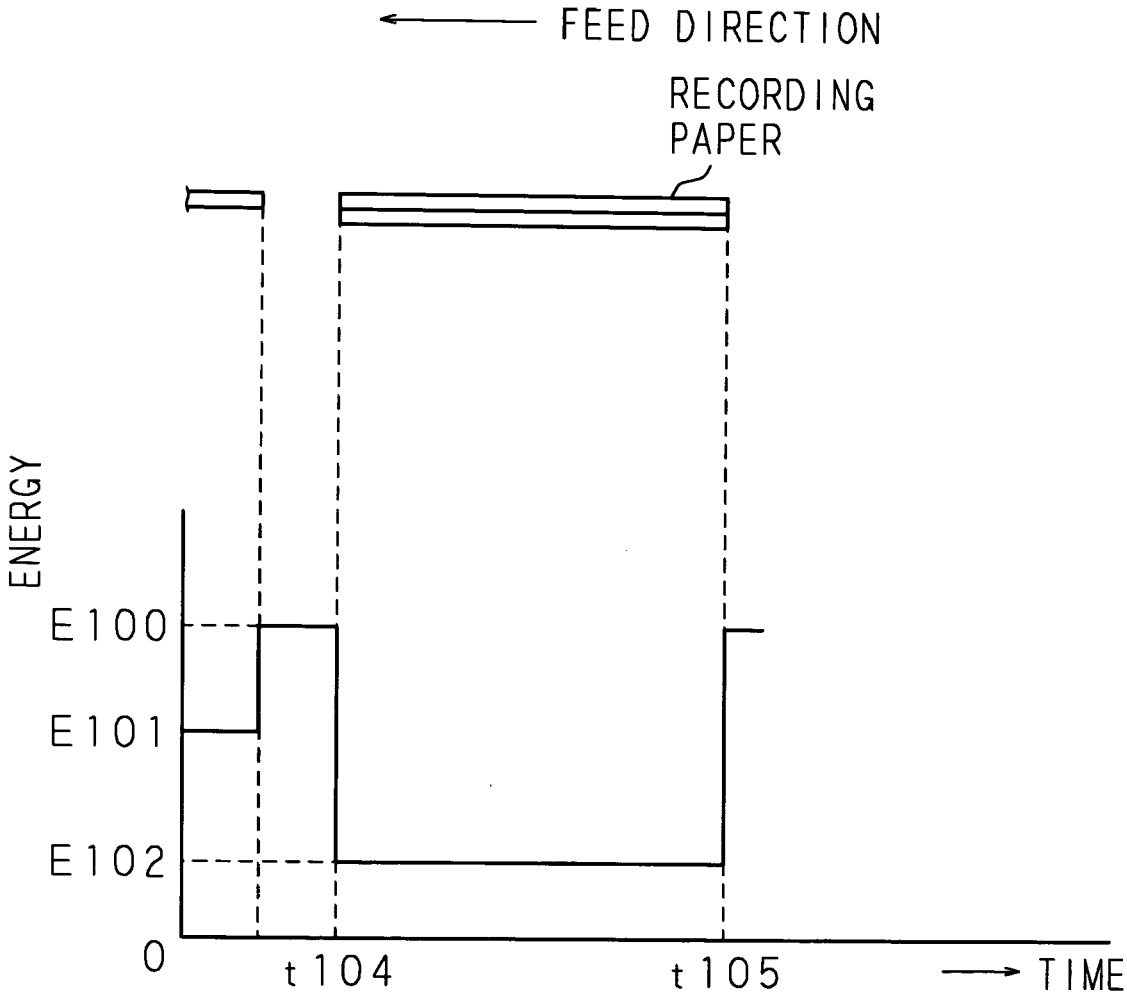
FIG. 25 is a time chart showing the relationship between overlapped feeding detection signals when the leading ends of sheets of recording paper are aligned with each other.

FIG. 25 is a time chart showing the relationship between overlapped feeding detection signals when the leading ends of sheets of recording paper are aligned with each other. The energy of the signal changes from E100 to E102 at time t104. It is possible to detect from the difference in the energy levels of the received signals that two sheets of recording paper were fed in an overlapped manner with their leading ends being aligned with each other. The energy of the signal changes from E102 to E100 at time t105.

The controller 110 determines, based on the detection result (the level of the detection signal) outputted from the ultrasonic sensor 108, the number of sheets of recording paper fed in an overlapped manner. When overlapped feeding is detected, the controller 110 determines, based on the count signal outputted from the image processing unit 115, the image forming process in progress, that is, up to which sheet of recording paper the image formation data has already been generated. Moreover, when overlapped feeding is detected, the controller 110 determines, based on the output signal outputted from the image forming unit 104, up to which sheet of recording paper the image has been formed.

When overlapped feeding is detected, if generation of image formation data has already been completed but image formation has not been completed, the controller 110 causes the image forming unit 104 to continue the image formation based on the generated image formation data. The image forming unit 104 outputs a signal to the controller 110 to notify the completion of the process of forming the image on the recording paper based on the generated image formation data.

When the controller 110 receives the signal from the image forming unit 104, it determines that it is possible to form an image by interrupting the image formation, and controls the image processing unit 115 and the image forming unit 104 to form the image which could not have been formed due to overlapped feeding (the image involved in overlapped feeding) on recording paper again. Moreover, the controller 110 controls the image processing unit 115 and the image forming unit 104 to continue to form the remaining images after forming the image which could not have been formed due to overlapped feeding on recording paper again.

Figure 26:
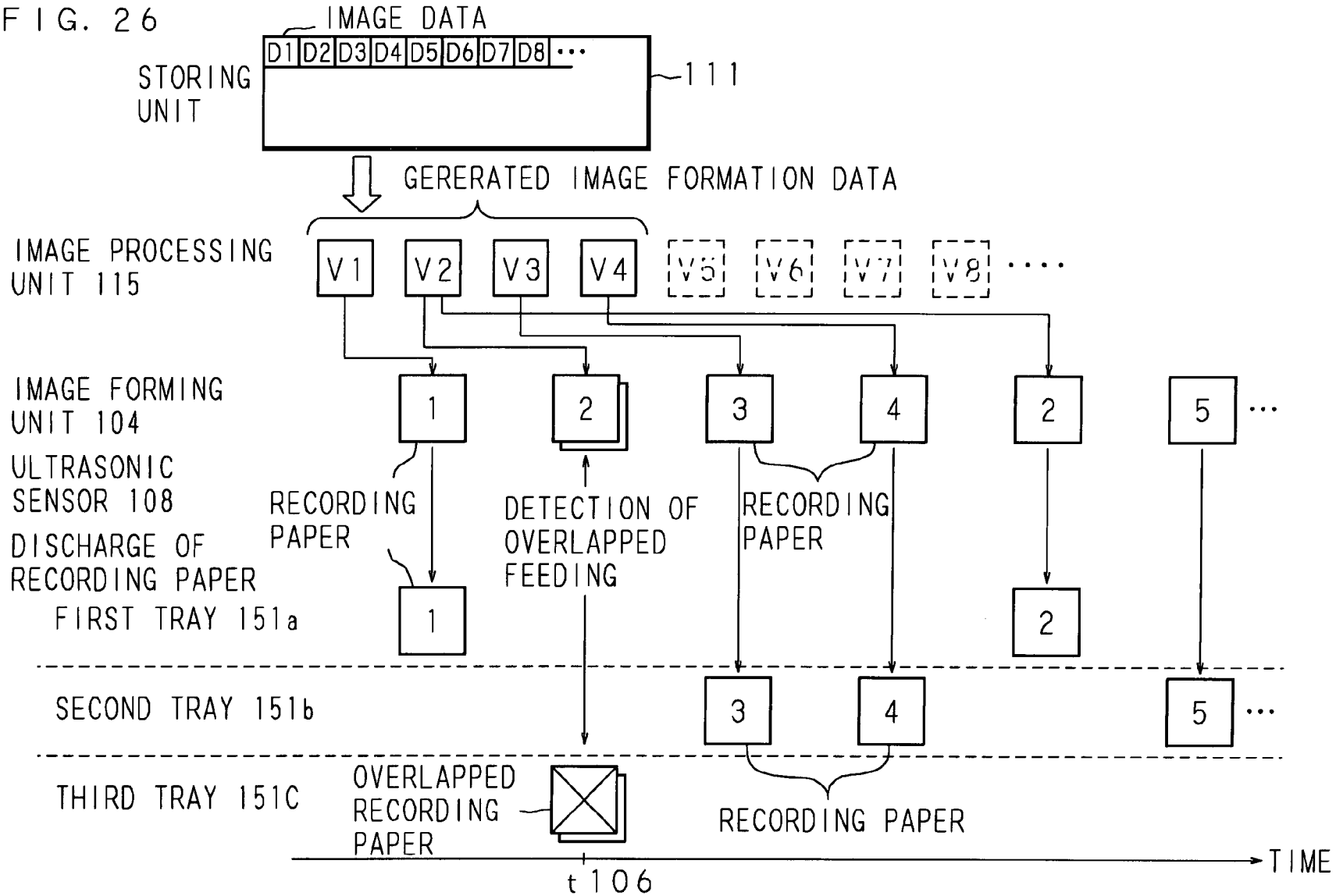
FIG. 26 is a time chart showing the processes of image formation.

FIG. 26 is a time chart showing an image forming process. The storing unit 111 stores in advance image data D1, D2, . . . (corresponding to recording paper 1, 2, . . . , respectively) for forming images on the recording paper 1, 2, . . . . The image processing unit 115 obtains the image data from the storing unit 111, and generates image formation data V1, V2, . . . (corresponding to the recording paper 1, 2, . . . , respectively) for forming images on the recording paper 1, 2, . . . . The image forming unit 104 forms the images on the recording paper 1, 2, . . . , based on the image formation data V1,
V2, . . . generated in the image processing unit 115.

The image forming unit 104 forms the image on the recording paper 1 based on the image formation data V1 generated in the image processing unit 115, and the recording paper 1 having the image formed thereon is discharged onto the first tray 151*a*. For example, when overlapped feeding is detected at time t106 in feeding the recording paper 2, the controller 110 causes the guide drive section 117 to switch the tray to the third tray 151 and causes the overlapped recording paper to be discharged onto the third tray 151*c*. Moreover, the controller 110 outputs a save signal for saving the image data D2 (or image formation data V2) for use in forming the image on the recording paper 2 to the image processing unit 115.

Note that, when overlapped feeding is detected, the controller 110 determines whether or not it is possible to stop image formation (writing) on the overlapped recording paper. If it is possible to stop the image formation, the controller 110 stops the image formation to prevent wasteful image formation. On the other hand, if it is not possible to stop the image formation, the controller 110 causes the image forming unit 104 to form the image on the overlapped recording paper, and causes the overlapped recording paper to be discharged onto the third tray 151*c*. When the image is formed on the overlapped recording paper, for example, when the image is formed on the overlapped two sheets of recording paper, the image cannot be formed under normal conditions because the conditions of image formation (for example, the transfer current, the fixing temperature, etc.) are different from those for forming the image on one sheet of recording paper, and therefore the overlapped recording paper is discharged onto the third tray 151 regardless of whether or not image formation is possible.

When the controller 110 determines at time t106 at which overlapped feeding was detected that the image formation data V4 up to the recording paper 4 have already been generated in the image processing unit 115, it instructs the image forming unit 104 to continue to form the images on the recording paper 3 and 4. The controller 110 causes the guide driving unit 117 to switch the tray for discharging the recording paper 3 and 4 to the second tray 151*b*. Consequently, the recording paper fed after overlapped feeding is discharged onto the second tray 151*b* different from the first tray 151 on which the recording paper fed before the overlapped feeding is discharged, and the overlapped recording paper is discharged onto the third tray 151*c* different from the first and second trays 151*a* and 151*b*.

At the time the image formation on the recording paper 4 was finished in the image forming unit 104, the image forming unit 104 outputs to the controller 110 a signal indicating the completion of image formation based on the generated image formation data. Accordingly, the controller 110 determines that it is possible to interrupt the image formation in progress, and controls the image processing unit 115 and the image forming unit 104 to form the image on recording paper again based on the image formation data V2 of the image which could not have been formed due to overlapped feeding, and also causes the guide driving unit 117 to switch the tray to the first tray 151*a*. Consequently, the image supposed to be formed on the overlapped recording paper is formed on the recording paper 2 again, and the recording paper 2 is discharged onto the first tray 151*a*.

The controller 110 causes the guide driving unit 117 to switch the tray to the second tray 151*b*, causes the image forming unit 104 to form the images on the recording paper 5, . . . and causes the recording paper 5 . . . having the images formed thereon to be discharged onto the second tray 151*b*.

Figure 27:
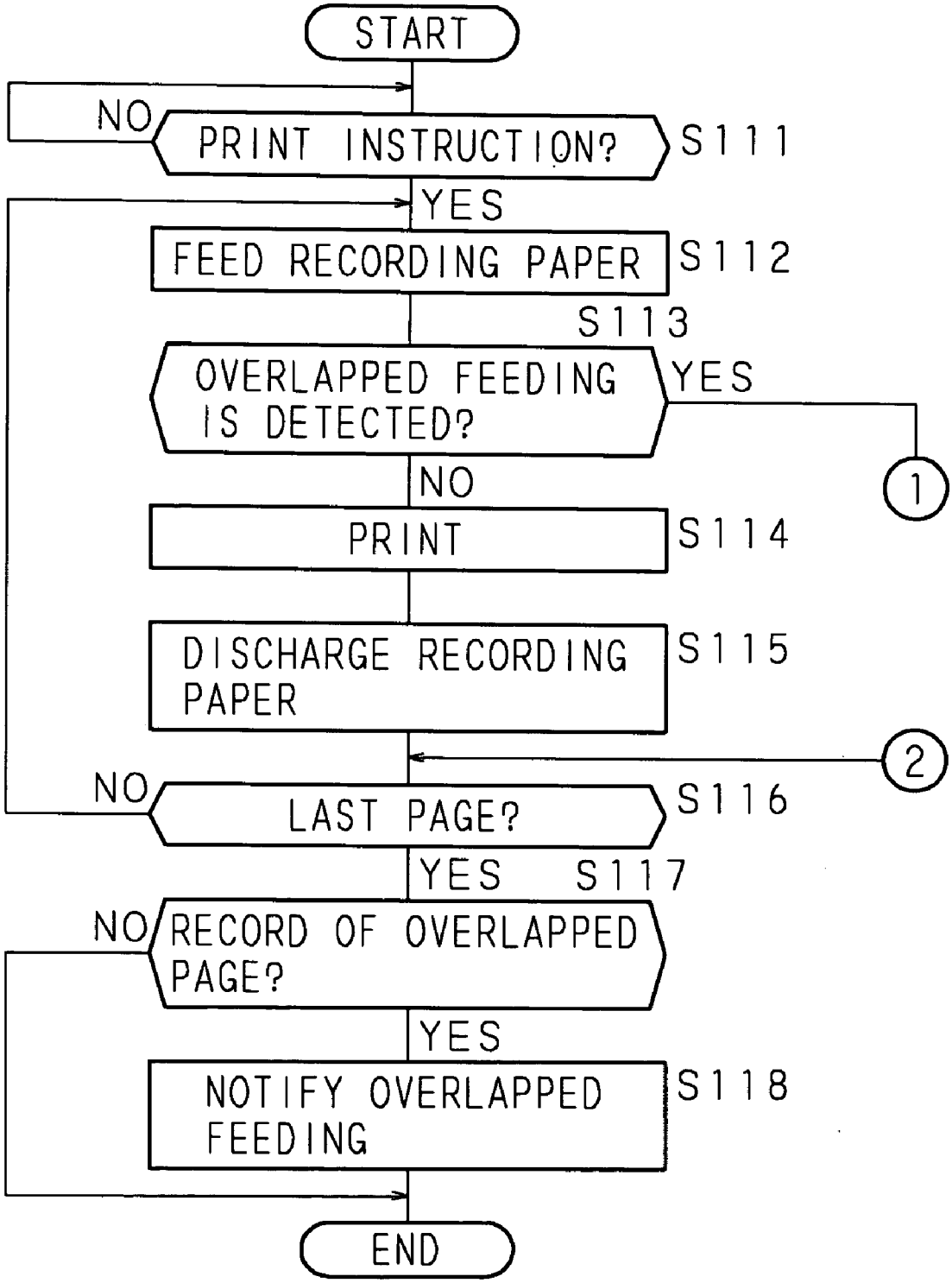
FIG. 27 is a flowchart showing the steps of a process executed by the image forming apparatus when overlapped feeding of recording paper is detected.
Figure 28:
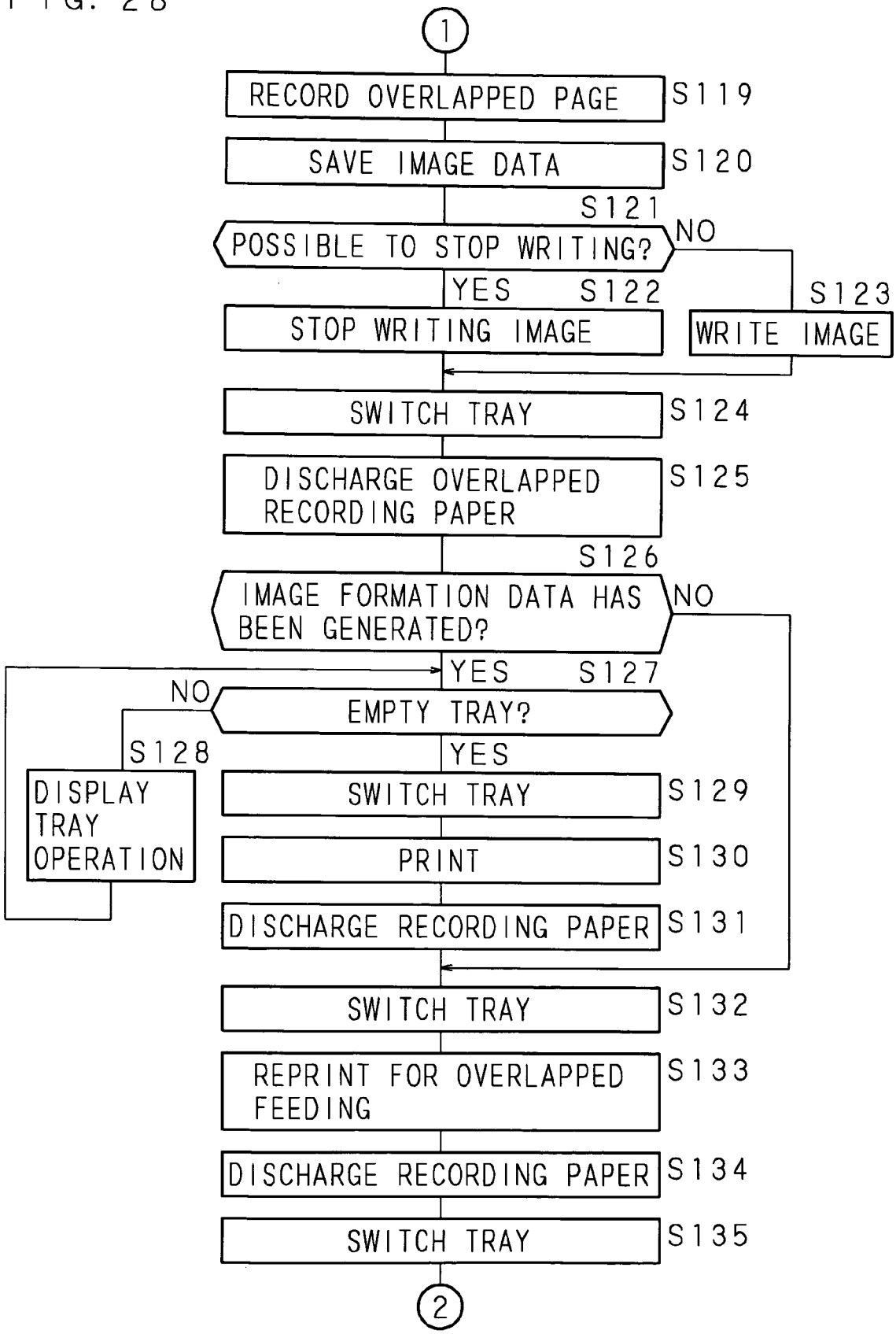
FIG. 28 is a flowchart showing the steps of a process executed by the image forming apparatus when overlapped feeding of recording paper is detected.

Next, the operation of the image forming apparatus 200 of the present invention will be explained. FIGS. 27 and 28 are flowcharts showing the steps of a process to be executed by the image forming apparatus 200 when overlapped feeding of recording paper is detected. The controller 110 determines, based on the information inputted from the operation unit 118, whether or not there is a print instruction (S111). If there is no print instruction (NO in S111), the controller 110 continues the process of step S111, and waits until a print instruction is given.

When there is a print instruction (YES in S111), the controller 110 causes the recording paper to be fed (S112). The controller 110 determines whether or not overlapped feeding was detected (S113). If overlapped feeding of recording paper is not detected (NO in S113), the controller 110 causes the image forming unit 104 to perform printing on the recording paper (S114), and causes the printed recording paper to be discharged onto a tray (for example, the first tray 151*a*) (S115).

The controller 110 determines whether the printed recording paper is the last page (S116), and, if it is not the last page (NO in S116), the controller 110 continues the processes in and after step S112. If it is the last page (YES in S116), the controller 110 determines whether or not there is a record of overlapped pages (S117). If there is a record of overlapped pages (YES in S117), the controller 110 causes the operation unit 118 to give an overlapped feeding notification to indicate how to handle the recording paper discharged onto the tray (S118), and finishes the process. If there is no record of overlapped pages (NO in S117), the controller 110 finishes the process.

On the other hand, when overlapped feeding is detected (YES in S113), the controller 110 records the overlapped pages representing the pages of recording paper fed in an overlapped manner (S119), and causes the image processing unit 115 to save the image data corresponding to the images supposed to be formed on the overlapped recording paper (S120). The controller 110 determines whether or not it is possible to stop writing on the overlapped recording paper (for example, image formation on the recording paper, or image formation on the photoreceptor drum) (S121).

If is it possible to stop writing (YES in S121), the controller 110 stops writing the image (S122), and causes the guide driving unit 117 to switch the tray (for example, from the first tray 151*a* to the third tray 151*c*) (S124), and causes the overlapped recording paper to be discharged onto the third tray 151*c* (S125). If it is not possible to stop writing (NO in S121), the controller 110 causes the image forming unit 104 to write the image (S123), and continues the processes in and after step S124.

The controller 110 determines whether or not the image formation data has already been generated in the image processing unit 115 (S126). If the image formation data has already been generated (YES in S126), the controller 110 determines whether or not there is an empty tray on which no recording paper is discharged, based on the detection results of the recording paper sensors 154*a*, 154*b* and 154*c* (S127). If there is no empty tray (NO in S127), the controller 110 causes the operation unit 118 to display a tray operation to remove the recording paper from a tray and create an empty tray (S128), continues the process of step S127, and waits until an empty tray is created.

If there is an empty tray (YES in S127), the controller 110 causes the guide driving unit 117 to switch the tray (for example, from the third tray 151*c* to the second tray 151*b*) (S129), and causes the image forming unit 104 to perform printing on the recording paper (S130). The controller 110 causes the printed recording paper to be discharged onto the tray (for example, the second tray 151*b*) (S131), and causes the guide driving unit 117 to switch the tray again (for example, from the second tray 151*b* to the first tray 151*a*) (S132).

On the other hand, if the image formation data has not been generated (NO in S126), the controller 110 continues the processes in and after step S132. The controller 110 causes the image forming unit 104 to print the contents to be printed on the overlapped recording paper again (S133), causes the printed recording paper to be discharged (S134), causes the guide driving unit 117 to switch the tray (for example, from the first tray 151*a* to the second tray 151*b*) (S135), and continues the processes in and after step S116.

Figure 29:
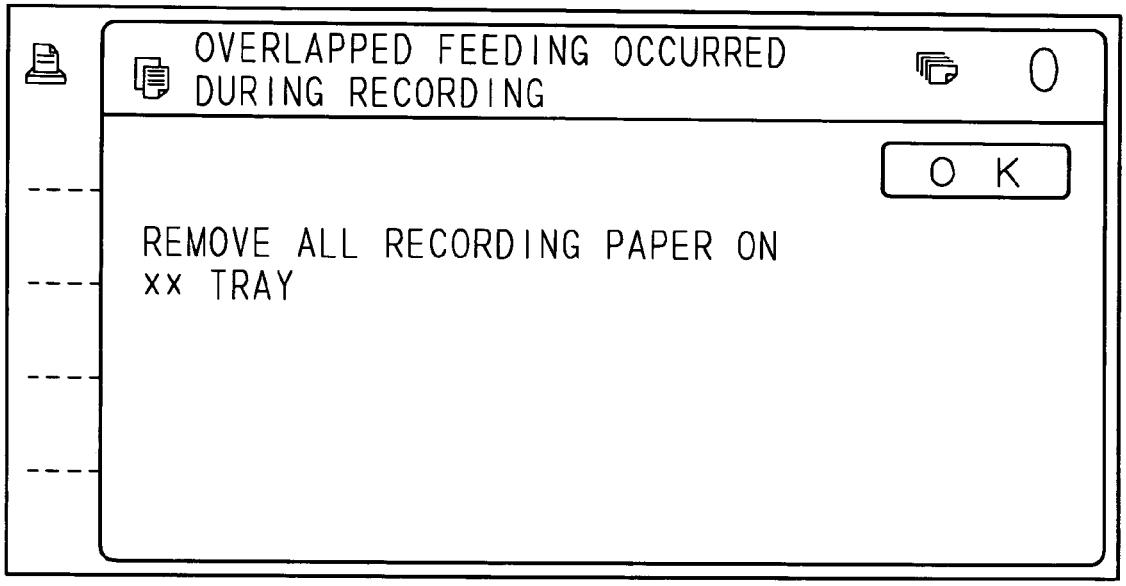
FIG. 29 is a schematic view showing one example of a screen displaying a tray operation when there is no empty tray.

FIG. 29 is a schematic view showing one example of a screen displaying a tray operation when there is no empty tray. As shown in FIG. 29, if there is no empty tray when overlapped feeding of recording paper is detected, a screen displaying an operation to remove the recording paper from a tray is displayed on the liquid crystal display of the operation unit 118. On the display screen, for example, a message such as "Overlapped feeding occurred during recording." and "Remove all the recording paper on the xx tray." is displayed. When the user removes the recording paper from the specified tray, the image forming apparatus 200 continues the image formation, and discharges the recording paper onto the tray.

Figure 30:
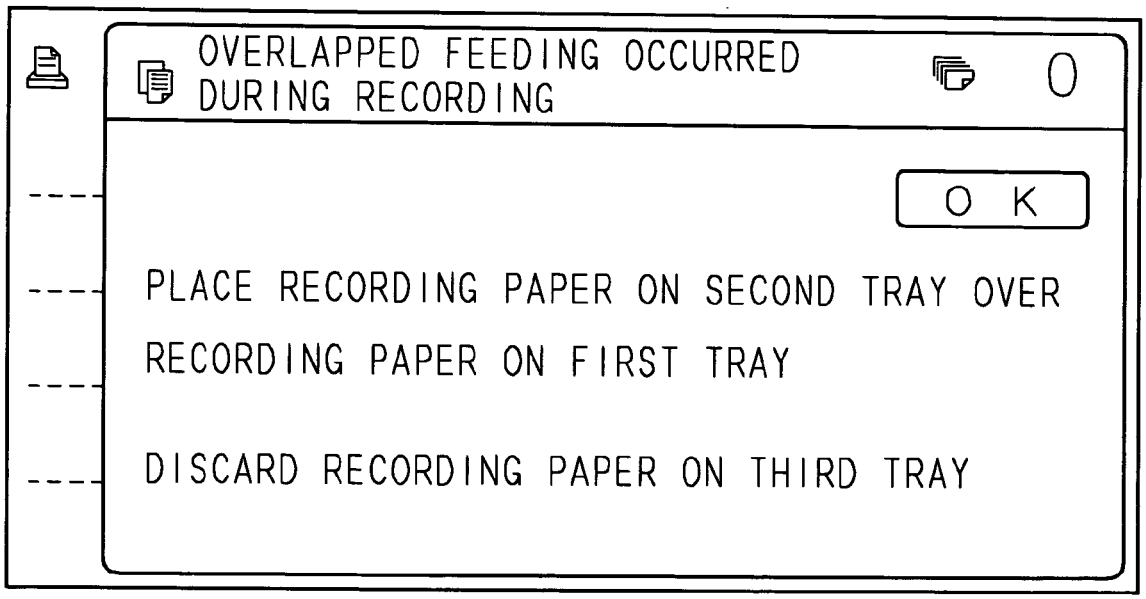
FIG. 30 is a schematic view showing one example of a screen displayed on a display screen when notifying overlapped feeding.

FIG. 30 is a schematic view showing one example of a screen displayed on the display screen when notifying overlapped feeding. As shown in FIG. 30, when overlapped feeding of recording paper is detected, a screen for notifying overlapped feeding of recording paper is displayed on the liquid crystal display of the operation unit 118. Displayed on the display screen is, for example, a message such as "Overlapped feeding occurred during recording.", "Place the recording paper on the second tray over the recording paper on the first tray.", and "Discard all the recording paper on the third tray.". If the user operates according to the instruction on the display screen, even when overlapped feeding occurs, it is possible easily distinguish the overlapped recording paper from normally printed recording paper, and it is possible to easily arrange the printed recording paper in the correct order.

Figure 31:
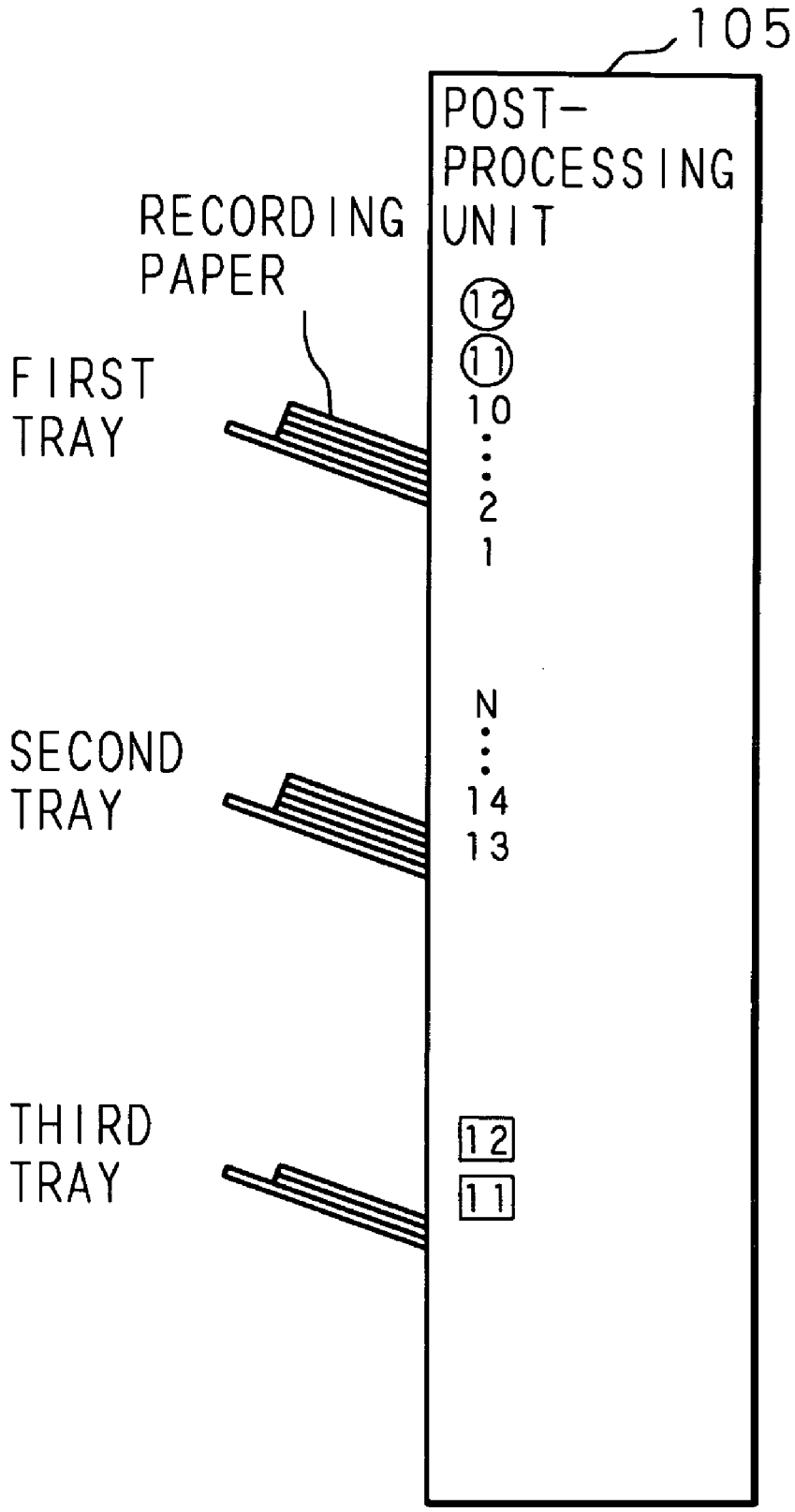
FIG. 31 is a schematic view showing one example of discharging of recording paper when overlapped feeding occurs.

FIG. 31 is a schematic view showing one example of discharging of recording paper when overlapped feeding occurs. The post-processing unit 105 includes three trays (the first tray, second tray and third tray). The page numbers (indicating which sheets) of the recording paper discharged onto the respective trays are indicated by 1, 2, . . . N (N is the last page). FIG. 31 shows the case where overlapped feeding occurred on the 11th and 12th sheets of recording paper. The number enclosed by a square indicates the page number (indicating which sheet) of recording paper where overlapped feeding occurred. The number enclosed by a circle indicates the page number of recording paper on which the image supposed to be formed on overlapped recording paper when overlapped feeding occurred was printed again.

Sheets of recording paper (1, 2, . . . 10) printed before the occurrence of overlapped feeding are discharged onto the first tray. Sheets of recording paper (13, 14, . . . N) fed after the overlapped recording paper are discharged onto the second tray. Sheets of overlapped recording paper (11 and 12) are discharged onto the third tray. The sheets of recording paper (11 and 12) printed again are discharged onto the first tray.

Figure 32:
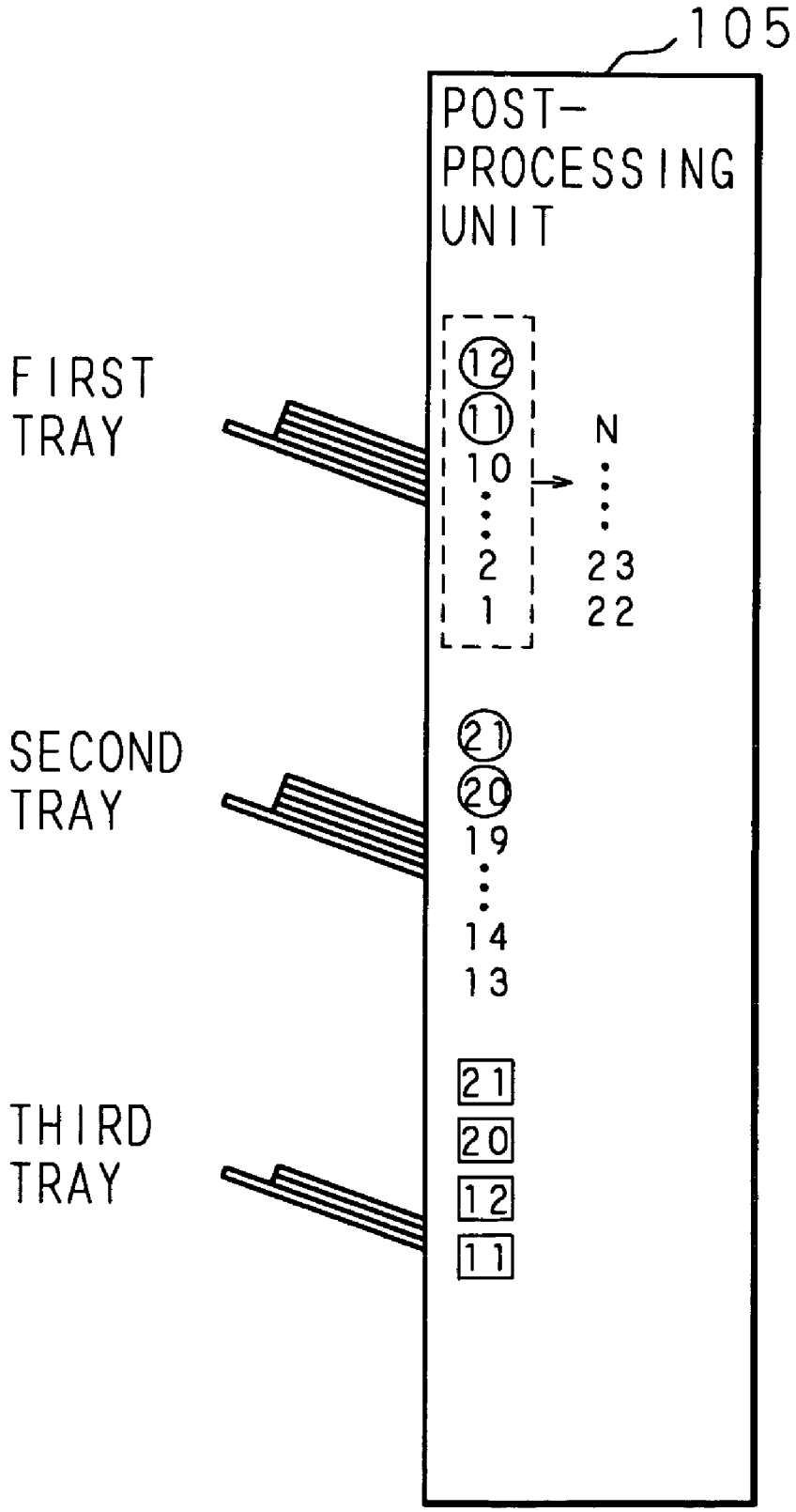
FIG. 32 is a schematic view showing one example of discharging of recording paper when overlapped feeding occurs twice.

FIG. 32 is a schematic view showing one example of discharging of recording paper when overlapped feeding occurs twice. The post-processing unit 105 includes three trays (the first tray, second tray and third tray). The page numbers (indicating which sheets) of the recording paper discharged onto the respective trays are indicated by 1, 2, . . . N (N is the last page). FIG. 32 shows the case where overlapped feeding occurred for the first time on the 11th and 12th sheets of recording paper, and overlapped feeding occurred for the second time on the 20th and 21st sheets of recording paper. The number enclosed by a square indicates the page number of recording paper where overlapped feeding occurred. The number enclosed by a circle indicates the page number of recording paper on which the image supposed to be formed on the overlapped recording paper when overlapped feeding occurred was printed again.

Sheets of recording paper (1, 2, . . . 10) printed before the occurrence of overlapped feeding are discharged onto the first tray. Sheets of recording paper (13, 14, . . . 19) printed after the first overlapped feeding but before the occurrence of the second overlapped feeding are discharged onto the second tray. The overlapped recording paper (11 and 12) is discharged onto the third tray. Sheets of recording paper (11 and 12) printed again are discharged onto the first tray.

When the second overlapped feeding occurs, there is no empty tray because the recording paper has already been discharged onto the first, second and third trays, and therefore, for example, a tray operation for asking the user to remove the recording paper (1, 2, . . . 12) on the first tray is displayed. After the user removes the recording paper (1, 2, . . . , 12) on the first tray, sheets of recording paper (22, 23, . . . N) fed after the overlapped recording paper are discharged onto the first tray. The overlapped recording paper (20 and 21) is discharged onto the third tray. Recording paper (20 and 21) printed again is discharged onto the second tray.

Thus, even when overlapped feeding occurs a plurality of times, it is possible to easily distinguish the overlapped recording paper from the normally printed recording paper, and it is possible to easily arrange the printed recording paper in the correct order by operating the image forming apparatus according to the instruction on the display screen.

As explained above, according to the present invention, even when overlapped feeding is detected, it is possible to continue the image forming processes on the recording paper without stopping, and it is possible to prevent a decrease in the overall job efficiency of the apparatus due to overlapped feeding. Moreover, it is possible to easily distinguish the overlapped recording paper from the normally printed recording paper, and it is possible to easily arrange the printed recording paper in the correct order, thereby reducing the burden of the user. Further, when overlapped feeding occurs, the image forming process in progress is not wasted, and the image to be formed on the overlapped recording paper can be promptly formed again. In particular, when there is a need to process a large amount of printing based on a large volume of image data at high speeds, the recording paper already discharged in the record order can be promptly removed from a tray and passed to the post processing after printing, and therefore it is possible to significantly reduce the burden of the user.

In Embodiment 2, although the ultrasonic sensor is used as means for detecting overlapped feeding of recording paper, the means is not limited to this, and it may be possible to use, for example, an optical sensor. However, in the case where the optical sensor is used, when the length of recording paper in the feed direction is detected and the distance between the leading end and the trailing end of the recording paper is larger than the dimension of the document, overlapped feeding is detected. Therefore, when two sheets of recording paper completely overlap each other, there is a possibility that overlapped feeding may not be detected. Thus, in terms of detection accuracy, the ultrasonic sensor is superior.

Although Embodiment 2 explains the case where three trays are provided, the number of trays is not limited to this, and it may be possible to provide four or more trays. If the number of trays is increased, when overlapped feeding occurs a plurality of times, it is possible to promptly discharge the recording paper fed after the overlapped feeding, without giving an instruction to remove the recording paper from a tray and waiting for the tray becomes empty if there is no empty tray.

In Embodiment 2, although the tray for discharging the recording paper is switched by the guide, switching of trays is not limited to this, and it may be possible to move the transport path itself to discharge the recording paper onto a predetermined tray, or it may be possible to switch a discharge location of the recording paper by moving the discharge tray.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An image forming apparatus comprising:

an image forming unit for forming an image on a fed sheet, based on input image data;

a plurality of trays for discharging a sheet having an image formed thereon;

a detecting unit for detecting overlapped feeding of a plurality of sheets; and a controller that controls the trays by, when overlapped feeding is detected by said detecting unit, causing a sheet having an image formed by said image forming unit before the detection of overlapped feeding to be discharged onto a first tray, and causing a sheet which is fed after the overlapped sheets where overlapped feeding was detected and has an image formed by said image forming unit to be discharged onto a second tray, wherein said controller further controls the trays by causing the sheets on which images involved in overlapped feeding are formed to be discharged on the third tray.

2. An image forming apparatus comprising:

an image forming unit for forming an image on a fed sheet, based on input image data;

a plurality of trays for discharging a sheet having an image formed thereon;

a detecting unit for detecting overlapped feeding of a plurality of sheets; and a controller that controls the trays by, when overlapped feeding is detected by said detecting unit, causing a sheet having an image formed by said image forming unit before the detection of overlapped feeding to be discharged onto a first tray, and causing a sheet which is fed after the overlapped sheets where overlapped feeding was detected and has an image formed by said image forming unit to be discharged onto a second tray, wherein when overlapped feeding is detected by said detecting unit, said image forming unit forms an image involved in overlapped feeding and to be formed on the overlapped sheets, on a sheet fed after the overlapped sheets, based on image data corresponding to the image.

3. The image forming apparatus according to claim 2, wherein said controller is further capable of determining whether or not it is possible to interrupt image formation in progress when overlapped feeding is detected by said detecting unit, and when said controller determines that it is possible to interrupt the image formation, said image forming unit forms an image involved in overlapped feeding on a sheet fed after the overlapped sheets, based on image data corresponding to the image.

4. The image forming apparatus according to claim 3, further comprising an image processing unit for generating data for use in forming an image based on image data, wherein said controller is further capable of determining whether or not it is possible to interrupt the image forming process, based on data already generated in said image processing unit, when overlapped feeding is detected.

5. The image forming apparatus according to claim 2, wherein said controller is further capable of causing the sheet on which the image involved in overlapped feeding is formed to be discharged onto the first tray.

6. An image forming apparatus comprising:

an image forming unit for forming an image on a fed sheet, based on input image data;

a plurality of trays for discharging a sheet having an image formed thereon;

a detecting unit for detecting overlapped feeding of a plurality of sheets; and a controller that controls the trays by, when overlapped feeding is detected by said detecting unit, causing a sheet having an image formed by said image forming unit before the detection of overlapped feeding to be discharged onto a first tray, and causing a sheet which is fed after the overlapped sheets where overlapped feeding was detected and has an image formed by said image forming unit to be discharged onto a second tray, wherein said controller is further capable of:

determining presence or absence of sheets on a tray; and switching the tray, based on the determined presence or absence of sheets, when overlapped feeding is detected by said detecting unit, wherein said image forming unit interrupts image formation when said controller determines that there are sheets on all of the trays, said image forming unit resumes the interrupted image formation when said controller determines that there is no sheet on at least one of the trays; and said controller is further capable of causing a sheet having an image formed by the resumed image formation to be discharged onto said tray, further comprising an output unit for outputting an instruction to remove sheets on at least one of the trays if a determination is made that sheets are present on all of the trays when overlapped feeding is detected by said detecting unit.

7. An image forming method for forming an image on a fed sheet based on input image data, and discharging the sheet having the image formed thereon, comprising:

detecting overlapped feeding of a plurality of sheets; and when overlapped feeding is detected, discharging, onto a first tray, a sheet having an image formed before the detection of overlapped feeding, and discharging, onto a second tray, a sheet fed after overlapped sheets where overlapped feeding was detected and having an image formed thereon, and discharging, onto a third tray, the sheets on which images involved in overlapped feeding are formed.

* * * * *